US010457477B2

(12) United States Patent
Hu et al.

(10) Patent No.: US 10,457,477 B2
(45) Date of Patent: Oct. 29, 2019

(54) SLICED ASSEMBLY TYPE CONTAINER AND METHOD FOR MANUFACTURING THE SAME

(71) Applicants: Shanghai CIMC YangShan Logistics Equipment Co., Ltd., Shanghai (CN); Shanghai Sunnyway Mechanical & Electrical Equipment Company, Shanghai (CN)

(72) Inventors: Haoqi Hu, Jiangsu (CN); Deyong Sun, Jiangsu (CN); Hao Li, Shanghai (CN); Dong Qian, Shanghai (CN); Xiliang Zhang, Jiangsu (CN)

(73) Assignees: Shanghai CIMC YangShan Logistics Equipment Co. Ltd., Shanghai (CN); Shanghai Sunnyway Mechanical & Electrical Equipment Co., Shanghai (CN)

( * ) Notice: Subject to any disclaimer, the term of this patent is extended or adjusted under 35 U.S.C. 154(b) by 620 days.

(21) Appl. No.: 14/917,731

(22) PCT Filed: Jul. 29, 2014

(86) PCT No.: PCT/CN2014/000720

§ 371 (c)(1),
(2) Date: Mar. 9, 2016

(87) PCT Pub. No.: WO2015/032168

PCT Pub. Date: Mar. 12, 2015

(65) Prior Publication Data

US 2016/0288993 A1 Oct. 6, 2016

(30) Foreign Application Priority Data

Sep. 9, 2013 (CN) ..... 2013 1 0406905

(51) Int. Cl.
*B65D 90/08* (2006.01)
*B65D 88/52* (2006.01)
(Continued)

(52) U.S. Cl.
CPC ..... *B65D 90/08* (2013.01); *B65D 88/121* (2013.01); *B65D 88/528* (2013.01); *B65D 90/008* (2013.01)

(58) Field of Classification Search
CPC .. B65D 88/528; B65D 88/121; B65D 90/023; B65D 90/008; B65D 90/08
See application file for complete search history.

(56) References Cited

U.S. PATENT DOCUMENTS

2007/0000921 A1* 1/2007 Butler ..... B65D 88/121 220/1.5

FOREIGN PATENT DOCUMENTS

CN 2758214 Y 2/2006
CN 2758215 Y 2/2006
(Continued)

*Primary Examiner* — Andrew T Kirsch
*Assistant Examiner* — Don M Anderson
(74) *Attorney, Agent, or Firm* — Fox Rothschild LLP

(57) ABSTRACT

A sliced assembly type container, manufacturing, stacking and transportation methods, and finished modules. The sliced assembly type container meets requirements of the ISO on a universal cargo container. The sliced assembly type container comprises a bottom finished module (1), two side finished modules (2, 3), two door finished modules (6, 7), a top finished module (5), and a front finished module (4). Adjacent modules are fixed by using a connection structure, and/or fixing glue, and/or welding, and/or another manner.

32 Claims, 38 Drawing Sheets

(51) Int. Cl.
*B65D 88/12* (2006.01)
*B65D 90/00* (2006.01)

(56) References Cited

FOREIGN PATENT DOCUMENTS

| | | | |
|---|---|---|---|
| CN | 1762776 | A | 4/2006 |
| CN | 101267992 | A | 9/2008 |
| CN | 101412462 | A | 4/2009 |
| CN | 101456475 | A | 6/2009 |
| CN | 101734441 | A | 6/2010 |
| CN | 101898664 | A | 12/2010 |
| CN | 2740566 | Y | 11/2015 |
| DE | 202005016455 | U1 | 2/2006 |
| DE | 102008021515 | A1 | 11/2009 |
| FR | 2083539 | A3 | 12/1971 |
| JP | H10101186 | A | 4/1998 |
| WO | 198807477 | A1 | 10/1988 |
| WO | 1999030989 | A1 | 6/1999 |
| WO | 2006024396 | A2 | 3/2006 |
| WO | 2006024396 | A3 | 4/2006 |

* cited by examiner

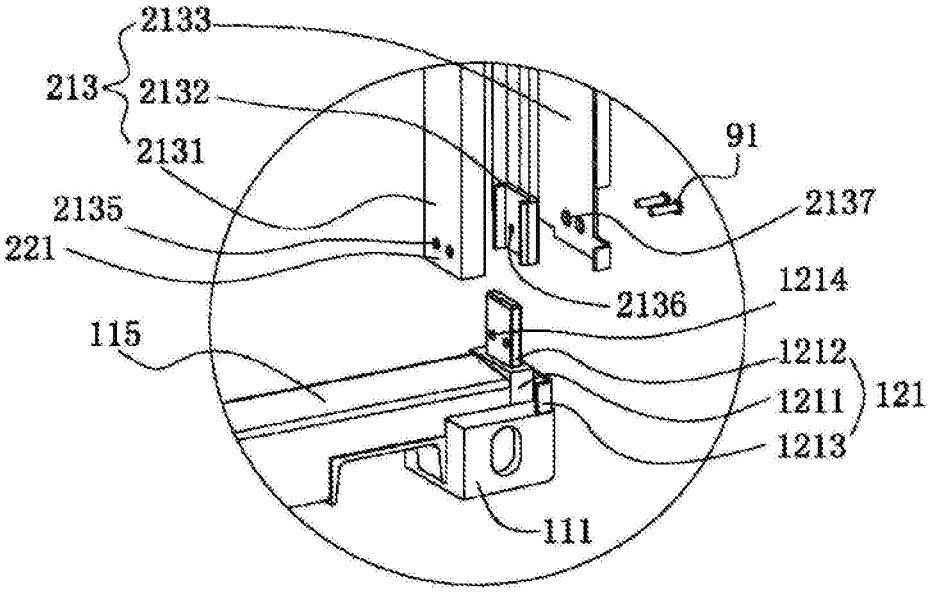
Fig.6C
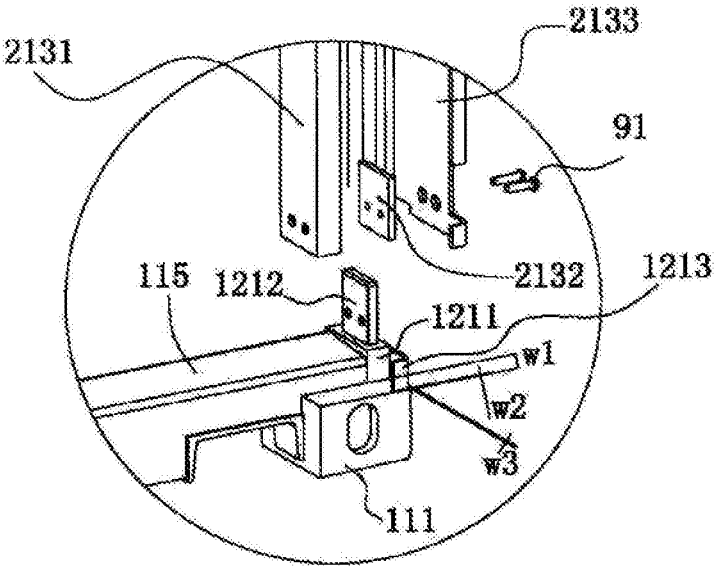
Fig.6C0

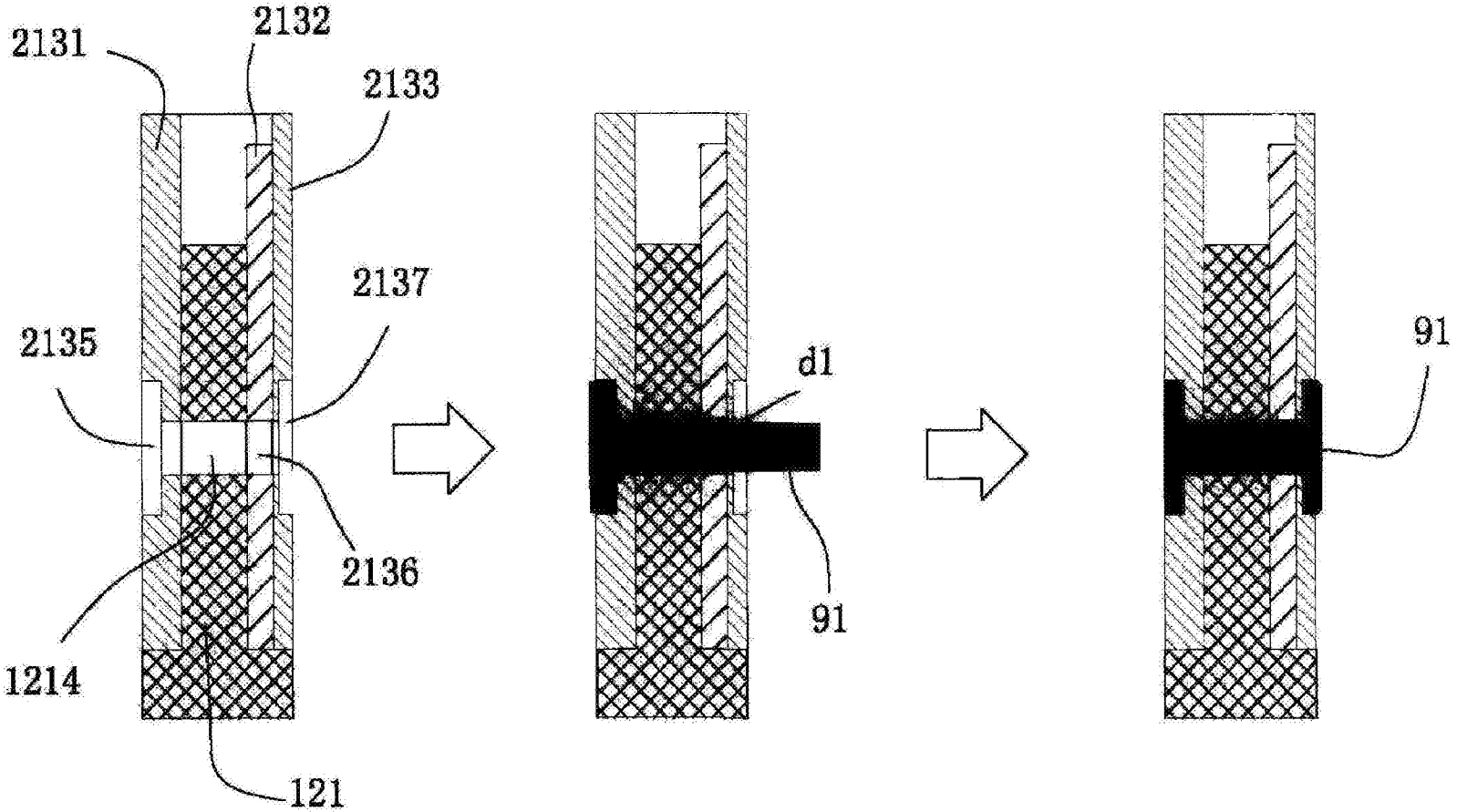
Fig.6C1

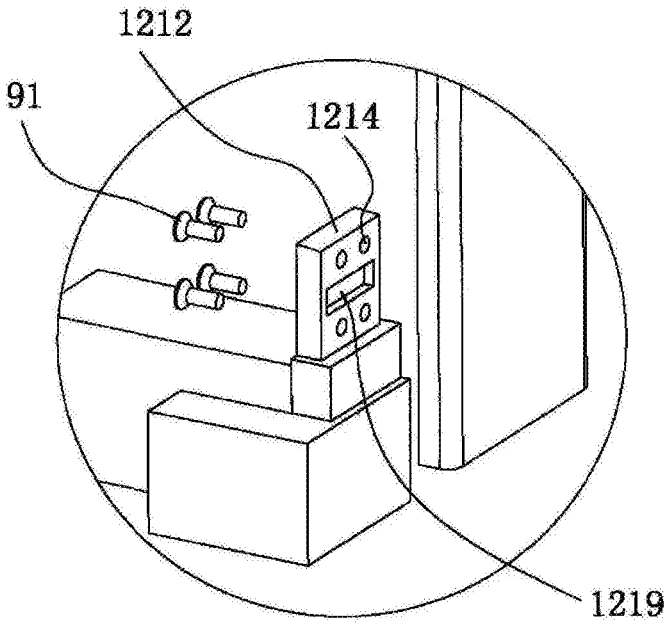
Fig.6C2
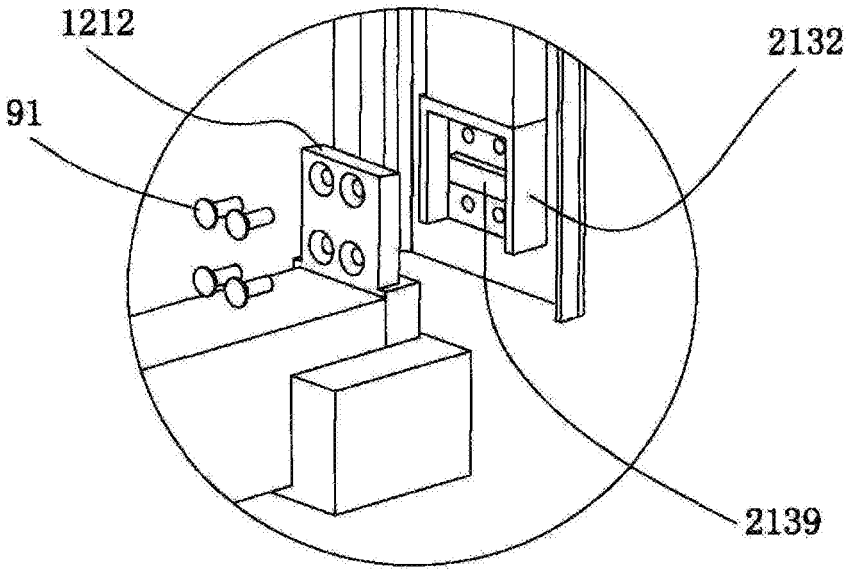
Fig.6C3

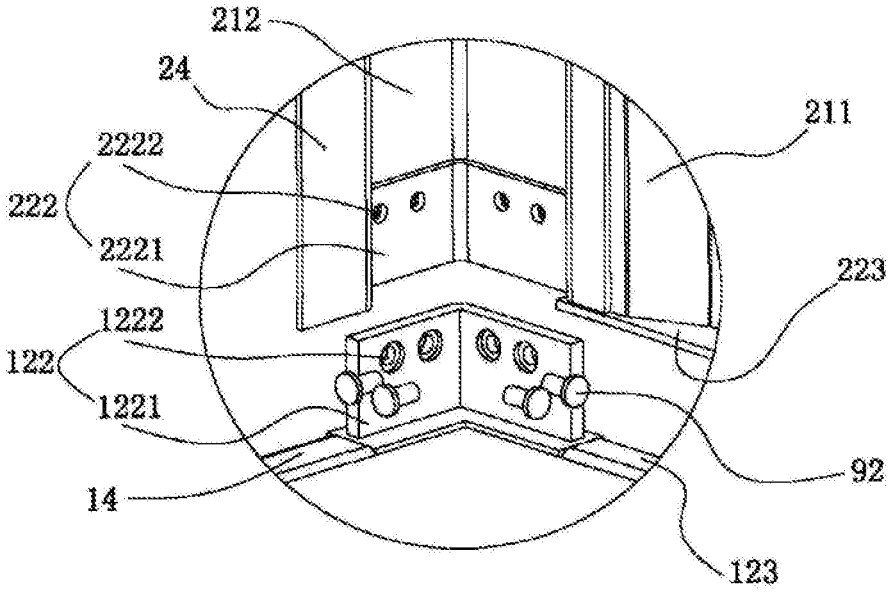
Fig.7A0
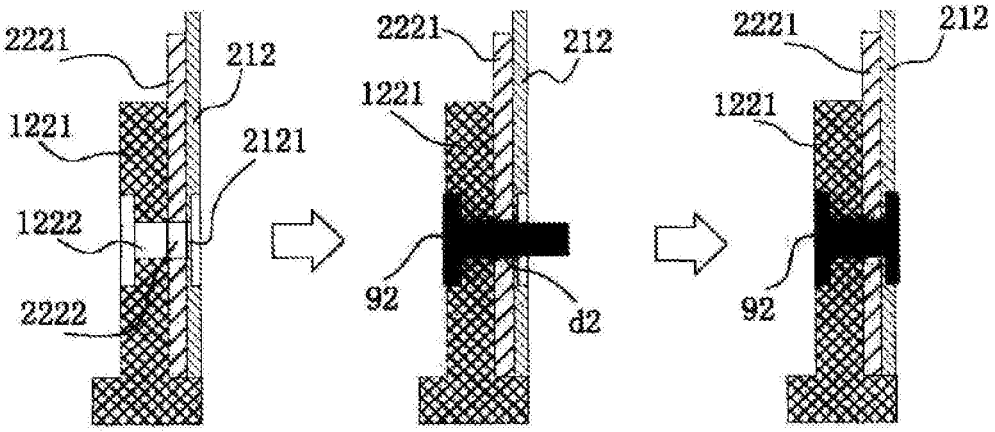
Fig.7A1

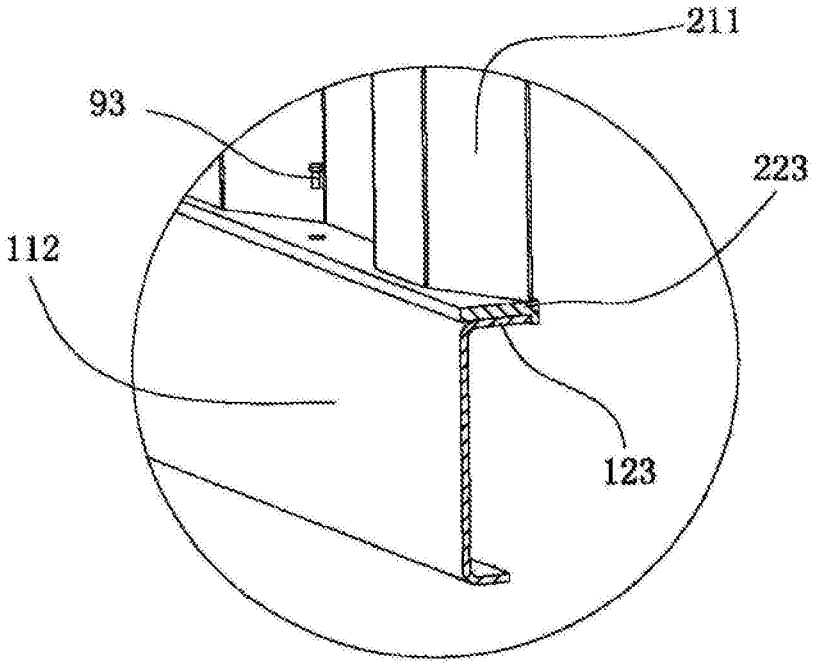
Fig.8A
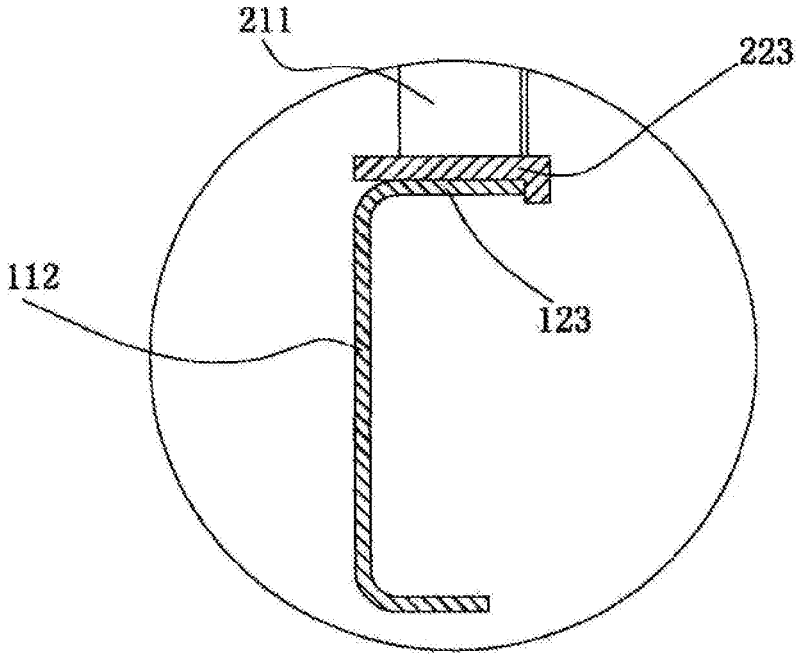
Fig.8A1

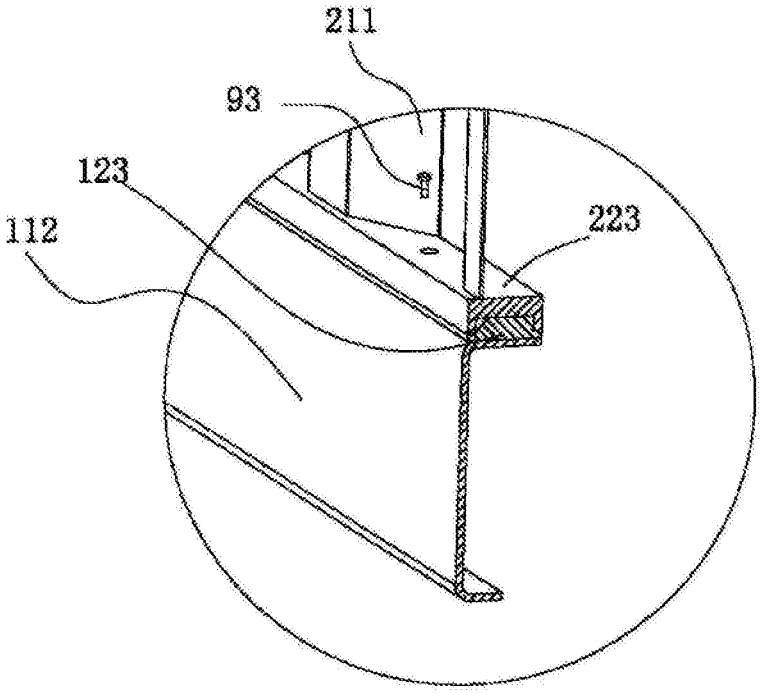
Fig.8B
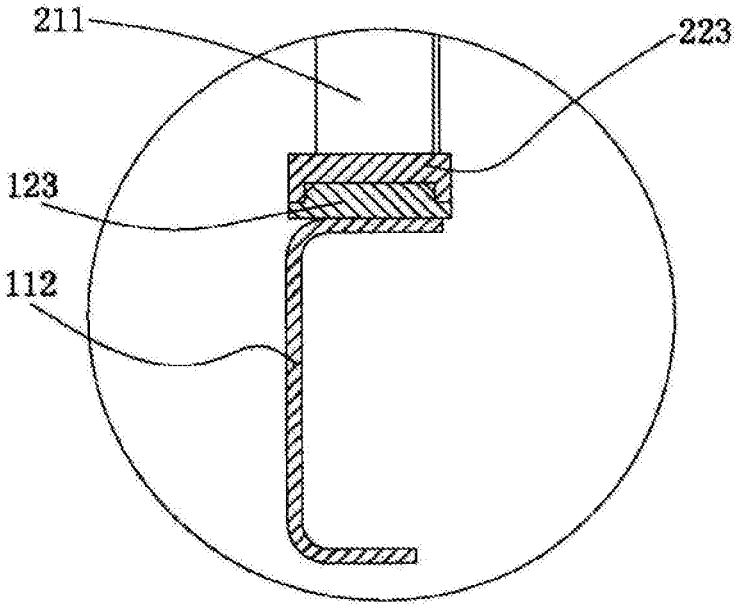
Fig.8B1

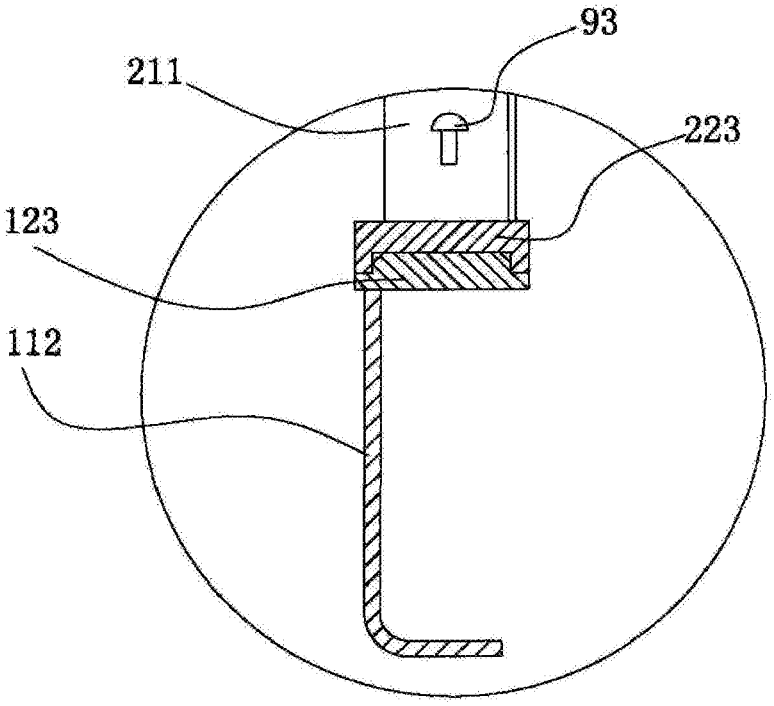
Fig.8C
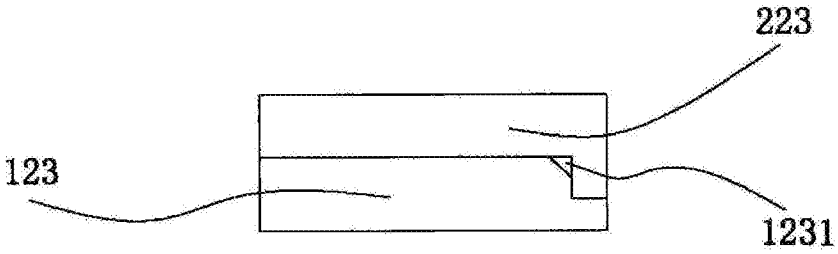
Fig.8C1
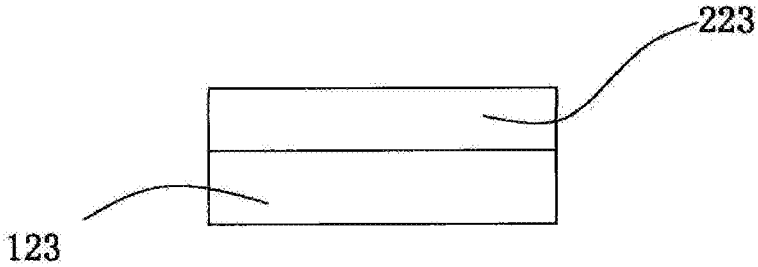
Fig.8C2

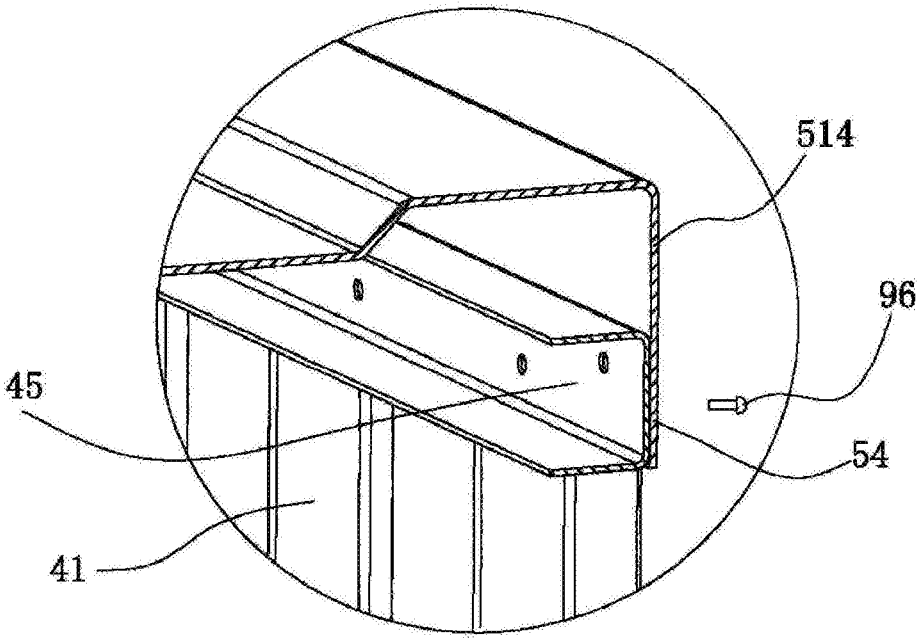
Fig.11A
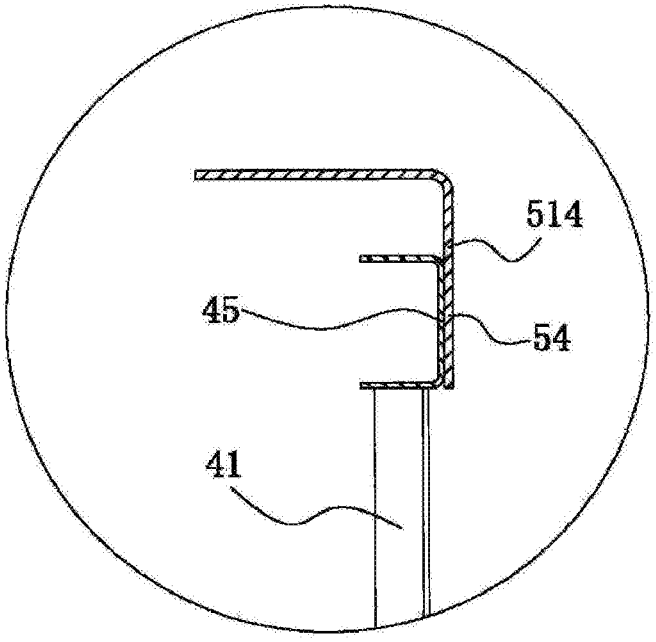
Fig.11A1

Fig.12A1

SLICED ASSEMBLY TYPE CONTAINER AND METHOD FOR MANUFACTURING THE SAME

CROSS-REFERENCE TO RELATED APPLICATIONS

This application is a U.S. National Phase of International Application No. PCT/CN2014/000720, filed Jul. 29, 2014, which claims priority to China Patent Application No. 201310406905.4, filed Sep. 9, 2013, the disclosures of which are incorporated herein by reference.

TECHNICAL FIELD

The disclosure relates generally to structure designing, manufacturing, stacking and transportation of containers, and more specifically to structure designing, manufacturing, stacking and transportation of general cargo containers in consistent with ISO standards.

BACKGROUND

Dry containers, mainly used to transport general cargo and have a wide range of applications, take an amount of 70-80% in the total containers. Generally, there are two types of dry containers, 20 feet and 40 feet containers. In order to ensure product quality and transportation safety and the like, ISO (International Standardization Organization) issued strict provisions to general cargo containers (normally called dry container), for example: ISO 1496-1 puts forward very strict provisions about the rigidity and inner space of the general cargo container. For the container, except for the provisions in ISO, in order to satisfy special requirements for the containers, CSC (The International Convention for Safe Containers) issued corresponding provisions, and UIC (Union Internationale des Chemins de Fer), TIR (Transport International Router) issued corresponding provisions, too. A dry container generally comprises a closed structure having a door disposed at back end, and the structure generally comprises: an underframe comprising two bottom longitudinal beams, two front end bottom corner fittings and two door end bottom corner fittings respectively on both ends of the two bottom longitudinal beams, a front end bottom beam connected between the two front end bottom corner fittings, a doorsill connected between the two door end bottom corner fittings, a plurality of bottom crossbeams each connected between the two bottom longitudinal beams, and a floor laid on the bottom crossbeams; four corner pillars comprise two front end corner pillars corresponding to two front end bottom corner fittings and two door end corner pillars corresponding to two door end corner fitting; two lateral walls, each lateral wall is correspondingly connecting to the front end corner pillar at front end and connecting to back end the corner pillar at back end; front wall, connected two front end corner pillar between; a door mounted between two back end corner pillar; and a top frame comprising two top longitudinal beams which are respectively on two front end top corner fittings and two door end top corner fittings on both ends of two top longitudinal beams, a front end bottom beam connected between the two front end top corner fittings, a lintel connected between the two door end bottom corner fittings, and a top plate. According to the traditional container manufacturing technology, the container is generally manufactured as whole, that is, after all parts are assembled and welded to from a complete box, a series of subsequent processes such as sand-blasting, painting, floor mounting are performed on the whole box. In order to increase manufacturing efficiency and reduce manufacturing cost, traditional way is to improve the automation degree of the basic processes such as welding and painting by continuously increasing/improving the automation equipments. However, such way of manufacturing the box as whole is always troubled by its inherent problems: first, the automation degree of the container manufacturing is low because on one hand, transportation is difficult due to cumbersome of the assembled container, and on the other hand, after assembling of the container, any wok within the box of the container is limited by conditions of the box, thus automation is difficult; second, delivering cost of the empty containers are high, since all new containers are empty, during delivering of the empty containers from manufacturer to destination, their inner spaces are vacant and cannot be utilized, thus transportation efficiency is low, and delivering cost is high; third, stacking space is big, and stacking cost is high, because the containers occupy huge stacking space and floor area in the factory, stacking cost is higher and higher; fourth, environment pressure is high, and it is difficult to perform optimization and allocation of resources, e.g., painting on the whole assembled would have negative impacts on either environment or operation persons; fifth, factory site is limited, because to avoid the high transportation cost, manufacturing factories t have to be set up in each container demand site, so, on one hand, the possibility of pollution diffusion will be increased, and on the other hand, the optimal allocation of resources will be more difficult.

SUMMARY

The disclosure aims to overcome the shortcomings of the existing technology, and provides a new sliced assembly type container, which, under the condition that all requirements about a common cargo container in ISO are satisfied, can improve the normal technology of manufacturing container as whole to a new technology of manufacturing and assembling finished modules, which can bring about a revolutionary improvement to structural designing, manufacturing, stacking and transporting of the containers.

Aiming to solve the technical problems stated above, the disclosure provides a sliced assembly type container, the sliced assembly type container is in consistent with requirements about a general cargo container in ISO and comprises a bottom finished module, two lateral finished modules, two door finished modules, top finished a module, and a front finished module, the two door finished modules are respectively hinged to a door end of lateral bodies of the two lateral finished modules, wherein:

The bottom finished module comprises: a bottom body; two bottom lateral connecting parts, respectively disposed on both sides of the bottom body, to fixedly connect the two lateral finished modules, each of the bottom lateral connecting parts comprises a lateral connecting element, a first corner connecting element at a door end of the lateral connecting element, and a second corner connecting element at a front end of the lateral connecting element; and a bottom front connecting part, disposed at a front end of the bottom body, to connect the front finished module.

The lateral finished modules comprises: a lateral body; lateral bottom connecting parts, disposed on a bottom side of the lateral body, to fixedly connect the bottom finished module, each of the lateral bottom connecting parts comprises a lateral connecting element, a first corner connecting element at a door end of the lateral connecting element, and a second corner connecting element at a front end of the lateral connecting element; lateral top connecting parts, disposed on a top side of the lateral body, to fixedly connect the top finished module, each of the lateral top connecting parts comprises a lateral connecting element, a first corner connecting element at a door end of the lateral connecting element, and a second corner connecting element at a front end of the lateral connecting element; and a lateral front connecting part, disposed at a front end of the lateral body, to connect the front finished module.

The top finished module comprises: a top body; two top lateral connecting parts, respectively disposed on both sides of the top body, to fixedly connect the two lateral finished modules, each of the top lateral connecting parts comprises a lateral connecting element, a first corner connecting element at a door end of the lateral connecting element, and a second corner connecting element at a front end of the lateral connecting element; and a top front connecting part, disposed at a front end of the top body, to connect the front finished module.

The front finished module comprises: a front body; a front bottom connecting part, disposed on a bottom side of the front body, to connect the bottom finished module; two front lateral connecting parts, respectively disposed on both sides of the front body, to connect the two lateral finished modules; and a front top connecting part, disposed on a top side of the front body, to connect the top finished module.

Wherein between the bottom finished module and the lateral finished modules as well as between the lateral finished modules and the top finished module, totally four pairs of lateral connecting elements may fixedly connected together via a connecting piece and/or a structural adhesive; between the bottom finished module and the front finished module, between the top finished module and the front finished module, as well as between the two lateral finished modules and the front finished module, totally four pairs of side connections may be fixedly connected together via a connecting piece and/or a structural adhesive; between the bottom finished module and the lateral finished modules as well as between the lateral finished modules and the top finished module, total eight pairs of the corner connection elements may be fixedly connected together via a connecting piece; and sealing process is performed on coupled portions between the modules of the sliced assembly type container.

Preferably, the sliced assembly type container is in consistent with requirements about container in CSC and/or UIC.

Preferably, the sliced assembly type container is in consistent with requirements about a container in TIR.

The door finished modules and the lateral finished modules may be coupled together as one finished module; or, the door finished modules and the lateral finished modules may be two finished modules separated from each other.

As a variation of the sliced assembly type container, at least one pair of the eight pairs of the corner connection elements may be fixedly connected together by welding.

As a variation of the sliced assembly type container, the front finished module may be hinged to one module of the two lateral finished modules, the bottom finished module, and the top finished module; and the front finished module may be fixedly connected to the rest modules of the two lateral finished modules, the bottom finished module, and the top finished module via a connecting piece and/or a structural adhesive. By such structure, the front finished module may be assembled with the lateral finished modules, the bottom finished module or top finished module in advance in a factory, so as to facilitate stacking/transporting.

Aiming to solving the technical problems stated above, the disclosure further provides a method for manufacturing a sliced assembly type container, which comprises: a manufacturing process of finished modules for separately manufacturing the bottom finished module, the two lateral finished modules, the two door finished modules, the top finished module, and the front finished module; and an assembling process of the container for assembling the finished modules together, the assembling process is based on the bottom finished module, and the assembling process comprises sealing coupled portions between the modules by applying a glue, an adhesive tape or adhesive sheet;

wherein the two door finished modules are being able to be coupled to the two lateral finished modules during the manufacturing process of finished modules in advance, or able to be assembled with the two lateral finished modules during the assembling process of the container.

Further, the method comprises, between the manufacturing process of finished modules and the assembling process of the container: stacking the manufactured finished modules.

In one embodiment, both the manufacturing process of finished modules and the assembling process of the container are able to be completed in manufacturing site.

In another embodiment, the manufacturing process of finished modules is able to be completed at manufacturing site, and the assembling process of the container is able to be completed at delivery site.

Aiming to solving the technical problems stated above, the disclosure further provide a method for stacking and transporting the sliced assembly type container, which comprises the following steps: arranging the bottom finished module at bottom; respectively stacking the front finished module, the two lateral finished modules, and the two door finished modules on the bottom finished module; stacking the top finished module at top, and packing the finished modules together to form a stacking and transporting basic unit.

Further, the stacking and transporting method may further comprise: stacking a plurality of the transporting basic units together to form a stacking and transporting unit.

Aiming to solve the technical problems stated above, the disclosure further provides a bottom finished module for the sliced assembly type container. The bottom finished module comprises: a bottom body; two bottom lateral connecting parts, respectively disposed on both sides of the bottom body, to fixedly connect the two lateral finished modules, each of the bottom lateral connecting parts comprises a lateral connecting element, a first corner connecting element at a door end of the lateral connecting element, and a second corner connecting element at a front end of the lateral connecting element; and a bottom front connecting part, disposed at a front end of the bottom body, to connect the front finished module; wherein the bottom body comprises two set of door end bottom corner fittings, bottom longitudinal beams and front end bottom corner fittings on both sides thereof, a front end bottom beam connected between the two front end bottom corner fittings, a doorsill connected between the two door end bottom corner fittings, bottom crossbeams each connected between the two bottom longitudinal beams, and a floor; the first corner connecting element is disposed on a top of the door end bottom corner fittings, the second corner connecting element is disposed on a top of the front end bottom corner fitting, the lateral connecting element is disposed on a top of the bottom longitudinal beam; the lateral connecting element of the bottom lateral connecting part is disposed on the front end bottom beam of the bottom body.

Aiming to solve the technical problems stated above, the disclosure further provides a top finished module for a sliced assembly type container. The sliced assembly type container is in consistent with requirements about a common cargo container in ISO; the top finished module comprises: a top body; two top lateral connecting parts, respectively disposed on both sides of the top body, to fixedly connect the two lateral finished modules, each of the top lateral connecting parts comprises a lateral connecting element, a first corner connecting element at a door end of the lateral connecting element, and a second corner connecting element at a front end of the lateral connecting element; and a top front connecting part, disposed at a front end of the top body, to connect the front finished module; the top body comprises two set of door end top corner fittings, top longitudinal beams, and front end top corner fittings on both sides, a front end top beam connected between the two front end top corner fittings, a lintel connected between the two door end top corner fittings, and a top plate; the first corner connecting element is disposed on a bottom of the door end top corner fitting of the top body, the second corner connecting element is disposed on a bottom of the front end top corner fitting, the lateral connecting element is disposed on a bottom of the top longitudinal beam; the top front connecting part is disposed on the front end top beam of the top body.

Aiming to solving the technical problems stated above, the disclosure further provides a lateral finished module for a sliced assembly type container. The lateral finished module comprises: a lateral body; lateral bottom connecting parts, disposed on a bottom side of the lateral body, to fixedly connect the bottom finished module, each of the lateral bottom connecting parts comprises a lateral connecting element, a first corner connecting element at a door end of the lateral connecting element, and a second corner connecting element at a front end of the lateral connecting element; lateral top connecting parts, disposed on a top side of the lateral body, to fixedly connect the top finished module, each of the lateral top connecting parts comprises a lateral connecting element, a first corner connecting element at a door end of the lateral connecting element, and a second corner connecting element at a front end of the lateral connecting element; and a lateral front connecting part, disposed at a front end of the lateral body, to connect the front finished module; wherein the first corner connecting element disposed on the bottom of the door end corner pillar, the second corner connecting element is disposed on a bottom of the front end corner pillar, the lateral connecting element is disposed on a bottom of the lateral wall; the lateral front connecting part is disposed on the front end corner pillar of the lateral body.

Aiming to solve the technical problems stated above, the disclosure further provides a front finished module for the sliced assembly type container. The front finished module comprises: a front body; a front bottom connecting part, disposed on a bottom side of the front body, to connect the bottom finished module; two front lateral connecting parts, respectively disposed on both sides of the front body, to connect the two lateral finished modules; and a front top connecting part, disposed on a top side of the front body, to connect the top finished module.

In comparison with the prior art, the sliced assembly type container, the corresponding manufacturing, stacking and transporting method, and the finished modules according to the disclosure, the normal technology of manufacturing a container as whole is improved to a new technology manufacturing and assembling various finished modules by dividing the container to a bottom module, a top module, two lateral modules, two doors and a front module, and performing processes such as welding and painting on those finished modules, and designing connection relations of the respective finished modules, all requirements about a common cargo container in ISO can be satisfied, thus a revolutionary improvement is brought for the structural designing, manufacturing, stacking and transporting of the containers.

BRIEF DESCRIPTION OF THE DRAWINGS

FIGS. 2A, 2B, 2C, 2D, 2E and 2F are perspective views showing the finished modules of the disclosure, wherein FIGS. 2A and 2B show two bottom finished modules from different views, FIGS. 2C and 2D show two top finished modules from different views, FIG. 2E shows a lateral finished module, and FIG. 2F shows a front finished module.

FIGS. 4A and 4B are a flow diagram of a manufacturing method of a sliced assembly type container of the disclosure, wherein FIG. 4A shows lateral finished modules being coupled with a door finished module, FIG. 4B shows the lateral finished modules and the door finished module being separated from each other.

FIGS. 6A, 6B, 6C, 6C0, 6C1, 6C2, 6C3, 6D, 6E, 6F, 6G and 6H shows connection relations of corners at door ends of the lateral finished module and the bottom finished module according to the disclosure, wherein FIG. 6A shows a plug-in relation of a protruded bottom to a depressed side, FIG. 6B shows a plug-in relation of a depressed bottom to a protruded side, FIG. 6C shows a plug-in relation of a protruded bottom to a depressed side, FIG. 6C0 shows a plug-in relation of a protruded bottom to a depressed side, FIG. 6C1 shows a process of connecting by rivets based on FIG. 6C/6C0, FIGS. 6C2 and 6C3 show an overlapping relation between a vertical bottom and a vertical side in two different perspectives, FIG. 6D shows a plug-in relation of a protruded bottom to a depressed side, FIG. 6E shows a plug-in relation of a protruded bottom to a depressed side, FIG. 6F shows an overlapping relation of a flat bottom to a flat side, FIG. 6G shows a connecting relation of a protruded bottom to depressed side plug-in with a filler, FIG. 6H shows a plug-in relation and connecting relation of a depressed bottom to protruded side with a filler.

FIGS. 7A, 7A0, 7A1, 7B, 7C, 7D and 7E schematically show connection relations of corners at the front end of a lateral finished module and a bottom finished module according to the disclosure, wherein FIG. 7A shows an overlapping relation of a flat bottom to a flat side, FIG. 7A0 shows an overlapping relation of a vertical bottom to a vertical side, FIG. 7A1 shows a process of connecting with rivets based on FIG. 7A0, FIG. 7B shows a plug-in relation of a depressed bottom to a protruded side, FIG. 7C shows an overlapping relation of a flat bottom to a flat side in combination with a vertical bottom to a vertical side, FIG. 7D shows a plug-in relation and connecting relation of a protruded bottom to depressed side with a filler, FIG. 7E shows a plug-in relation and a connecting relation of a depressed bottom to protruded side with a filler.

FIGS. 8A, 8A1, 8B, 8B1, 8C, 8C1, 8C2, 8D, 8E, 8F, 8G and 8H schematically show connection relations of a finished module and a bottom finished module at sides of a bottom lateral beam according to the disclosure, wherein FIGS. 8A and 8A1 show a horizontally overlapping relation of a side bottom beam to a bottom lateral beam, FIGS. 8B and 8B1 show an overlapping relation of a protruded bottom to a depressed side, FIG. 8C shows a variant design for a bottom lateral beam, FIG. 8C1 shows a first variant design based on FIG. 8C, FIG. 8C2 shows a second variant design based on FIG. 8C, FIGS. 8D, 8E and 8F respectively show a variant design for a bottom lateral beam, FIGS. 8G and 8H respectively show a vertically overlapping relation of a side bottom beam to a bottom lateral beam.

FIGS. 9A, 9A1, 9B, 9C, 9D, 9E, 9F, 9G, 9H, 9I, 9J, 9K, 9L and 9M schematically show connection relations of a lateral finished module and a top finished module at sides of a top lateral beam according to the disclosure, wherein FIGS. 9A and 9A1 show a horizontally overlapping relation of a side top beam to a top lateral beam, FIGS. 9B, 9C, 9D, 9E, 9F, 9G, 9H and 9I respectively show a variant design of a top lateral beam, FIGS. 9J, 9K, 9L and 9M respectively show a vertically overlapping relation of a side top beam to a top lateral beam.

FIGS. 10A, 10A1 and 10B schematically show connection relations of a bottom finished module and a front finished module at sides according to the disclosure, wherein FIGS. 10A and 10A1 show a horizontally overlapping relation of a front bottom beam to a bottom front end beam, FIG. 10B shows a variant design for a front bottom beam.

FIGS. 11A, 11A1 and 11B schematically show connection relations of a top finished module and a front finished module at sides according to the disclosure, wherein FIGS. 11A and 11A1 show a vertically overlapping relation of a front top beam to a bottom front end beam, FIG. 11B shows a variant design for a front top beam.

FIGS. 12A, 12A1, 12B, 12C and 12D schematically show connection relations of a lateral finished module and a front finished module at sides according to the disclosure, wherein FIGS. 12A and 12A1 show a vertically overlapping relation of a side front end corner pillar to a front wallboard, FIGS. 12B and 12C respectively show a vertically overlapping variant design of, FIG. 12D shows a side front end corner pillar and a front wallboard being connected together by a connecting piece.

FIGS. 13A, 13B, 13C and 13D schematically show structures of connecting pieces having a locking effect for a sliced assembly type container according to preferred embodiments of the disclosure, wherein FIG. 13A is a schematic diagram, FIG. 13B schematically shows an embodiment, and FIGS. 13C and 13D schematically show another embodiment.

DETAILED DESCRIPTION

Hereinafter, the disclosure will be explained with reference to the accompanying drawings.

Figure 1:
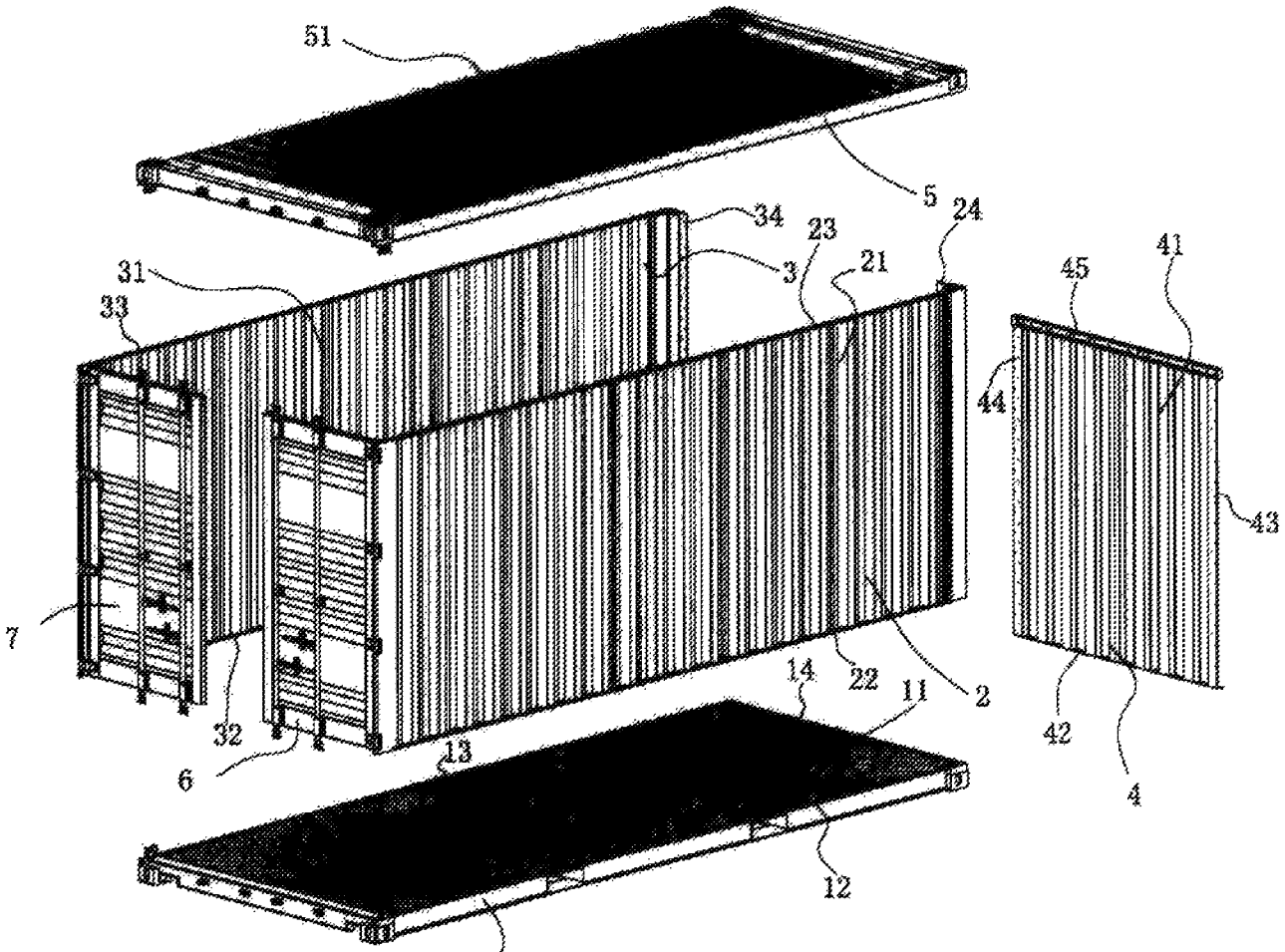
FIG. 1 is a perspective exploded view showing a preferred embodiment of a sliced assembly type container of an embodiment of the disclosure, wherein lateral finished modules and a door finished modules are coupled.

Refers to FIG. 1, according to a preferred embodiment of the disclosure, a sliced assembly type container comprises: a bottom finished module 1, two lateral finished modules 2 and 3, a front finished module 4, a top finished module 5, and two door finished modules 6, 7. Wherein each of the finished modules has been treated by processes such as welding, painting, and necessary inner sealing, can be circulated as a standard part. The sliced assembly type container is in consistent with requirements about a general cargo container in ISO and in consistent with requirements about a container in CSC, UIC and TIR. That is, the structure of the sliced assembly type container of the disclosure is achieved, under the condition of achieving requirements about a general cargo container in ISO and requirements about a container in CSC, UIC and TIR, after structures of the respective modules are inventively designed/optimized.

Figure 2A:
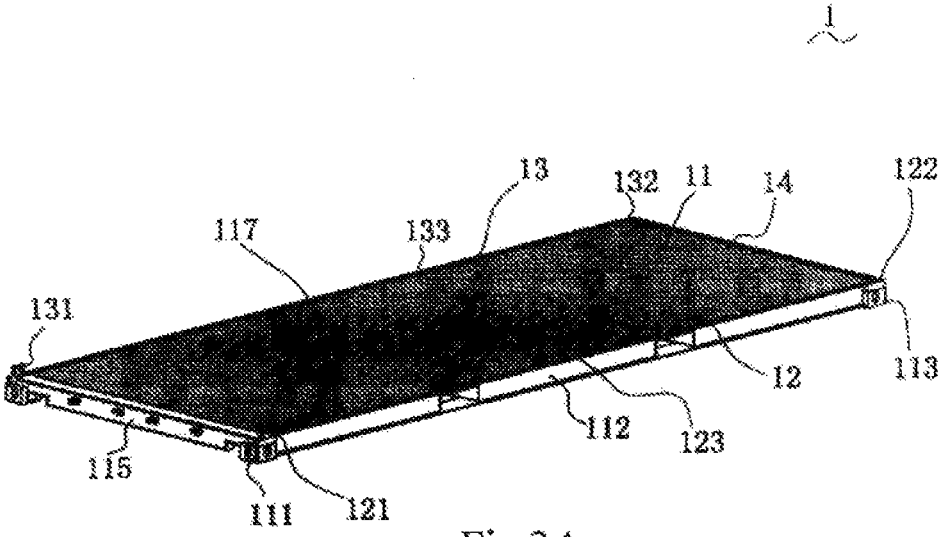
Figure 2B:
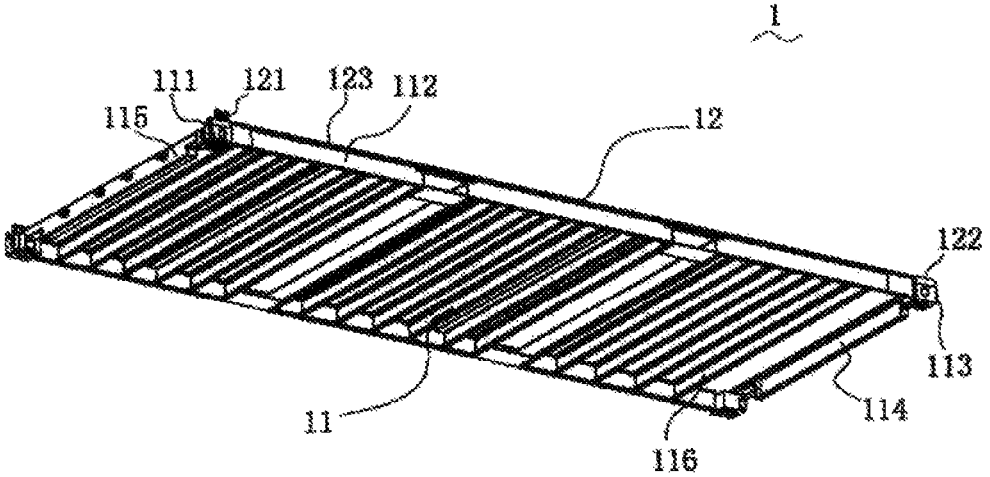

Please refer to FIGS. 2A and 2B in conjunction with FIG. 1, the bottom finished module 1 comprises a bottom body 11, two bottom lateral connecting parts 12, 13, and a bottom front connecting part 14. The bottom body 11 comprises two set of door end bottom corner fittings 111, bottom longitudinal beams 112 and front end bottom corner fittings 113 respectively positioned on both sides thereof, a front end bottom beam 114 connected between the two front end bottom corner fittings 113, a doorsill 115 connected between the two door end bottom corner fittings 111, several bottom crossbeams 116 connected between the two bottom longitudinal beams 112, and a floor 117. The two bottom lateral connecting parts 12, 13 are disposed on both sides of the bottom body 11, to fixedly connect the two lateral finished modules 2, 3, respectively. The bottom front connecting part 14 is disposed at a front end of the bottom body 11, to fixedly connect the front finished module 4. Specifically, the bottom lateral connecting part 12 comprises a first corner connecting element 121 disposed on a top of the door end bottom corner fitting, a second corner connecting element 122 on a top of the front end bottom corner fitting, and a lateral connecting element 123 on a top of the bottom longitudinal beam on the same side of the bottom body 11. Similarly, the bottom lateral connecting parts 13 comprises a first corner connecting element 131 disposed on a top of the door end bottom corner fitting, a second corner connecting element 132 on a top of the front end bottom corner fitting, and a lateral connecting element 133 on tops of the bottom longitudinal beams on the same side of the bottom body 11. The bottom front connecting part 14 is equivalent to comprise only one lateral connecting element. It would be noted, in case that an inner sealing is needed, for example, in case that the floor 117 is made from a wood/wood-bamboo material, any necessary sealing process relating to the floor 117 in the bottom finished module 1 has been performed. Generally, the bottom body 11 may be understood as a bottom structure of a traditional container, and respective connecting parts 12, 13, 14 are some newly added structures onto the bottom body 11 for sake of module assembling.

In some embodiments, the first corner connecting element of the bottom lateral connecting parts may have a plug-in structure, and the plug-in structure may comprise a vertically extending protrusion or receiving cavity. The structure of the first corner connecting element may be a plug-in structure selected from below:

a first plug-in structure: the first corner connecting element comprises a upwardly protruding protrusion, and a connecting hole and a mounting hole surrounding the connecting hole are disposed in the protrusion;

a second plug-in structure: the first corner connecting element comprises a upwardly protruding protrusion, and a connecting hole is disposed in the protrusion;

a third plug-in structure: the first corner connecting element comprises a upwardly protruding protrusion, and two connecting holes and a mounting hole positioned on a side of each of the connecting holes and communicating with the connecting holes are disposed in the protrusion;

a fourth plug-in structure: the first corner connecting element comprises a connecting block having a downwardly depressed receiving cavity, and a connecting hole traversing the receiving cavity is disposed in the connecting block.

In some embodiments, the first corner connecting element may have an overlapped structure. The structure of the first corner connecting element may be selected from any of the overlapped structures below:

a first overlapped structure: the first corner connecting element has a horizontally overlapping surface, and a connecting hole traversing the overlapping surface is disposed therein;

a second overlapped structure: the first corner connecting element has a vertically overlapping surface, and a connecting hole traversing the overlapping surface is disposed therein;

a third overlapped structure: the first corner connecting element has a vertically overlapping surface with a depressed clasp slot or a protruding clasp block disposed in the overlapping surface, and a connecting hole traversing the overlapping surface is disposed in a peripheral of the clasp slot/clasp block.

In some embodiments, the second corner connecting element of the bottom lateral connecting parts may have an overlapped structure. The structure of the second corner connecting element is selected from any of the overlapped structures below:

a first overlapped structure: the second corner connecting element has a horizontally overlapping surface, and a connecting hole traversing the overlapping surface is disposed thereon;

a second overlapped structure: the second corner connecting element has a vertically overlapping surface, and a connecting hole traversing the overlapping surface is disposed thereon;

a third overlapped structure: the second corner connecting element has a vertically overlapping surface with a depressed clasp slot or a protruding clasp block disposed in the overlapping surface, and a connecting hole traversing the overlapping surface is disposed in a peripheral of the clasp slot/clasp block;

a fourth overlapped structure: the second corner connecting element comprises a first part having a vertically overlapping surface and a second part having a horizontally overlapping surface, a connecting hole traversing the vertically overlapping surface is disposed in the first part, and a connecting hole traversing the horizontally overlapping surface is disposed in the second part.

wherein in any one of the overlapped structures, the second corner connecting element is in a shape of L.

In some embodiments, the second corner connecting element comprises a plug-in structure, and the plug-in structure may comprise a vertically extending protrusion or receiving cavity. The connection structure of the second corner connecting element is selected from any one of the plug-in structures below:

a first plug-in structure: the second corner connecting element comprises a upwardly protruding protrusion, and a connecting hole is disposed in the protrusion;

a second plug-in structure: the second corner connecting element comprises a connecting block having a downwardly depressed receiving cavity, a connecting hole traversing the receiving cavity is disposed in the connecting block.

In a preferred embodiment, the first corner connecting element comprises upwardly protruding protrusion, and a connecting hole is disposed in the protrusion; the second corner connecting element has a horizontally overlapping surface or a vertically overlapping surface, and a connecting hole is disposed to pass through the overlapping surface.

In some embodiments, the lateral connecting element of the bottom lateral connecting part comprises a horizontally extending abutting wall, and a connecting hole is disposed in the horizontally extending abutting wall; or, the bottom lateral connecting parts comprises a vertically extending abutting wall, and a connecting hole is disposed in the vertically extending abutting wall.

It would be noted, the above illustration about the structure of the bottom finished module 1 is generalized, and a more details will be followed with respect to the description about connection relations of the bottom finished module 1 and the lateral finished modules 2, 3 by referring to the drawings.

Figure 2C:
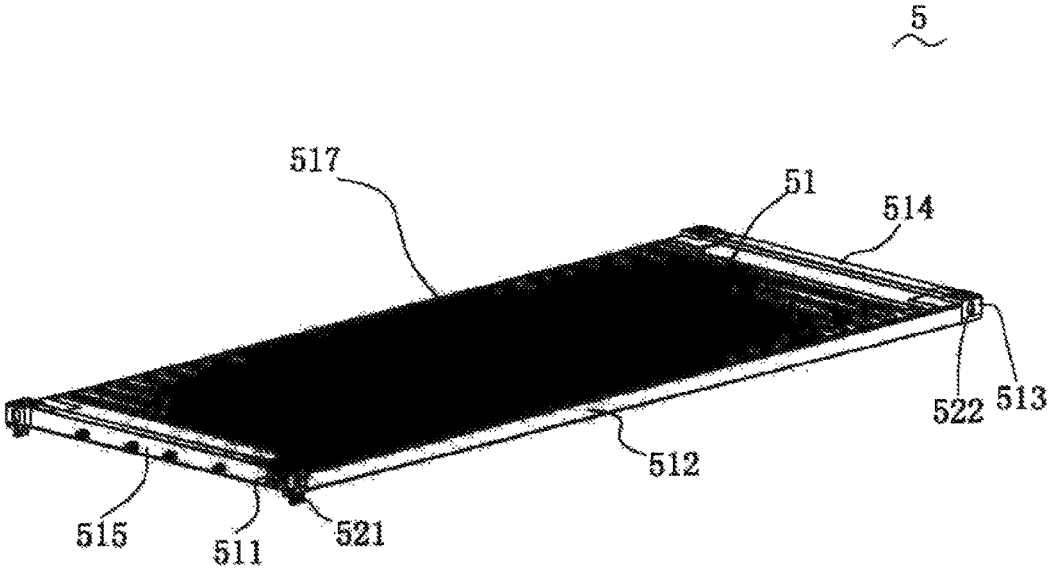
Figure 2D:
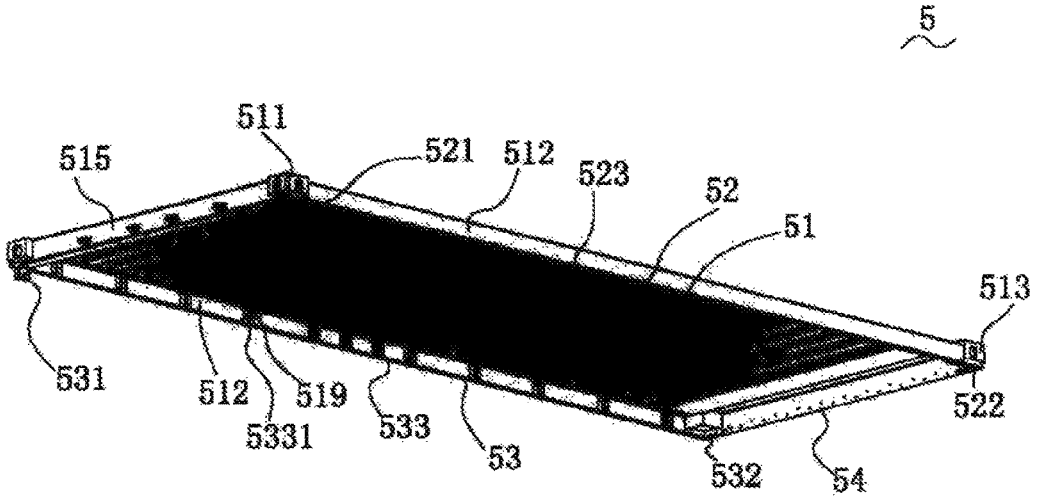

Please refer to FIGS. 2C and 2D in conjunction with FIG. 1, the top finished module 5 comprises a top body 51, two top lateral connecting parts 52, 53, and a top front connecting part 54. The top body 51 comprising two sets of door end top corner fittings 511, top longitudinal beams 512 and front end top corner fittings 513 positioned on both sides thereof, a front end top beam 514 connected between the two front end top corner fittings 513, a lintel 515 connected between the two door end top corner fittings 511, and a top plate 517. The two top lateral connecting parts 52, 53 are disposed on both sides of the top body 51, to fixedly connect the two lateral finished modules 2, 3, respectively. The top front connecting part 54 is disposed at a front end of the top body 51, to fixedly connect the front finished module 4. Specifically, the top lateral connecting parts 52 comprises a first corner connecting element 521 disposed on a bottom of the door end top corner fitting, a second corner connecting element 522 on a top of the front end top corner fitting, and a lateral connecting element 523 on a bottom of the top longitudinal beam on the same side of the top body 51. Similarly, the top lateral connecting parts 53 comprises a first corner connecting element 531 disposed on a top of the door end bottom corner fitting, a second corner connecting element 532 on a bottom of the front end top corner fitting, and a lateral connecting element 533 on a bottom of the top longitudinal beam on the same side of the top body 51. It can be seen from FIG. 2D, the lateral connecting element 533 has a horizontal abutting wall structure, and a mounting hole 5331 is disposed therein. The top finished module 5 may further comprises a reinforcing plate 519 mounted on an inner side of the top longitudinal beams 512. A top of the reinforcing plate 519 abuts against a top of the top longitudinal beams 512, a side of the reinforcing plate 519 is welded on an inner side of the top longitudinal beams 512, and a bottom of the reinforcing plate 519 abuts against the lateral connecting element 533. In this embodiment, one reinforcing plate 519 is disposed on each side of every mounting hole 5331. In other embodiments, the quantity and position of the reinforcing plate 519 may be varied depending on the actual top longitudinal beams 512 and the lateral connecting element 533. The top front connecting part 54 is equivalent to comprise only one lateral connecting element. It would be noted, generally, the top body 51 may be understood as a top structure of a traditional container, and respective connecting parts 52, 53, 54 are some newly added structures onto the top body 51 for sake of module assembling.

In some embodiments, the first corner connecting element may have a plug-in structure, and the plug-in structure may comprise a vertically extending protrusion or receiving cavity. The structure of the first corner connecting element is selected from any one of the plug-in structures below:

a first plug-in structure: the first corner connecting element comprises a downwardly protruding protrusion, and a connecting hole and a mounting hole surrounding the connecting hole are disposed in the protrusion;

a second plug-in structure: the first corner connecting element comprises a downwardly protruding protrusion, and a connecting hole is disposed in the protrusion;

a third plug-in structure: the first corner connecting element comprises a downwardly protruding protrusion, and two connecting holes and a mounting hole positioned on a side of each of the connecting holes and communicating with the connecting holes are disposed in the protrusion;

a fourth plug-in structure: the first corner connecting element comprises a connecting block having a receiving cavity depressed upwardly, and a connecting hole traversing the receiving cavity is disposed in the connecting block.

In some embodiments, the first corner connecting element may have an overlapped structure. The structure of the first corner connecting element is selected from any of the overlapped structures below:

a first overlapped structure: the first corner connecting element has a horizontally overlapping surface, and a connecting hole traversing the overlapping surface is disposed therein;

a second overlapped structure: the first corner connecting element has a vertically overlapping surface, and a connecting hole traversing the overlapping surface is disposed therein;

a third overlapped structure: the first corner connecting element has a vertically overlapping surface with a depressed clasp slot or a protruding clasp block, and a connecting hole traversing the overlapping surface is disposed in a peripheral of the clasp slot/clasp block.

In some embodiments, the second corner connecting element comprises an overlapped structure. The structure of the second corner connecting element is selected from any of the overlapped structures below:

a first overlapped structure: the second corner connecting element has a horizontally overlapping surface, and a connecting hole traversing the overlapping surface is disposed therein;

a second overlapped structure: the second corner connecting element has a vertically overlapping surface, and a connecting hole traversing the overlapping surface is disposed therein;

a third overlapped structure: the second corner connecting element has a vertically overlapping surface with a depressed clasp slot or a protruding clasp block, and a connecting hole traversing the overlapping surface is disposed in a peripheral of the clasp slot/clasp block;

a fourth overlapped structure: the second corner connecting element comprises a first part having a vertically overlapping surface and a second part having a horizontally overlapping surface, a connecting hole traversing the vertically overlapping surface is disposed in the first part, and a connecting hole traversing the horizontally overlapping surface is disposed in the second part.

wherein in any one of the overlapped structures mentioned above, the second corner connecting element is in a shape of L.

In some embodiments, the second corner connecting element comprises a plug-in structure, and the plug-in structure may comprise a vertically extending protrusion or receiving cavity. The connection structure of the second corner connecting element connection structure is selected from any one of the plug-in structures below:

a first plug-in structure: the second corner connecting element comprises a downwardly protruding protrusion, and a connecting hole is disposed in the protrusion;

a second plug-in structure: the second corner connecting element comprises a connecting block having a receiving cavity depressed upwardly, a connecting hole traversing the receiving cavity is disposed in the connecting block.

In one preferred embodiment, the first corner connecting element comprises a downwardly protruding protrusion, and a connecting hole is disposed in the protrusion; the second corner connecting element has a horizontally overlapping surface or a vertically overlapping surface, and a connecting hole traversing the overlapping surface is disposed therein.

In some embodiments, the lateral connecting element of the top lateral connecting part comprises a horizontally extending abutting wall, and a connecting hole is disposed in the abutting wall.

Wherein, the abutting wall may have a protruding downward outer side edge at the outside thereof; or, the abutting wall may have a protruding downward outer side edge at the outside and a protruding downward inner side edge at the inside thereof.

Preferably, the top finished module may further comprises a reinforcing plate welded on the top longitudinal beams, and the reinforcing plate has a top abutting against the top longitudinal beams and a bottom abutting against the abutting wall.

In some embodiments, the lateral connecting element of the top lateral connecting parts comprises a vertical extending abutting wall, and a connecting hole is disposed in the abutting wall.

In some embodiments, the top front connecting part comprises a vertical extending abutting wall, and a connecting hole is disposed in the abutting wall.

It would be noted, the illustration about the structure of the top finished module 5 is generalized, and a more details will be followed with respect to the description about connection relations of the top finished module 5 and the lateral finished modules 2, 3 as well as the front finished module 4 by referring to the drawings.

Figure 2E:
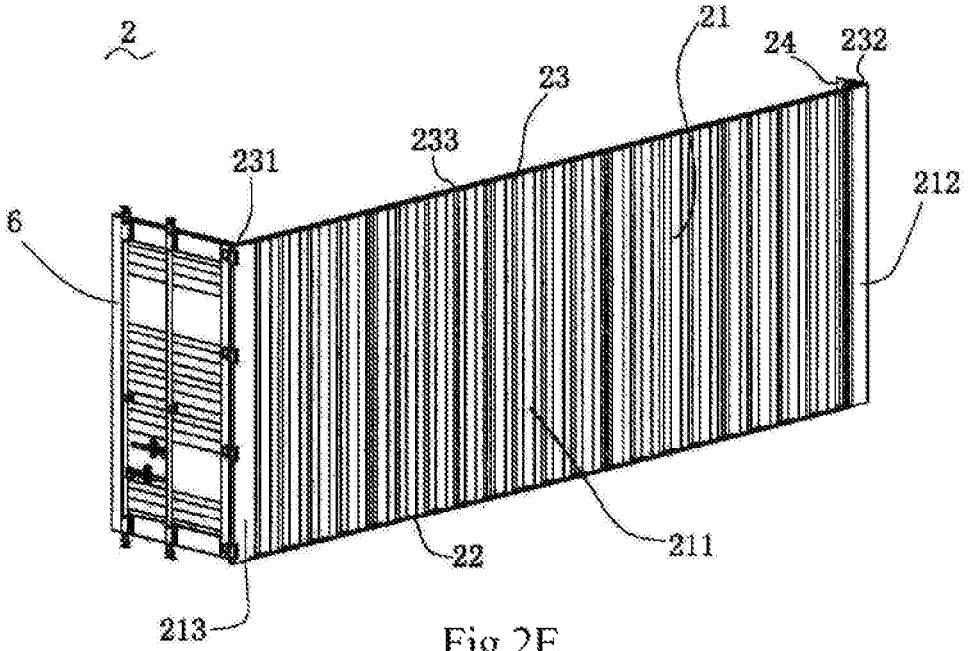

Please refer to FIG. 2E in conjunction with FIG. 1, the lateral finished module 2 comprises a lateral body 21, lateral bottom connecting parts 22, lateral top connecting parts 23, a lateral front connecting part 24, and a door finished module 6. The lateral body 21 comprises a lateral wall 211, a front end corner pillar 212 connected to a front end side of the lateral wall 211, and a door end corner pillar 213 connected to a door end side of the lateral wall 211. The lateral bottom connecting part 22 is disposed on a bottom side of the lateral body 21, to fixedly connect the bottom finished module 1. The lateral top connecting parts 23 are disposed on a top side of the lateral body 21, to fixedly connect the top finished module 5. The lateral front connecting part 24 is disposed at a front end of the lateral body 21, to fixedly connect the front finished module 4. The door finished module 6 is disposed at a door end of the lateral body 21, specifically, is hinged to the corresponding door end corner pillar 213 of the lateral body 21. The structure of the lateral finished module 3 is similar to that of the lateral finished module 2, and comprises the door finished modules 7. The door finished module 7 cooperates with the door finished module 6 to form the door of the sliced assembly type container. The lateral front connecting part 24 is equivalent to comprise only one lateral connecting element. It would be noted, generally, the side bodies 21, 31 may be understood as top structures of a traditional container, and the respective connecting parts 22, 23, 24, 32, 33, 34 are some newly added structures onto the side bodies 21, 31 for sake of module assembling. Moreover, the door finished modules 6, 7 may be understood as structures of the door of a traditional container.

In some embodiments, the first corner connecting element of the lateral bottom connecting part may have a plug-in structure, and the plug-in structure may comprise a vertically extending protrusion or receiving cavity. The structure of the first corner connecting element is selected from any one of the plug-in structures below:

a first plug-in structure: the first corner connecting element comprises a receiving cavity formed at a bottom of the door end corner pillar, and a connecting hole and a mounting hole surrounding the connecting hole are horizontally disposed in the bottom of the door end corner pillar corresponding to the receiving cavity;

a second plug-in structure: the first corner connecting element comprises a receiving cavity formed at a bottom of the door end corner pillar, and a connecting hole is disposed in the bottom of the door end corner pillar corresponding to the receiving cavity;

a third plug-in structure: the first corner connecting element comprises a receiving cavity formed at a bottom of the door end corner pillar, and a connecting hole is disposed in the bottom of the door end corner pillar corresponding to the receiving cavity; the door end corner pillar comprises a first corner pillar part, a second corner pillar part and a reinforcing part, the first corner pillar part, the second corner and the pillar part are welded together, the reinforcing part is correspondingly welded in a bottom of the first corner pillar part/the second corner pillar part and located between the first corner pillar part and the second corner pillar part, the connecting hole in the bottom of the door end corner pillar comprises holes respectively formed in the first corner pillar part, the reinforcing part and the second corner pillar part;

a fourth plug-in structure: the first corner connecting element comprises a receiving cavity formed at a bottom of the door end corner pillar, and two connecting holes and a mounting hole positioned on a side of each of the connecting holes and communicating with the connecting holes are horizontally disposed in the bottom of the door end corner pillar corresponding to the receiving cavity;

a fifth plug-in structure: the first corner connecting element comprises a downwardly protruding protrusion, and a connecting hole is disposed in the protrusion to horizontally pass therethrough.

In some embodiments, the first corner connecting element of the lateral bottom connecting part may have an overlapped structure. The structure of the first corner connecting element is selected from any of the overlapped structures below:

a first overlapped structure: the first corner connecting element has a horizontally overlapping surface, and a connecting hole is disposed to traverse the overlapping surface;

a second overlapped structure: the first corner connecting element has a vertically overlapping surface, and a connecting hole is disposed to traverse the overlapping surface;

a third overlapped structure: the first corner connecting element has a vertically overlapping surface with a depressed clasp slot or a protruding clasp block, and a connecting hole is disposed in a peripheral of the clasp slot/clasp block to traverse the overlapping surface.

In some embodiments, the second corner connecting element of the lateral bottom connecting part comprises an overlapped structure. The second corner connecting element has a structure selected from any of the overlapped structures below:

a first overlapped structure: the second corner connecting element has a horizontally overlapping surface, and a connecting hole is disposed to traverse the overlapping surface;

a second overlapped structure: the second corner connecting element has a vertically overlapping surface, and a connecting hole is disposed to traverse the overlapping surface;

a third overlapped structure: the second corner connecting element has a vertically overlapping surface with a depressed clasp slot or a protruding clasp block, and a connecting hole is disposed in a peripheral of the clasp slot/clasp block to traverse the overlapping surface;

a fourth overlapped structure: the second corner connecting element comprises a first part having a vertically overlapping surface and a second part having a horizontally overlapping surface, a connecting hole traversing the vertically overlapping surface is disposed in the first part, and a connecting hole traversing the horizontally overlapping surface is disposed in the second part.

Wherein in any one of the overlapped structures, the second corner connecting element is in a shape of L.

In some embodiments, the second corner connecting element of the lateral bottom connecting part may have a plug-in structure, and the plug-in structure may comprise a vertically extending protrusion or receiving cavity. The second corner connecting element has a structure selected from any one of the plug-in structures below:

a first plug-in structure: the second corner connecting element comprises a receiving cavity formed in a bottom of the front end corner pillar, a connecting hole is disposed in the protrusion in the bottom of the front end corner pillar corresponding to the receiving cavity;

a second plug-in structure: the second corner connecting element comprises a receiving cavity formed in a bottom of the front end corner pillar, a connecting hole is disposed in the protrusion in the bottom of the front end corner pillar corresponding to the receiving cavity; the front end corner pillar comprises a first corner pillar part, a second corner pillar part and a reinforcing part, the first corner pillar part, the second corner and the pillar part are welded together, the reinforcing part is correspondingly welded in a bottom of the first corner pillar part/the second corner pillar part and located between the first corner pillar part and the second corner pillar part, the connecting hole in the bottom of the front end corner pillar comprises holes respectively formed in the first corner pillar part, the reinforcing part and the second corner pillar part;

a third plug-in structure: the second corner connecting element comprises downwardly protruding protrusion, and a connecting hole is disposed in the protrusion.

In a preferred embodiment, the first corner connecting element of the lateral bottom connecting part comprises a receiving cavity formed at a bottom of the door end corner pillar, a connecting hole is disposed in the bottom of the door end corner pillar corresponding to the receiving cavity; the second corner connecting element of the lateral bottom connecting part has a horizontally overlapping surface or a vertically overlapping surface, and a connecting hole is disposed to pass through the overlapping surface.

In some embodiments, the structure of the first corner connecting element of the lateral top connecting part is as same as the structure of the first corner connecting element of the lateral bottom connecting part; the structure of the second corner connecting element of the lateral top connecting part is as same as the structure of the second corner connecting element of the lateral bottom connecting part.

In some embodiments, the structure of the second corner connecting element of the lateral top connecting part is as same as the structure of the first corner connecting element of the lateral bottom connecting part.

In some embodiments, the lateral connecting element of the lateral bottom connecting part comprises a horizontally extending abutting wall, and a connecting hole is disposed in the abutting wall. Further, the abutting wall may have a protruding downward outer side edge at the outside thereof; or, the abutting wall may have a protruding downward outer side edge at the outside thereof, and, the abutting wall may have a protruding downward inner side edge at the inside thereof.

In some embodiments, the lateral connecting element of the lateral top connecting part comprises a horizontally extending abutting wall, and a connecting hole is disposed in the abutting wall. Further, the abutting wall may have a protruding upward inner side edge at the inside thereof.

In some embodiments, the lateral front connecting part comprises a vertically extending abutting wall, and a connecting hole is disposed in the abutting wall.

In some embodiments, the lateral finished module may further comprise door finished modules hinged to a door end of the lateral body.

It would be noted, the above illustration about the structures of the lateral finished modules 2, 3 is generalized, and a more details will be followed with respect to the description about connection relations of the lateral finished modules 2, 3 and the bottom finished module 1 as well as the top finished module 5 by referring to the drawings.

Figure 2F:
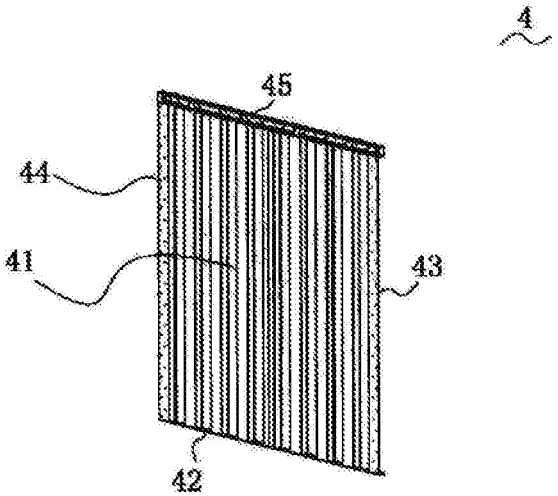

Please refer to FIG. 2F in conjunction with FIG. 1, the front finished module 4 comprises a front body 41, a front bottom connecting part 42, two front lateral connecting parts 43, 44, and a front top connecting part 45. The front body 41 is equivalent to an end wall. The front bottom connecting part 42 is disposed on a bottom side of the front body 41, to fixedly connect the bottom finished module 1. The front bottom connecting part 42 is equivalent to comprise only one lateral connecting element. The two front lateral connecting parts 43, 44 are disposed on both sides of the front body 41, to fixedly connect the two lateral finished modules 2, 3, respectively. The front lateral connecting parts 43, 44 are equivalent to each comprise only one lateral connecting element. The front top connecting part 45 is disposed on a top side of the front body 41, to fixedly connect the top finished module 5. The front top connecting part 45 is equivalent to comprise only one lateral connecting element. It would be noted, generally, the front body 41 may be understood as an end wall structure without containing a corner fitting and a corner pillar in a traditional container, and respective connecting parts 42, 43, 44, 45 are some newly added structures based on the front body 41 for sake of module assembling.

In some embodiments, the front bottom connecting part comprises a horizontally extending abutting wall, and a connecting hole is disposed in the abutting wall. Further, the abutting wall may have a protruding downward outer side edge disposed at the outside thereof; or, the abutting wall may have a protruding downward outer side edge at the outside thereof, and, the abutting wall may have a protruding downward inner side edge at the inside thereof.

In some embodiments, the front top connecting part comprises a vertically extending abutting wall, and a connecting hole is disposed in the abutting wall.

In some embodiments, the front lateral connecting part comprises a vertically extending abutting wall, and a connecting hole may be disposed in the vertically extending abutting wall.

It would be noted, the above illustration about the structure of the front finished module 4 is generalized, and a more detailed illustration will be followed with respect to the description about connection relations of the front finished module 4, the bottom finished module 1, top finished module 5, and the lateral finished modules 2, 3 by referring to the drawings.

Figure 3:
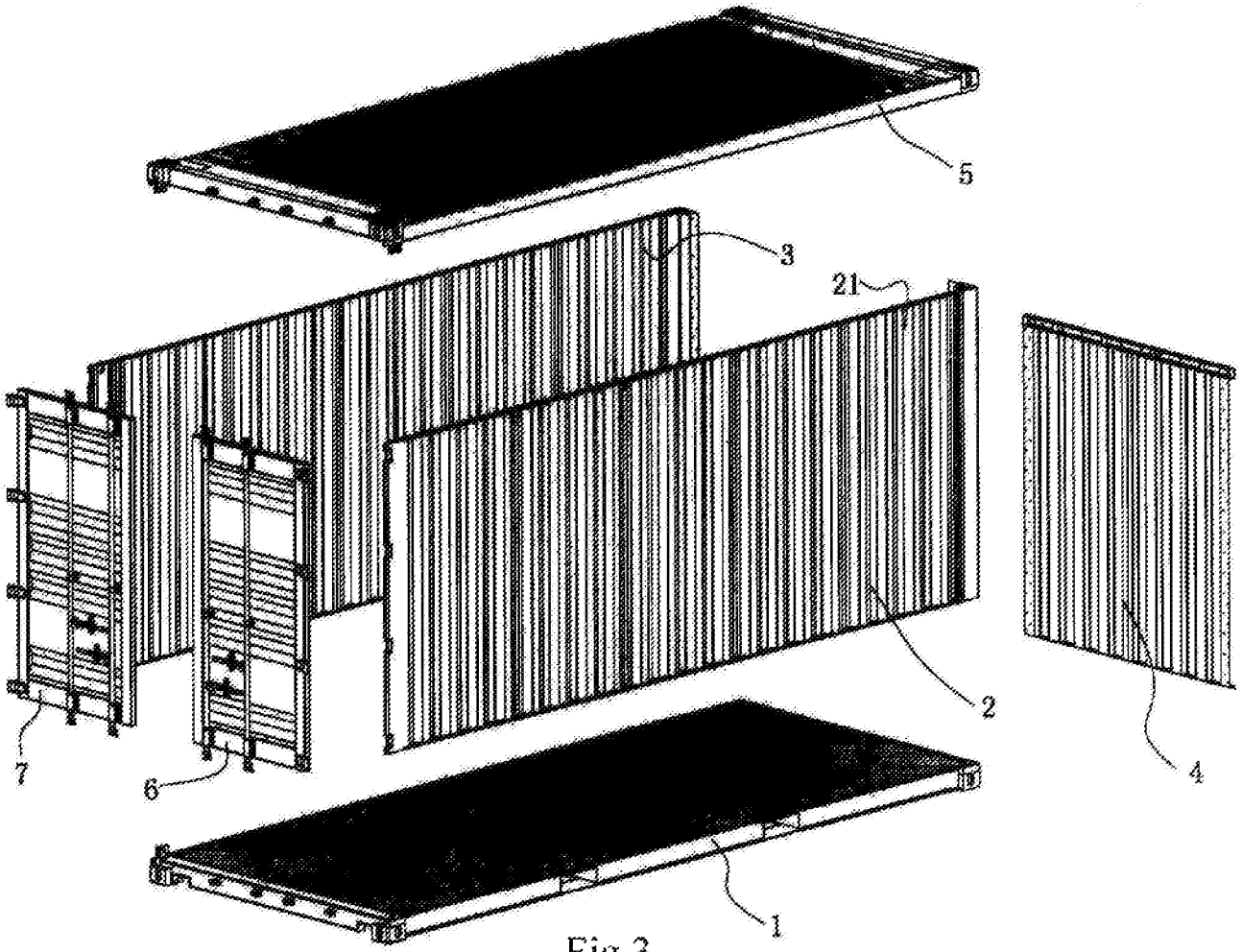
FIG. 3 is a perspective exploded view showing a sliced assembly type container of a further embodiment of the disclosure, wherein lateral finished modules and a door finished module are separated from each other.

Please refer to FIG. 3 in conjunction with FIG. 1, the sliced assembly type container provided by another embodiment of the disclosure comprises a bottom finished module 1, two lateral finished modules 2, 3, a front finished module 4, a top finished module 5, and two door finished modules 6, 7. The sliced assembly type container of this embodiment differs from that of previous preferred embodiments mainly in: the door finished module 6 and the lateral finished module 2 are independent to each other, that is, they are not coupled into one; similarly, the door finished modules 7 and the lateral finished module 3 are independent with respect to each other, that is, they are not coupled into one. In other words, in the embodiment as shown in FIG. 1, the whole sliced assembly type container may be understood to be formed by five finished modules (the coupled side and door finished modules can be taken as a single lateral finished module); moreover, in the embodiment as shown in FIG. 3, the whole sliced assembly type container may be understood to be formed by seven finished modules (each of the lateral finished modules and the door finished modules which are separated from each other can be taken as a single finished module).

In the sliced assembly type container according to the disclosure, at a position other than a corner (where a corner fitting is disposed) in the sliced assembly type container (that is, between the lateral connecting elements), the bottom finished module 1 and the lateral finished modules 2, 3 may be fixedly connected together via a connecting piece and/or a structural adhesive, and the lateral finished modules 2, 3 and the top finished module 5 may be fixedly connected together via a connecting piece and/or a structural adhesive. The front finished module 4 and the two lateral finished modules 2, 3 may be fixedly connected together via a connecting piece and/or a structural adhesive. The bottom finished module 1 and the top finished module 5 may be fixedly connected together via a connecting piece and/or a structural adhesive. Between the bottom finished module 1 and the lateral finished modules 2, 3, and between the lateral finished modules 2, 3 and the top finished module 5, totally eight corners may be fixedly connected together via a connecting piece. The coupled portions between the modules of the sliced assembly type container are sealed. It would be noted, sealing may be performed in various ways, for example, glue is applied on both sides of the coupled portion, or an adhesive tape is applied on a coupling surface, alternatively, an adhesive sheet is applied on a coupling surface.

In the sliced assembly type container according to the disclosure, preferably, the modules 1-5 are fixedly connected to each other and un-detachable after assembling. For example, for selecting a connecting piece, if a bolt is effective as same as a rivet, the rivet is selected, so as to assure reliability of the sliced assembly type container. Alternatively, for corner connection and side connection, a detachable connecting piece may be selected to perform fixed connection among the modules 1-5.

It would be noted, in the previous embodiments, the front finished module 4 is independent with respect to the bottom finished module 1, the lateral finished modules 2, 3 and the top finished module 5. In other embodiments, the front finished module 4 and other modules may be connected together via a rotatable element such as a hinge to form a group of modules, for example, the front finished module 4 is connected to one of the two lateral finished modules 2, 3 via a hinge or the like to form an assembly; or, the front finished module 4 is connected to the bottom finished module 1 via a hinge or the like to form an assembly; or, the front finished module 4 is connected to the top finished module 5 via a hinge or the like to form an assembly. In this way, an independent front finished module 4 or an assembly of the front finished module 4 and the other modules 1, 2, 3, 5 can be provided flexibly dependent on actual requirements.

It would be noted, in the previous embodiments, eight corners are fixedly connected together via connecting pieces; in other embodiments, it is possible to replace a connecting piece by welding. Therefore, welding may be applied to some of eight corners for connection. Of course, in case that welding is applied for corner connection, depending on the actual requirements, welding may be applied to one or more of the corners, and may be applied to all the eight corners.

In one or more of the previous embodiments, no matter the door finished modules 6, 7 are independent, or coupled together with the lateral finished modules 2, 3 in advance; or, no matter the front finished module 4 is independent, or is coupled together with the other modules 1, 2, 3, 5 in advance, there will be little impact on the whole structure of the sliced assembly type container of the disclosure (as a whole after assembling). In addition, no matter whether coupling is performed in advance, the door finished modules and the front finished module are required to be a sliced type finished module. Therefore, a more specific description will be provided by taking structures of some preferred embodiments for example.

Figure 4A:
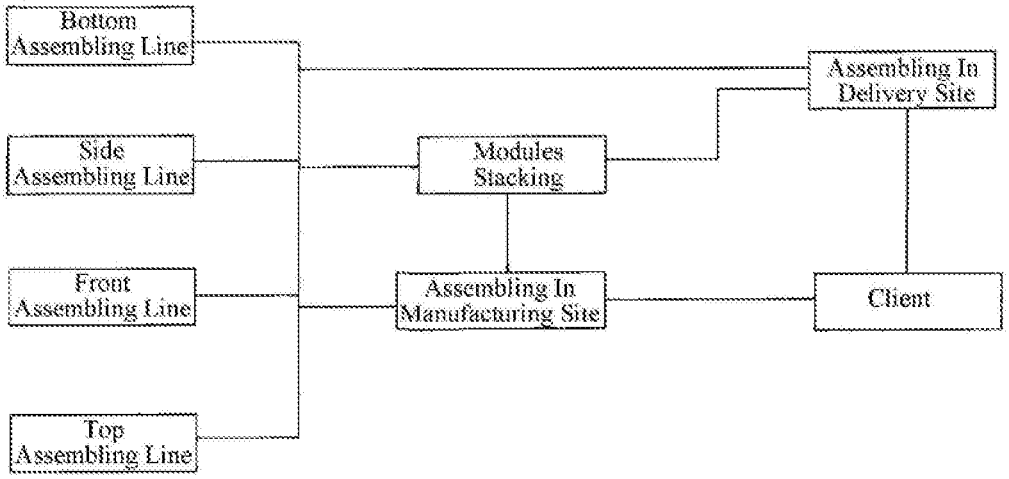

Please refer to FIG. 4A in conjunction with FIG. 1, the disclosure provides a method for manufacturing the above sliced assembly type container, which comprises the following steps:

Firstly, manufacturing process of the finished modules: respectively manufacturing the bottom finished module 1 by a bottom assembling line, manufacturing the two lateral finished modules 2, 3 (inherently comprising the two door finished modules 6, 7) by a side assembling line, manufacturing the front finished module 4 by a front assembling line, and manufacturing the top finished module 5 by a top assembling line. It would be noted, initially, single elements are assembled to sub-assemblies consisting essentially of a bottom assembly, a front assembly, a top assembly and the like by welding, then, all subsequent processes such as anti-corrosion treatment (e.g. sand-blasting, painting and the like), floor mounting, locking bar mounting and the like are performed on the assemblies, so as to form finished modules 1, 2, 3, 4, and, finally, the finished modules 1-5 are assembled to form a container product.

Figure 6A:
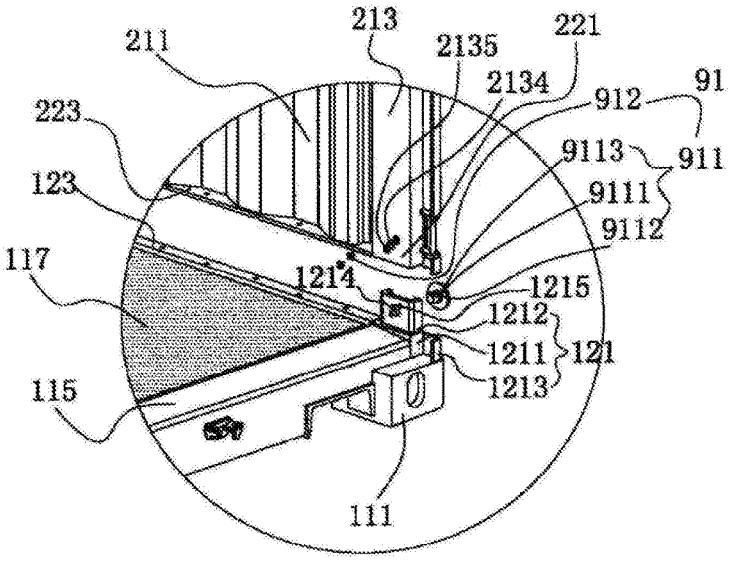

Secondly, assembling process of the container: the process for assembling these finished modules 1, 2, 3, 4, 5 may be divided into three modes: in a first mode, the bottom finished module 1 is located at first, then, the two lateral finished modules 2, 3 are mounted on both sides of the bottom finished module 1, respectively, next, the front finished module 4 and the bottom finished module 1 as well as the two lateral finished modules 2, 3 are assembled together, and finally, the top finished module 5 is mounted; in a second mode, the bottom finished module 1 is located at first, then the two lateral finished modules 2, 3 are mounted on both sides of the bottom finished module 1, respectively, then the top finished module 5 and the bottom finished module 1 as well as the two lateral finished modules 2, 3 are assembled together, and finally, the front finished module 4 is mounted; in a third mode, the bottom finished module 1 is located at first, then the front finished module 4 is mounted at a front end of the bottom finished module 1, next, the two lateral finished modules 2, 3 are mounted on both sides of the bottom finished module 1, respectively, and finally, the top finished module 5 is mounted. It would be noted, the assembling process is performed based on the bottom finished module 1, the process of amounting the lateral finished modules 2, 3 on the bottom finished module 1 may take the door end bottom corner fittings of the bottom finished module 1 as a basis, for example, if the bottom finished module 1 and the lateral finished modules 2, 3 may be fit at a door end corner (i.e., a door end bottom corner fittings) via a protruded bottom-depressed side plug-in fitting structure (specifically the structure as shown in FIGS. 6A, 6C), at first, plug-in at this corner should be performed completely. In order to meet the provisions about sealing in ISO standards, the assembling process further comprises a treating process of sealing the coupled portions between the modules by applying glue, adhesive tape or adhesive sheet thereon.

Between the manufacturing process of the finished modules and the assembling process of the container, according to the actual requirements, a stacking process of the finished modules may be further provided, so as to provide a buffer for the manufacturing process of the finished modules and the assembling processes of the container. In this way, the production flexibility of the container can be substantively improved, for example, in non-peak season, separate manufacturing of the finished modules 1-5 can be mainly performed, and stacking can be also performed; moreover, in peak season, assembling of the finished modules 1-5 would be mainly performed. According to production mode of separating the manufacturing process of the finished modules from the assembling process of the container, manufacturing capability can be relatively more effectively arranged, and a uniform distribution of the manufacturing capability can be achieved.

Similar to the traditional container production technology, separately manufacturing these finished modules 1-5 and assembling the finished modules 1, 5 to form the resultant container may be performed in a manufacturing place. It would be noted, the manufacturing place herein may contain a plurality of geographic locations, for example, in case of the most decentralized geographic locations, manufacturing of each of the finished modules and assembling of the container can be separately performed in one dedicated factory.

In comparison with the prior art, according to the inventive production mode of the disclosure, the separated manufacturing of these finished modules 1-5 can be arranged to be performed in a manufacturing place far away from the client (delivery place), moreover, assembling of these finished modules 1-5 can be either performed in their manufacturing place(s), or be performed in a delivery place near to the client. According to such production mode of separately manufacturing single sliced products, and centrally assembling the modules, the processes which have relative strong influence to environment such as welding/painting can be totally controlled within a dedicated manufacturing place in factory; moreover, it is only needed to arrange some assembling devices and testing equipments for assembling of the finished modules in an assembling region at the delivery place. Assembling the various finished modules to be the resultant container in consistent with the related standard provisions can be performed like building blocks, or assembling DIY furniture (sealing operation is completed while assembling), so production flexibility can be substantively improved, manufacturing and delivering cost for the whole container con be reduced, and the region which may contaminate environment can be strictly controlled.

Figure 4B:
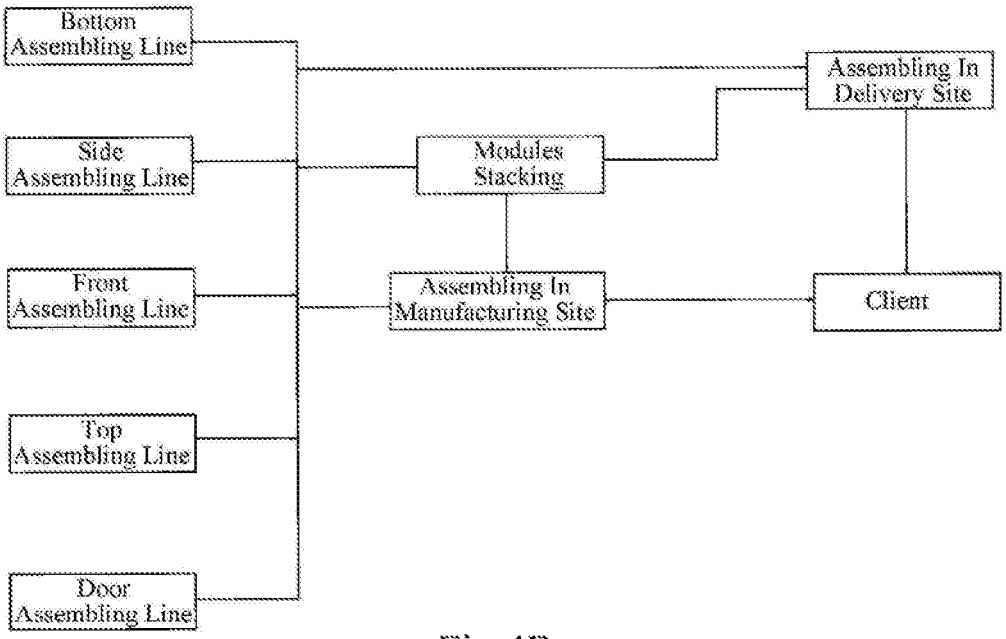

Refer to FIG. 4B, the disclosure provides another method for manufacturing the sliced assembly type container. The method of this embodiment, compared with the first method shown in FIG. 4A, have the following differences: before assembling process of the container, in the first method, the door finished modules 6, 7 have been coupled with the lateral finished modules 2, 3; however, according to this method, the door finished modules 6, 7 and the lateral finished modules 2, 3 are independent with respect to each other. In other words, in the first method, the manufacturing process of the door finished modules and process of assembling the door finished modules with the lateral finished modules are inherently comprised in manufacturing of the side assembling line. However, in the method of this embodiment, the manufacturing process of the door finished modules is separately performed, and the process of assembling the door finished modules with the lateral finished modules is arranged downstream to the assembling process of the container. Comparatively, the method of this embodiment and the first method in comparison, each have its own advantages, for example, by the first method, the burden of stacking/transporting and the subsequent processes for requiring assembling can be reduced; by this method of the embodiment, the assembling process of the other modules is facilitated since the door finished modules are independent, in other words, the assembling process of the other modules can be relatively less restricted by the door finished modules.

Figure 5:
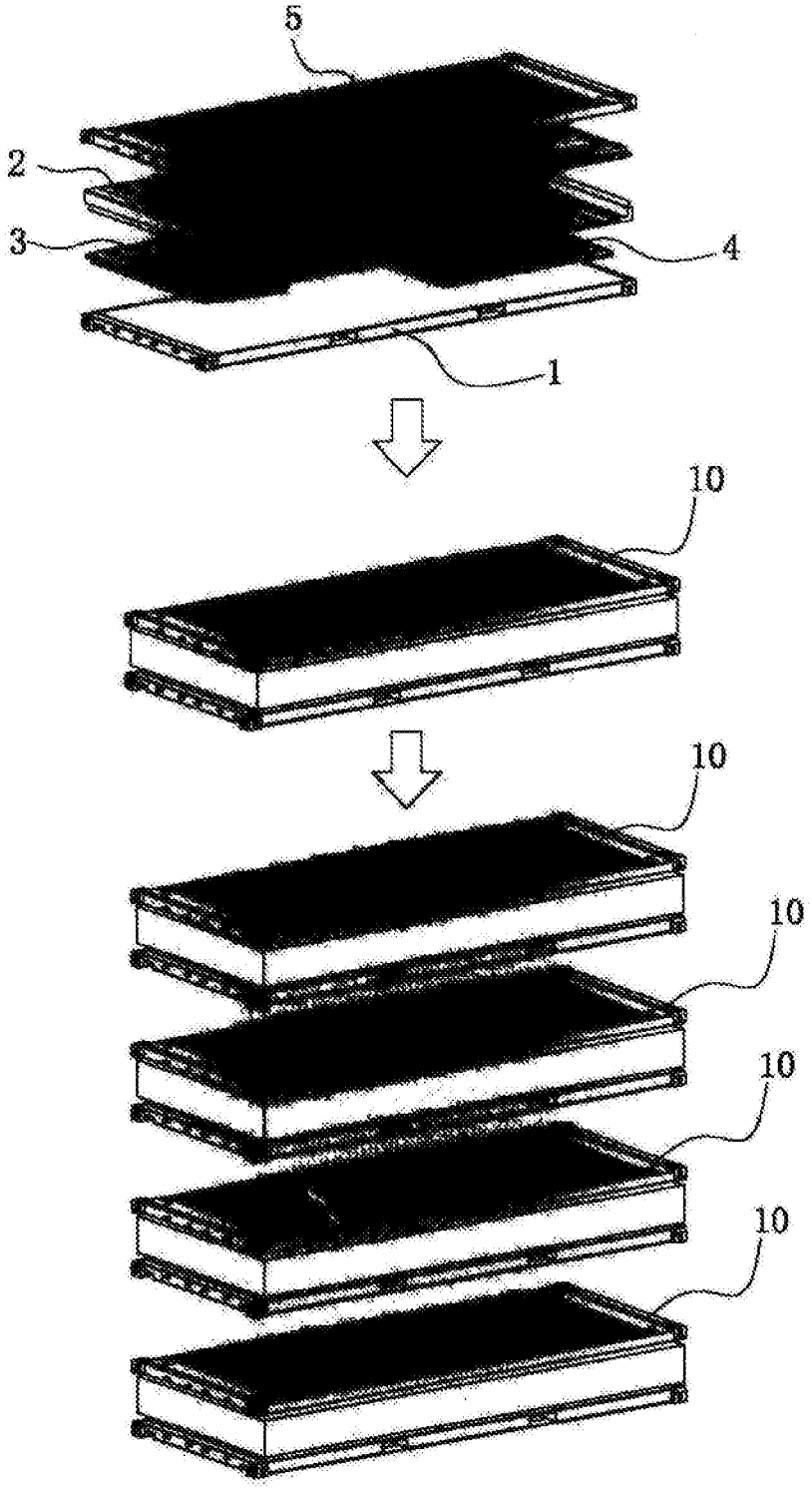
FIG. 5 schematically shows an operation flow diagram of stacking/transporting a sliced assembly type container according to a preferred embodiment of the disclosure.

Refer to FIG. 5, the disclosure provides a stacking/transporting method of the sliced assembly type container. The method comprises the following steps: arranging the bottom finished module 1 in a bottom; respectively stacking the front finished module 4, the two lateral finished modules 2, 3, and the two door finished modules 6, 7 (which may be coupled to the lateral finished modules, or separated from the lateral finished modules) on the bottom finished module 1; stacking the top finished module 5 on a top, packing these finished modules 1-5 (or 1-7) together to form a stacking/transporting basic unit 10. Further, a plurality of stacking/transporting basic unit 10 may be stacked together to form a stacking/transporting unit, thus a plurality of stacking/transporting basic unit 10 can be received in the occupation space of one standard container. Therefore, by means of performing stacking/transporting after packing, compared with the existing mode of stacking/transporting the whole container, the occupation area and the stacking space can be substantively saved, thus the stacking/transporting cost can be substantively reduced.

Hereafter, please refer to FIGS. 6A-12D in combination with FIGS. 1-2F, various finished modules of the disclosure and the connection relations between them will be explained in detail.

Firstly, the connection relations between the bottom finished module 1, the lateral finished modules 2, 3, and the bottom finished module 1 as well as the lateral finished modules 2, 3 will be discussed.

Please refer to FIGS. 6A-8H in combination with FIGS. 1-2E, the bottom lateral connecting part 12 of the bottom finished module 1 comprises: the first corner connecting elements 121 on the top of the door end bottom corner fitting 111, the second corner connecting element 122 on the top of the front end bottom corner fitting 113, and the lateral connecting element 123 on the top of the bottom longitudinal beam 112 all disposed the same side of the bottom body 11. Each of the lateral bottom connecting part 22 of the lateral finished module 2 comprises: the first corner connecting element 221 at the bottom of the door end corner pillar 213, the second corner connecting element 222 at the bottom of the front end corner pillar 212, and the lateral connecting element 223 at the bottom of the lateral wall 211 of the lateral body 21. The first corner connecting element 221 is opposite to the first corner connecting element 121, the second corner connecting element 222 is opposite to the second corner connecting element 122, and the lateral connecting element 223 is opposite to the lateral connecting element 123.

The first corner connecting element 121 of the bottom lateral connecting part 12 may comprise a protrusion, a receiving cavity or an overlapping piece. The first corner connecting element 221 of the lateral bottom connecting part 22 may correspondingly comprise a receiving cavity, a protrusion or an overlapping piece. The first corner connecting element 121 of the bottom lateral connecting part 12 may be fixedly connected to the first corner connecting element 221 of the lateral bottom connecting part 22 together via a connecting piece. Similarly, the second corner connecting element 122 of the bottom lateral connecting part 12 may comprise a protrusion, a receiving cavity or an overlapping piece, and the second corner connecting element 222 of the lateral bottom connecting part 22 may comprise a receiving cavity, a protrusion or an overlapping piece. The second corner connecting element 122 of the bottom lateral connecting part 12 may be fixedly connected to the second corner connecting element 222 of the lateral bottom connecting part 22 together via a connecting piece. The lateral connecting element 123 of the bottom lateral connecting part 12 may comprise a horizontally extending/vertically extending abutting wall, and the second corner connecting element 223 of the lateral bottom connecting part 22 may correspondingly comprises horizontally extending/vertically extending abutting wall. The lateral connecting element 123 of the bottom lateral connecting part 12 may be fixedly connected to the lateral connecting element 223 of the lateral bottom connecting part 22 together via a connecting piece and/or a structural adhesive.

Alternatively, the bottom finished module 1 and the lateral finished module 2 may be assembled together by welding at a position wherein the first corner connecting element 121 corresponds to the first corner connecting element 221, and also at a position where the second corner connecting element 122 corresponds to the second corner connecting element 222.

Sealing at a junction of the bottom finished module 1 and the lateral finished module 2 may comprising applying glue, an adhesive tape or an adhesive sheet and the like on a connection coupling surface or on an inner/outer side of the coupling surface.

In the bottom finished module 1, the bottom lateral connecting parts 13 and the bottom lateral connecting parts 12 are similar to each other in structure, and the connection relations and sealing modes of the bottom finished module 1 and the lateral finished module 3 are similar to the connection relations and sealing modes of the bottom finished module 1 and the lateral finished module 2, no redundant discussion is repeated.

Referring to FIGS. 6A-6H which show connection relations of the lateral finished modules 2, 3 and the bottom finished module 1 at door end corners (i.e., junctions of the first corner connecting elements 121/131 and the corresponding first corner connecting elements 221/231). Such connection relations may be used for connection of the lateral finished modules 2, 3 and the top finished module 5 at the door end corners. These connection relations may also be used for connection of the lateral finished modules 2, 3 and the bottom finished module 1 at front end corners.

Referring to FIG. 6A which shows a first embodiment, it shows: the door end bottom corner fitting 111, the doorsill 115, and the floor 117 on the bottom body 11 of the bottom finished module 1; the first corner connecting element 121 and the lateral connecting element 123 on the bottom lateral connecting parts 12; the lateral wall 211 and the door end corner pillar 213 on the lateral body 21 of the lateral finished module 2; the first corner connecting element 221 on the lateral bottom connecting part 22; and the connecting piece 91. The first corner connecting element 121 comprises an upwardly protruding protrusion 1212. A first connecting hole 1214 and two first mounting holes 1215 positioned around the first connecting hole 1214 are disposed to horizontally penetrate into the protrusion 1212. The first corner connecting element 221 comprises a receiving cavity formed at a bottom of door end corner pillar 213. A second connecting hole 2134 and two second mounting holes 2135 positioned around the second connecting hole 2134 are disposed to horizontally penetrate into the bottom of the door end corner pillar 213 corresponding to the receiving cavity. The connecting piece 91 comprises one connecting pin 911 and two fasteners 912. The connecting pin 911 is disposed to penetrate into the first connecting hole 1214 and the second connecting hole 2134, and has two third mounting holes 9113 disposed therein. The two fasteners 912 are correspondingly disposed to penetrate into the first mounting hole 1215, the second mounting hole 2135, and the third mounting hole 9113. Specifically, the first corner connecting element 121 comprises a base part 1211 disposed at the door end bottom corner fitting 111 and a baffle 1213 disposed on an outer side of the base part 1211. The protrusion 1212 protrudes upward from a top side of the base part 1211. The two first mounting holes 1215 in the protrusion 1212 are arranged to form an angle with respect to a horizontal plane defined by the bottom body 11. Preferably, the angle is in a range of 30-60°. The connecting pin 911 further has a cylindrical base part 9111 and frustum head part 9112, and the two third mounting holes 9113 are threaded holes disposed in the base part 9111 to fit for the two fasteners 912 (bolts in this embodiment). It would be noted, the connecting piece 91 in this embodiment is a connecting piece having a locking effect. It would be noted, in other embodiments, the baffle 1213 may be omitted; and in other embodiments, the baffle 1213 may be disposed in the door end corner pillar 213.

Figure 6B:
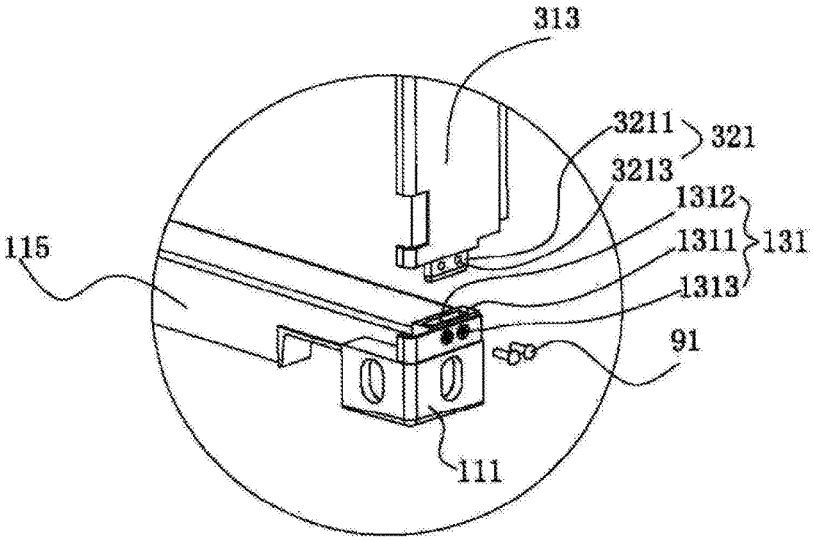

Referring to FIG. 6B which shows second embodiment, it is shown therein: the door end bottom corner fittings 111 and the doorsill 115 on the bottom body 11 of the bottom finished module 1; the first corner connecting element 131 on the bottom lateral connecting part 13; the door end corner pillar 313 on the lateral finished module 3; the first corner connecting element 321 on the lateral bottom connecting part 32; and the connecting piece 91. The first corner connecting element 131 of the bottom lateral connecting part 13 comprises a connecting block 1311 with a receiving cavity 1312. A first connecting hole 1313 is horizontally disposed in the connecting block 1311. The first corner connecting element 321 of the lateral bottom connecting part 32 comprises a downwardly protruding protrusion 3211. The protrusion 3211 has a second connecting hole 3213 horizontally disposed therein. The connecting piece 91 is correspondingly disposed to penetrate into the first connecting hole 1313 and the second connecting hole 3213. Preferably, the connecting piece 91 has a locking effect. More preferably, the connecting piece 91 having a locking effect is a solid rivet which can fill up the first connecting hole 1313 and the second connecting hole 3213 during riveting process. Of course, according to the actual situation, the two connecting pieces 91 both may be rivets, alternatively, one of them may by a rivet, and another is a fastener such as bolt. It can be known, in the first embodiment, basically a plug-in fitting of a protruded bottom to a depressed side is adopted, and in this embodiment, a plug-in fitting of a depressed bottom to a protruded side is adopted. It would be noted, in other embodiments, numbers of the connecting holes and the connecting pieces may be one or more than three.

Referring to FIG. 6C which shows a third embodiment, it is shown therein: the door end bottom corner fitting 111 and the doorsill 115 on the bottom body 11 of the bottom finished module 1; the first corner connecting element 121 on the bottom lateral connecting parts 12; the door end corner pillar 213 of the lateral finished module 2; the first corner connecting element 221 on the lateral bottom connecting part 22; and the connecting piece 91. The first corner connecting element 121 of the bottom lateral connecting part 12 comprises the upwardly protruding protrusion 1212, and the first connecting hole 1214 is horizontally disposed in the protrusion 1212. The first corner connecting element 221 of the lateral bottom connecting part 22 comprises a receiving cavity formed at the bottom of the door end corner pillar 213 and a reinforcing part 2132 being a bottom structural member of the door end corner pillar 213. Second connecting holes 2135, 2137 are horizontally disposed in the bottom of the door end corner pillar 213 at positions corresponding to the receiving cavity, and a third connecting hole 2136 is horizontally disposed in the reinforcing part 2132. The connecting piece 91 may be a fastener such as a bolt or rivet correspondingly disposed to penetrate into the first connecting hole 1214, the second connecting holes 2135, 2137 and the third connecting hole 2136. Specifically, the first corner connecting element 121 may comprise: the base part 1211 disposed at the door end bottom corner fittings 111, the baffle 1213 disposed on an outer side of the base part 1211, the protrusion 1212 protruding upward from a top side of the base part 1211. The door end corner pillar 213 has three-member-structure, which comprises a first corner pillar part 2131 on an inner side thereof and provided with a connecting hole 2135, a second member (i.e., the reinforcing part) 2132 disposed in the meddle thereof and provided with a connecting hole 2136, and a second corner pillar part 2133 disposed on an outer side thereof and provided with a connecting hole 2137. The reinforcing part 2132 may be welded together with the second corner pillar part 2133 in advance, then the second corner pillar part 2133 may be welded with the first corner pillar part 2131. Alternatively, the reinforcing part 2132 may welded together with the first corner pillar part 2131 in advance, and then, the second corner pillar part 2133 is welded to the first corner pillar part 2131; the aforementioned receiving cavity may be formed by cooperation of the reinforcing part 2132 and the first corner pillar part 2131 as well as the second corner pillar part 2133 for correspondingly receiving the protrusion 1212 of the first corner connecting element 121, and the protrusion 1212 may be fixed in the receiving cavity by the two connecting pieces 91. It would be noted, in other embodiments, numbers of the connecting hole and the connecting piece may be one or more than three. It would be noted, if strength of the first corner pillar part 2131 and the second corner pillar part 2133 are enough, the reinforcing part 2132 may be omitted. In other words, in some cases, the reinforcing part 2132 may not be a necessary structure of the door end corner pillar 213.

Referring to FIG. 6C0, in other embodiments, the reinforcing part 2132 may be merely a flat plate structure without inwardly bending parts on both sides of the flat plate. Referring to FIG. 6C0, in this embodiment, an outer end face of the base part 1211 is substantially flush with an outer end face of the doorsill 115. A distance w1 between the outer end face of the base part 1211 and the outer end face of the door end bottom corner fittings 111 is approximately 57 mm. A distance w2 between an outer end face of the baffle 1213 and an outer end face of the door end bottom corner fittings 111 is approximately 4 mm. A distance w3 between an outer lateral surface of the baffle 1213 and an outer lateral surface of the door end bottom corner fittings 111 is approximately 3 mm. A top surface of the base part 1211 is a horizontal surface, and its length and width are approximately equal to length and width of a horizontal surface of the door end corner pillar 213. In the top surface of the base part 1211, except for areas where the protrusion 1212 extends upward, abutting areas are received, thus the door end corner pillar 213 may be carried well to achieve abutting of the first corner connecting element 121 and the door end corner pillar 213.

Referring to FIG. 6C1 which shows a variant design based on the structure in FIG. 6C or 6C0. The connecting piece 91 is a connecting piece having a locking effect. Preferably, the connecting piece 91 is a rivet. The connecting hole 2135, 2136, 2137 in the door end corner pillar 213 and the connecting hole 1214 in the protrusion 1212 are aligned with each other (refer to the figure at the bottom). When the rivet is inserted (refer to the figure in the middle), there is a gap d1 between the rivet, the connecting hole 2135, 2136, 2137 in the door end corner pillar 213, and the connecting hole 1214 in the protrusion 1212. When riveting is completed (refer to the figure at the top), due to a material deformation of the rivet (solid rivet) during riveting process, the rivet may fill up these connecting hole 2135, 2136, 2137, 1214, and the gap d1 is eliminated. It would be noted, in practical assembling process of the container, when the protrusion 1212 is inserted into the receiving cavity, due to the assembly errors, the connecting hole 1214 and other connecting holes 2135, 2136, 2137 may not be aligned completely. According to the disclosure, performance characteristics of the rivet may be purposefully used to completely fill up the gap d1 subsequently, so such hole assembly error (the connecting hole 1214 and other connecting holes 2135, 2136, 2137 are not be aligned completely, a certain deviation, particularly a deviation in vertical direction is presented) may be allowed, consequently, it is not necessary to over strictly control machining accuracy of the finished modules, thus assembling of the container is facilitated. In addition, though in FIG. 6C1, the rivet is inserted from inner side to outer side of the container into the corresponding connecting holes, in other embodiments, the rivet may be is inserted from outer side to inner side of the container into the corresponding connecting holes. In addition, in case that there are a plurality groups of connecting holes, connecting pieces having a locking effect may be used for only a group or a part or all of the connecting holes.

Referring to FIGS. 6C2 and 6C3 which shows another variant design based on the structure in FIG. 6C or 6C0. Here, the outer side of the protrusion 1212 is depressed inwardly to form a clasp slot 1219. Moreover, the inner side of the reinforcing part 2132 projects inwardly to form a clasp block 2139, the clasp block 2139 and the clasp slot 1219 may cooperate with each other to facilitate for positioning and/or connecting. It would be noted, an indentation (not shown), which may provide a space for the protrusion 1212, is disposed in the bottom of the first corner pillar part on the inner side of the door end corner pillar 213, the protrusion 1212 and the reinforcing part 2132 have a cooperation relation of vertically overlapping with each other, In other words, the protrusion 1212 may be viewed as a first overlapping piece having a vertically overlapping surface, and the reinforcing part 2132 may be viewed as a second overlapping piece having a vertically overlapping surface, moreover, the second overlapping piece is welded on an inner side of the second corner pillar part at the outer side of the door end corner pillar 213. Since force in vertical direction is carried out by cooperation of the clasp block 2139 and the clasp slot 1219, the connecting piece 91 may be selected from a common fastener, rather than a connecting piece having a locking effect.

Figure 6D:
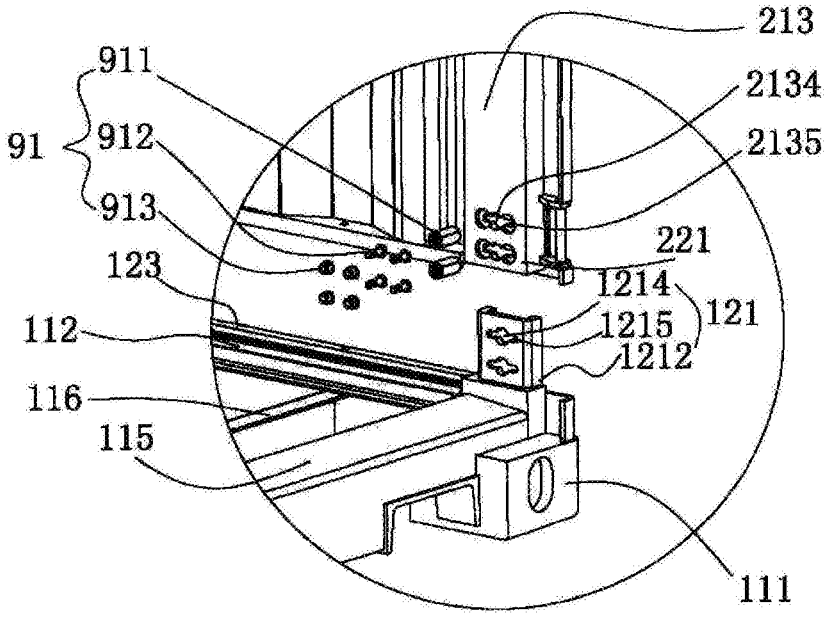

Referring to FIG. 6D which shows a fourth embodiment, it shows: the door end bottom corner fitting 111, the bottom longitudinal beams 112, the doorsill 115 and the bottom crossbeam 116 on the bottom body 11 of the bottom finished module 1; the first corner connecting element 121 and the lateral connecting element 123 on the bottom lateral connecting part 12; the door end corner pillar 213 of the lateral finished module 2; the first corner connecting element 221 on the lateral bottom connecting part 22; and the connecting piece 91. The first corner connecting element 121 of the bottom lateral connecting part 12 comprises the upwardly protruding protrusion 1212. Two first connecting holes 1214 and two first mounting holes 1215 disposed in side of each of the first connecting holes 1214 and in communication with the first connecting hole 1214 are horizontally disposed in the protrusion 1212. The first corner connecting element 221 of the lateral bottom connecting part 22 comprises a receiving cavity formed at the bottom of the door end corner pillar 213. Two second connecting holes 2134 and second mounting holes 2135 disposed in side of each of the second connecting holes 2134 and in communication with the second connecting holes 2134 are horizontally disposed at the bottom of the door end corner pillar 213 corresponding to the receiving cavity. The second mounting holes are. The connecting piece 91 comprises: two connecting pins 911 having locking effect, disposed to correspondingly penetrate into the first connecting hole 1214 and the second connecting hole 2134; bolts 912, disposed to correspondingly penetrate into the first mounting holes 1215 and the second mounting holes 2135; and nuts 913 in cooperation with the bolts 912. In this embodiment, the connecting piece 91 may be a connecting piece having locking effect. It would be noted, in other embodiments, numbers of the connecting holes and connecting pieces may be one or more than three. In addition, the bolt 912 and the nut 913 may be replaced by a rivet.

Figure 6E:
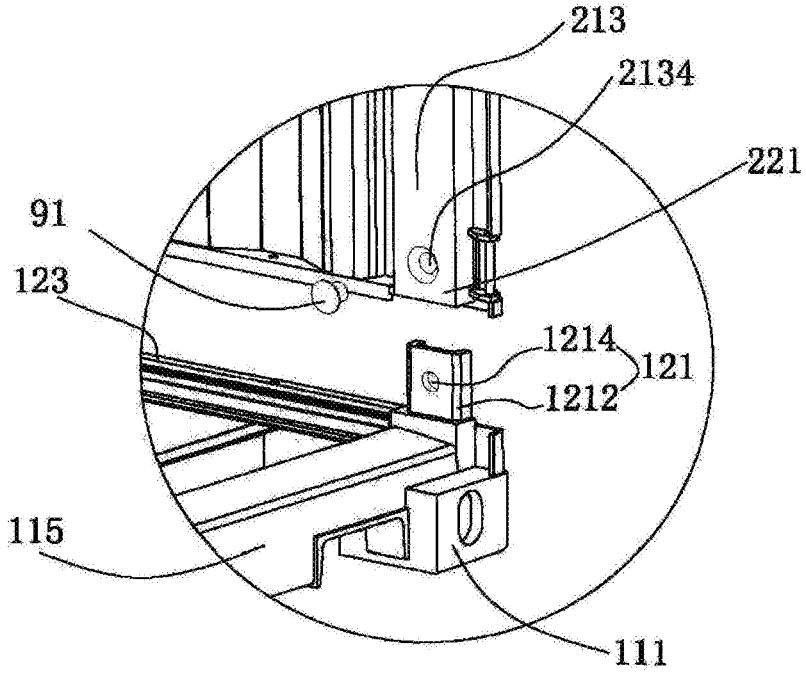

Referring to FIG. 6E which shows a fifth embodiment. It shows: the door end bottom corner fittings 111 and the doorsill 115 on the bottom body 11 of the bottom finished module 1; the first corner connecting element 121 and the lateral connecting element 123 on the bottom lateral connecting part 12; the door end corner pillar 213 of the lateral finished module 2; the first corner connecting element 221 on the lateral bottom connecting part 22; and the connecting piece 91. The first corner connecting element 121 of the bottom lateral connecting part 12 comprises the upwardly protruding protrusion 1212, and the first connecting hole 1214 is horizontally disposed in the protrusion 1212. The first corner connecting element 221 of the lateral bottom connecting part 22 comprises a receiving cavity formed at the bottom of the door end corner pillar 213, and the second connecting hole 2134 is horizontally disposed at the bottom of the door end corner pillar 213 corresponding to the receiving cavity. The connecting piece 91 may be a bolt having a tail cone and being disposed to correspondingly penetrate into the first connecting hole 1214 and the second connecting hole 2134, and the bolt has locking effect. In this embodiment, the connecting piece 91 is a connecting piece having a locking effect. It would be noted, in other embodiments, numbers of the connecting holes and connecting pieces may be two or the more.

Figure 6F:
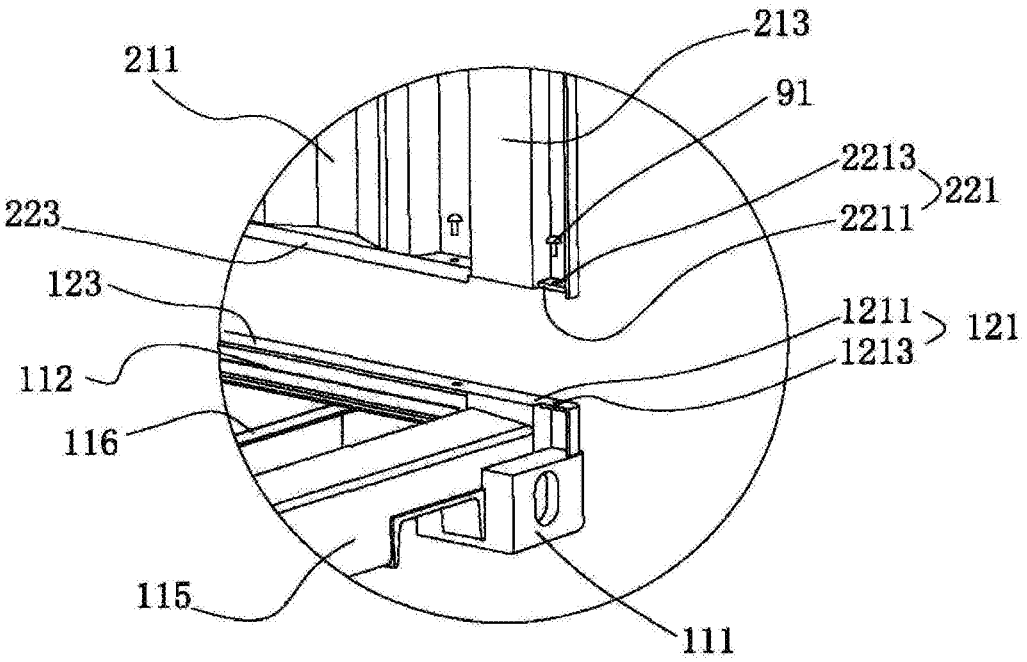

Referring to FIG. 6F which shows a sixth embodiment, it shows therein: the first corner connecting element 121 on the bottom lateral connecting parts 12 of the bottom finished module 1; the door end corner pillar 213 of the lateral finished module 2, the door end corner pillar 213 having a receiving cavity; the first corner connecting element 221 on the lateral bottom connecting part 22; and the connecting piece 91. The first corner connecting element 121 of the bottom lateral connecting part 12 comprises a first overlapping piece 1211 having a horizontally overlapping surface, and a first connecting hole 1213 is disposed in the first overlapping piece 1211. The first corner connecting element 221 of the lateral bottom connecting part 22 comprises a second overlapping piece 2211 having a horizontally overlapping surface, and a second connecting hole 2213 is disposed in the second overlapping piece 2211. The connecting piece 91 may be a fastener such as a bolt or rivet correspondingly disposed to penetrate into the first connecting hole 1213 and the second connecting hole 2213.

Figure 6G:
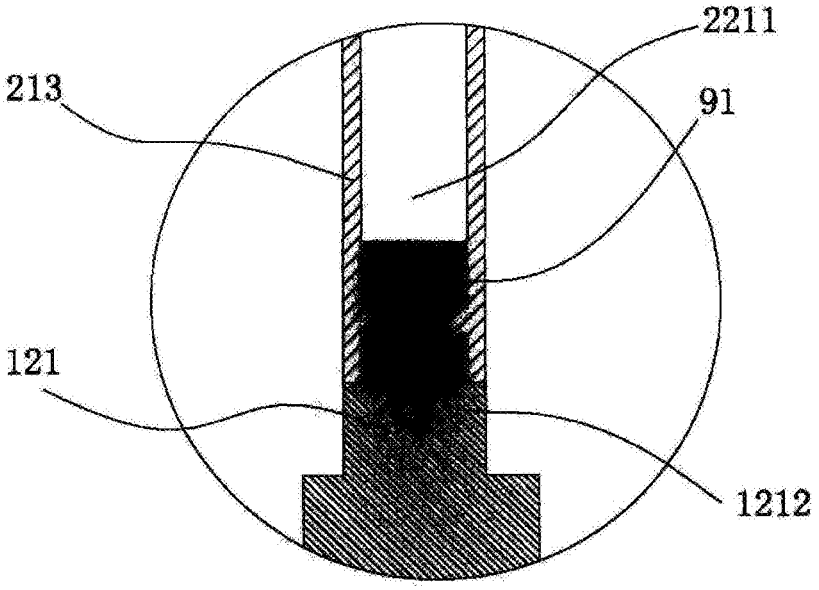

Referring to FIG. 6G which shows a seventh embodiment, it shows therein: the first corner connecting element 121 on the bottom lateral connecting parts 12 of the bottom finished module 1; the door end corner pillar 213 of the lateral finished module 2; the first corner connecting element 221 on the lateral bottom connecting part 22; and the connecting piece 91. The first corner connecting element 121 of the bottom lateral connecting part 12 comprises a protruding upward protrusion 1212. The first corner connecting element 221 of the lateral bottom connecting part 22 comprises a receiving cavity 2211 formed at the bottom of the door end corner pillar 213. The receiving cavity 2211 is injected with a filler at a position corresponding to the protrusion 1212, and the filler forms the connecting piece 91 after solidification, such that the first corner connecting element 121 of the bottom finished module 12 is fixedly connected together with the first corner connecting element 221 of the lateral finished module 22. The filler may be a glue, a high strength resin, a special cement, or the like. In order to improve mutual grasping of the concave and convex structures, the protrusion 1212 is special-shaped, and the protrusion may be designed to have concave and convex parts in mesh with each other according to the actual requirements.

Figure 6H:
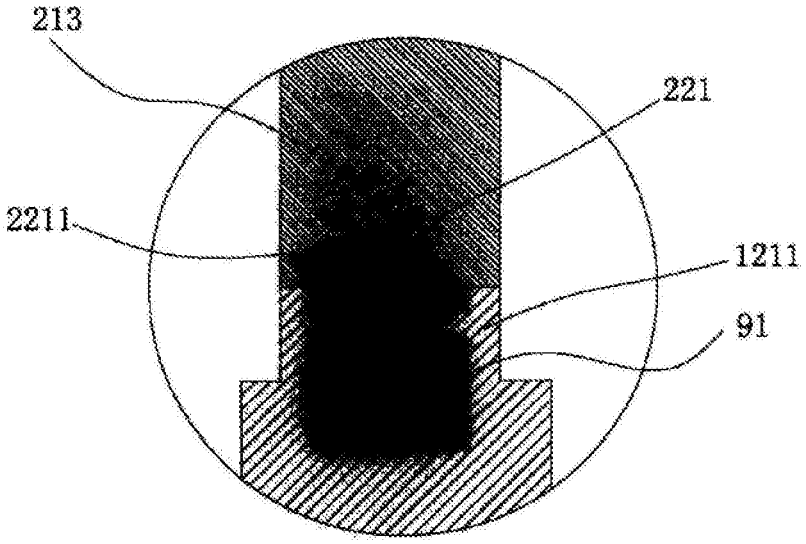

Referring to FIG. 6H which shows an eighth embodiment, it shows therein: the first corner connecting element 121 on the bottom lateral connecting parts 12 of the bottom finished module 1; the door end corner pillar 213 of the lateral finished module 2; the first corner connecting element 221 on the lateral bottom connecting part 22; and the connecting piece 91. The first corner connecting element 121 of the bottom lateral connecting part 12 comprises an abutting block 1211 having a receiving cavity, and the first corner connecting element 221 of the lateral bottom connecting part 22 comprises a downwardly protruding protrusion 2211. The receiving cavity of the abutting block 1211 is injected with a filler at a position corresponding to the protrusion 2211, and the filler forms the connecting piece 91, after solidification, such that the first corner connecting element 121 of the bottom finished module 12 and the first corner connecting element 221 of the lateral finished module 22 are fixedly connected together. The filler may be a glue, a high strength resin, a special cement, or the like. In order to improve mutual grasping of the concave and convex structures, the protrusion 2211 is special-shaped, particularly, the protrusion may designed to have concave and convex parts in mesh with each other according to the actual requirements.

Referring to FIGS. 7A-7E which shows the connection relations of the lateral finished modules 2, 3 and the bottom finished module 1 at the front end corners. These connection relations may be used for the connection of the lateral finished modules 2, 3 and the top finished module 5 at the front end corners.

Figure 7A:
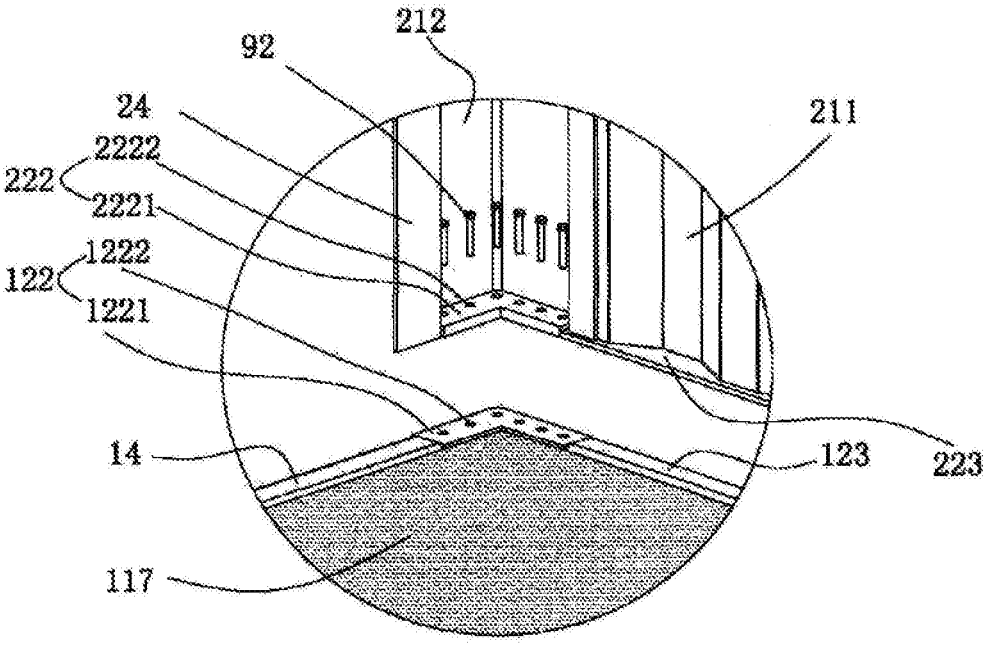

Referring to FIG. 7A which shows the first embodiment, it shows therein: the floor 117 on the bottom body 11, the second corner connecting element 122 and the lateral connecting element 123 on the bottom lateral connecting part 12, and the bottom front connecting part 14 of the bottom finished module 1; the lateral wall 211, the front end corner pillar 212, the second corner connecting element 222 and the lateral connecting element 223 on the lateral bottom connecting part 22, and the lateral front connecting part 24 of the lateral finished module 2; and the connecting piece 92. The second corner connecting element 122 of the bottom lateral connecting part 12 comprises a first overlapping piece 1221 having a horizontally overlapping surface. The first overlapping piece 1221 has a shape of L, and has a first connecting hole 1222 disposed therein. The second corner connecting element 222 of the lateral bottom connecting part 22 comprises a second overlapping piece 2221 having a horizontally overlapping surface. The second overlapping piece 2221 has a shape of L, and has a second connecting hole 2222 disposed therein. The connecting part 92 may be a fastener such as a bolt and a rivet correspondingly disposed to penetrate into the first connecting hole 1222 and the second connecting hole 2222.

Referring to FIG. 7A0, in other embodiments, the first overlapping piece 1221 has a vertically overlapping surface instead of a horizontally overlapping surface; moreover, the second overlapping piece 2221 has a vertically overlapping surface, too, rather than a horizontally overlapping surface. In addition, the second overlapping piece may be located at the outer side of the first overlapping piece 1221, rather than above the first overlapping piece 1221. The second overlapping piece 2221 and the front end corner pillar 212 are welded together in advance, and the third connecting hole 2121 is disposed in the front end corner pillar 212 at a position corresponding to the second connecting hole 2222 (in conjunction with FIG. 7A1).

Referring to FIG. 7A1 which shows a variant design based on the structure shown in FIG. 7A0, the connecting piece 92 has locking effect, preferably, the connecting piece is a rivet. The connecting hole 1222 in the first overlapping piece 1221, the connecting hole 2222 in the second overlapping piece 2221, and the connecting hole 2121 in the front end corner pillar 212 are aligned to one another (refer to the figure on the left side). When the rivet is inserted (refer to the figure in the middle), there is a gap d2 between the rivet and these connecting holes 1222, 2222, 2121. After riveting (refer to the figure on the right side), due to material deformation of the rivet (solid rivet) during riveting process, the rivet may fill up these connecting holes 1222, 2222, 2121, thus eliminating the gap d2. It would be noted, when two overlapping pieces 1221, 2221 are overlapped, due to the assembly errors, the connecting hole 1222 and other connecting holes 2221, 2121 may not be aligned completely. However, according to the disclosure, the performance characteristics of the rivet that can completely eliminate the gap d2 afterwards is purposefully used, such that the hole assembly error (i.e., the connecting hole 1222 and other connecting holes 2221, 2121 are not aligned completely, and there is a deviation) may be tolerable. Therefore, it is not necessary to over strictly control the machining accuracy of the finished modules, and assembling of the container is facilitated. In addition, though in FIG. 7A1, the rivet is amounted by inserting into the corresponding connecting hole from inner side to outer side of the container, in other embodiments, the rivet may be amounted by inserting into the corresponding connecting hole from outer side to inner side of the container.

Figure 7B:
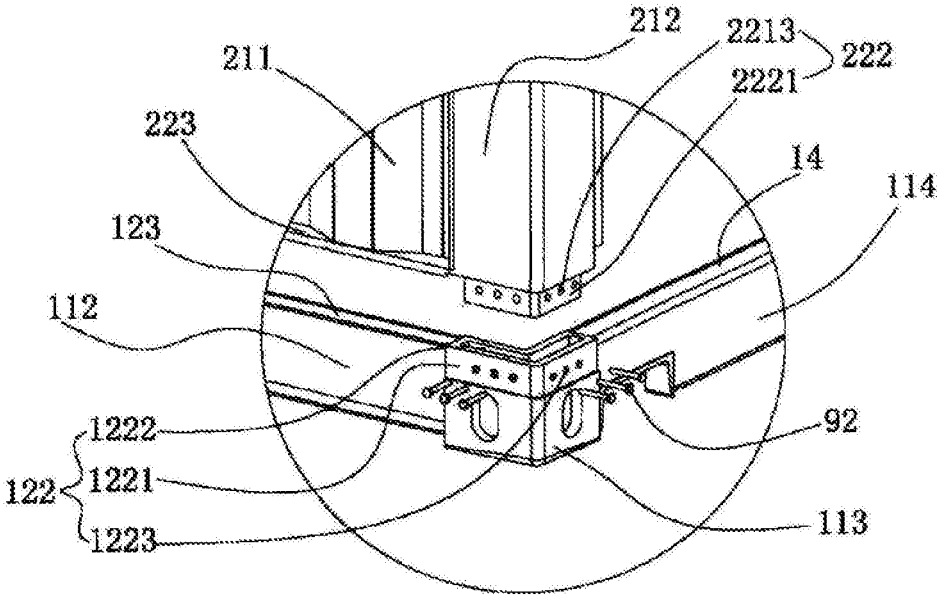

Referring to FIG. 7B which shows the second embodiment, it shows therein: the bottom longitudinal beams 112 on the bottom body 11, the front end bottom corner fittings 113, the front end bottom beam 114, the second corner connecting element 122 and the lateral connecting element 123 on the bottom lateral connecting parts 12, and the bottom front connecting part 14 of the bottom finished module 1; the lateral wall 211, the front end corner pillar 212, the second corner connecting element 222 and the lateral connecting element 223 on the lateral bottom connecting part 22 of the lateral finished module 2; and the connecting piece 92. The second corner connecting element 122 of the bottom lateral connecting part 12 comprises an abutting block 1221 having a receiving cavity 1222. The abutting block 1221 and the receiving cavity 1222 disposed in the abutting block each has a shape of L. The first connecting hole 1223 is horizontally disposed in the abutting block 1221. The second corner connecting element 221 of the lateral bottom connecting part 22 comprises a downwardly protruding protrusion 2211. The protrusion 2211 has a shape of L, and the second connecting hole 2213 is horizontally disposed in the protrusion 2211. The connecting piece 92 may be a connecting piece having a locking effect and is correspondingly disposed to penetrate into the first connecting hole 1223 and the second connecting hole 2213. Preferably, this connecting piece may be a rivet.

Figure 7C:
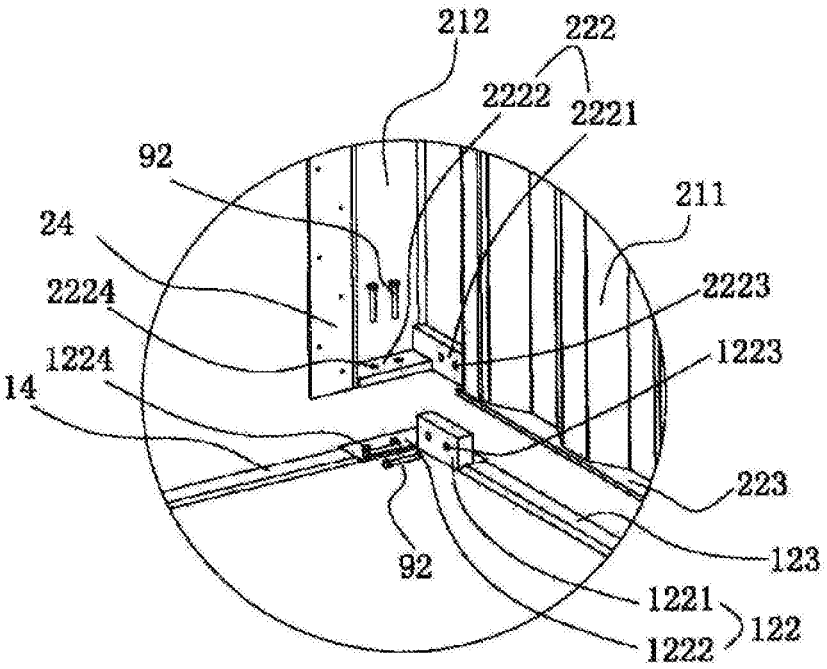

Referring to FIG. 7C which shows the third embodiment, it shows therein: the second corner connecting element 122 and the lateral connecting element 123 on the bottom lateral connecting parts 12, and the bottom front connecting part 14 of the bottom finished module 1; the lateral wall 211, the front end corner pillar 212, the second corner connecting element 222 and the lateral connecting element 223 on the lateral bottom connecting part 22, and the lateral front connecting part 24 of the lateral finished module 2; and the connecting piece 92. The second corner connecting element 122 of the bottom lateral connecting part 12 comprises a first overlapping piece comprising a first overlapping part 1221 which has a vertically overlapping surface and a second overlapping piece 1222 which has a horizontally overlapping surface. A first connecting hole 1223 is horizontally disposed in the first overlapping piece 1221, and a second connecting hole 1224 is disposed in the second overlapping piece 1222. The second corner connecting element 222 of the lateral bottom connecting part 22 comprises a first overlapping piece which includes a third overlapping piece 2221 having a vertically overlapping surface and a fourth overlapping piece 2222 having a horizontally overlapping surface. The third connecting hole 2223 is horizontally disposed in the third overlapping piece 2221. A fourth connecting hole 2224 is disposed in the fourth overlapping piece 2222. The connecting piece 92 further includes a connecting piece having locking effect and correspondingly disposed to penetrate into the first connecting hole 1223 and the third connecting hole 2223. Preferably, the connecting piece is a rivet. The connecting piece 92 may further comprise a connecting piece which is correspondingly disposed to penetrate into the second connecting hole 1224 and the fourth connecting hole 2224, and which may be a fastener such as a bolt or a rivet.

Figure 7D:
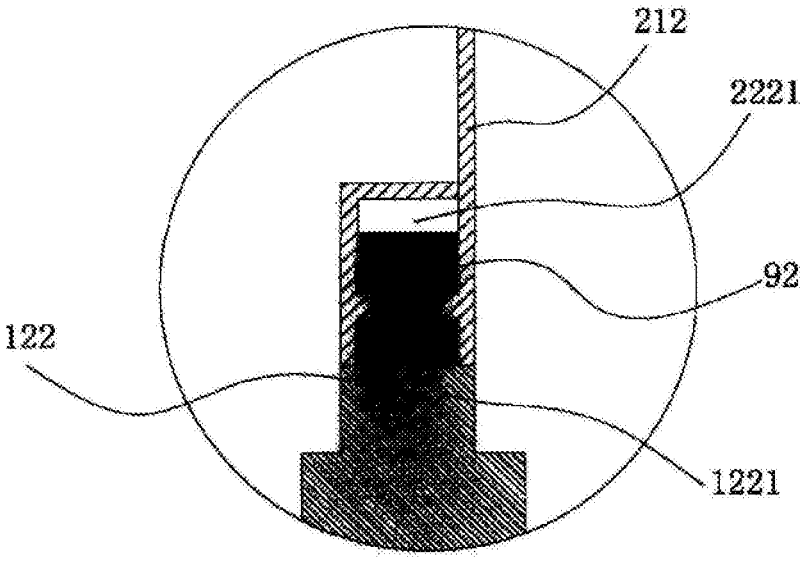

Referring to FIG. 7D which shows the fourth embodiment, it shows therein: the second corner connecting element 122 on the bottom lateral connecting parts 12 of the bottom finished module 1; the front end corner pillar 212 of the lateral finished module 2; the second corner connecting element 222 of the lateral bottom connecting part 22; and the connecting piece 92. The second corner connecting element 122 of the bottom lateral connecting part 12 comprises an upwardly protruding protrusion 1221. The second corner connecting element 222 of the lateral bottom connecting part 22 comprises a receiving cavity 2221 formed at the bottom of the front end corner pillar. The receiving cavity 2211 is injected with a filler at a position corresponding to the protrusion 1221. The filler 2222 forms the connecting piece 92 after solidification, such that the second corner connecting element 122 of the bottom lateral connecting part 12 and the second corner connecting element 222 of the lateral bottom connecting part 22 are fixedly connected together. The filler may be a glue, a high strength resin, a special cement, or the like. In order to improve mutual grasping of the concave and convex structures, the protrusion 1221 is special-shaped, and may be designed to have concave and convex parts in mesh with each other according to the actual requirements.

Figure 7E:
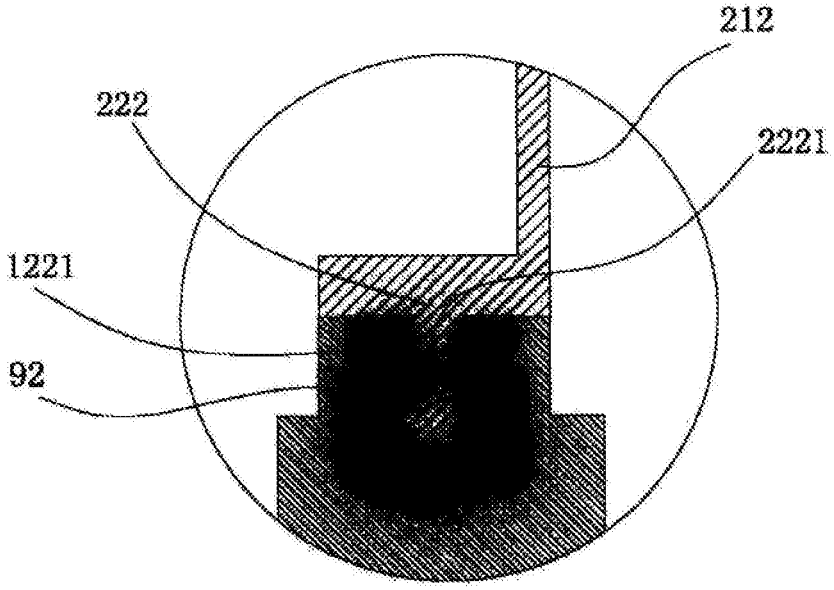

Referring to FIG. 7E which shows the fifth embodiment, it shows therein: the second corner connecting element 122 on the bottom lateral connecting parts 12 of the bottom finished module 1; the front end corner pillar 212 of the lateral finished module 2; the second corner connecting element 222 of the lateral bottom connecting part 22; and the connecting piece 92. The second corner connecting element 122 of the bottom lateral connecting part 12 comprises an abutting block 1221 having a receiving cavity. The second corner connecting element 222 of the lateral finished module 22 comprises a downwardly protruding protrusion 2221. The receiving cavity of the abutting block is injected with a filler at a position corresponding to the protrusion, and the filler forms the connecting piece 92 after solidification, such that the second corner connecting element 122 of the bottom lateral connecting part 12 and the second corner connecting element 222 of the lateral bottom connecting part 22 are fixedly connected together. The filler may be a glue, a high strength resin, a special cement, or the like. In order to improve mutual grasping of the concave and convex structures, the protrusion 2221 is special-shaped, and may be designed to have concave and convex parts in mesh with each other according to the actual requirements.

Referring to FIGS. 8A-8H which shows connection relations of the lateral finished modules 2, 3 and the bottom finished module 1 on sides of the bottom longitudinal beams 112.

Referring to FIGS. 8A and 8A1 which show the first embodiment, it shows therein: the bottom longitudinal beams 112 on the bottom body 11 and the lateral connecting element 123 on the bottom lateral connecting parts 12 of the bottom finished module 1; the lateral wall 211, and the lateral connecting element 223 on the lateral bottom connecting part 22 of the lateral finished module 2; and the connecting piece 93. The bottom longitudinal beams 112 has a shape of C, and comprises an upper flange that is extended horizontally outwardly, a lower flange, and a web connected between the upper and lower flanges. The upper flange forms the lateral connecting element 123 on the bottom lateral connecting part 12. The lateral connecting element 123 comprises a horizontally extended abutting wall (upper flange), and has several connecting holes disposed therein. Accordingly, the lateral connecting element 223 of the lateral bottom connecting part 22 of the lateral finished module 2 is formed by a side lower longitudinal beam 223. The lateral connecting element is a L-shaped plate, which includes a flat plate (horizontally extended abutting wall) and an outer side edge protruding downwardly from an outer side of the flat plate. The outer side edge is disposed on an outer side of the upper flange corresponding to the bottom longitudinal beam 112. The connecting piece 93 may be a fastener such as a bolt and a rivet correspondingly disposed to penetrate into the connecting hole.

Referring to FIGS. 8B and 8B1 which show the second embodiment, it shows therein: the bottom longitudinal beams 112 on the bottom body 11 and the lateral connecting element 123 on the bottom lateral connecting parts 12 of the bottom finished module 1; the lateral wall 211 of the lateral finished module 2 and the lateral connecting element 223 of the lateral bottom connecting part 22; and the connecting piece 93. The bottom longitudinal beams 112 has a shape of C, and comprises an upper flange extending outwardly, a lower flange, and a web connected between the upper and lower flanges. The lateral connecting element 123 is disposed (welded) on a top of the upper flange. The lateral connecting element 123 comprises a horizontally extending abutting wall. The abutting wall has a convex cross section, and comprises an outer side step and an inner side step with several connecting holes disposed therein. Accordingly, the lateral connecting element 223 of the lateral bottom connecting part 22 of the lateral finished module 2 is formed by a side lower longitudinal beam. The lateral connecting element 223 is a C-shaped plate with a connecting hole disposed therein. The C-shaped plate comprises a flat plate (horizontally extending abutting wall), an outer side edge protruding downward from an outside of the flat plate, and an inner side edge protruding downward from an inner side of the flat plate. The outer side edge is disposed on the outer side step of the lateral connecting element 123, and the inner side edge is disposed on the inner side step of the lateral connecting element 123. The connecting piece 93 may be a fastener such as a bolt and a rivet correspondingly disposed to penetrate into the connecting hole.

Referring to FIG. 8C which shows the third embodiment, it shows therein: the bottom longitudinal beam 112 on the bottom body 11 and the lateral connecting element 123 on the bottom lateral connecting parts 12 of the bottom finished module 1; the lateral wall 211 and the lateral connecting element 223 of the lateral bottom connecting part 22 of the lateral finished module 2; and the connecting piece 93. The bottom longitudinal beam 112 has a shape of L, and comprises a lower flange extending outwardly and a web. The lateral connecting element 123 is disposed (e.g., welded) on the top of the web. The lateral connecting element 123 comprises a horizontally extending abutting wall having a convex cross section and comprising an outer side step and an inner side step with several connecting holes disposed therein. Accordingly, the lateral connecting element 223 of the lateral bottom connecting part 22 of the lateral finished module 2 is formed by the side lower longitudinal beam. The lateral connecting element 223 is a C-shaped plate with connecting holes disposed therein. The C-shaped plate comprises a flat plate (horizontally extending abutting wall), an outer side edge protruding downwardly from an outer side of the flat plate, and an inner side edge protruding downwardly from an inner side of the flat plate. The outer side edge is disposed on the outer side step of the lateral connecting element 123, and the inner side edge is disposed on the inner side step of the lateral connecting element 123. The connecting piece 93 may be a fastener such as a bolt and a rivet disposed to penetrate into the corresponding connecting hole. Referring to FIG. 8C1, the lateral connecting element 223 may be replaced by a L-shaped plate, and the lateral connecting element 123 may be replaced by a plate having an outer side step. Preferably, an indentation 1231 is formed in a top of the outer side step. Referring to FIG. 8C2, the lateral connecting element 223 may be replaced by a flat plate, and the lateral connecting element 123 may be replaced by a flat plate.

Figure 8D:
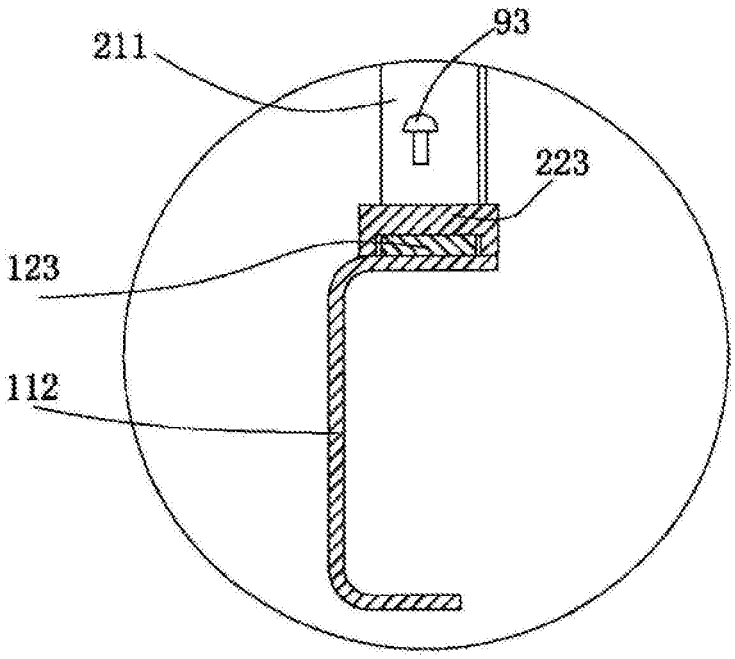

Referring to FIG. 8D which shows the fourth embodiment, it shows therein: the bottom longitudinal beams 112 on the bottom body 11 and the lateral connecting element 123 on the bottom lateral connecting parts 12 of the bottom finished module 1; the lateral wall 211 and the lateral connecting element 223 of the lateral bottom connecting part 22 of the lateral finished module 2; and the connecting piece 93. The bottom longitudinal beams 112 has a shape of C, and comprises an upper flange extending outwardly, a lower flange and a web connected between the upper and lower flanges. The lateral connecting element 123 is disposed (welded) on the top of the upper flange, and cooperates with the upper flange to form an outer side step and an inner side step. The lateral connecting element 123 may be a horizontally extending abutting wall, and have several connecting holes disposed therein. Accordingly, the lateral connecting element 223 of the lateral bottom connecting part 22 of the lateral finished module 2 is formed by the side lower longitudinal beam. The lateral connecting element 223 is a C-shaped plate with connecting holes disposed therein. The C-shaped plate comprises a flat plate (horizontally extending abutting wall), an outer side edge protruding downwardly from an outer side of the flat plate, and an inner side edge protruding downwardly from an inner side of the flat plate. The outer side edge is disposed on the outer side step of the lateral connecting element 123, and the inner side edge is disposed on the inner side step of the lateral connecting element 123. The connecting piece 93 may be a fastener such as a bolt and a rivet disposed to penetrate into the corresponding connecting hole.

Figure 8E:
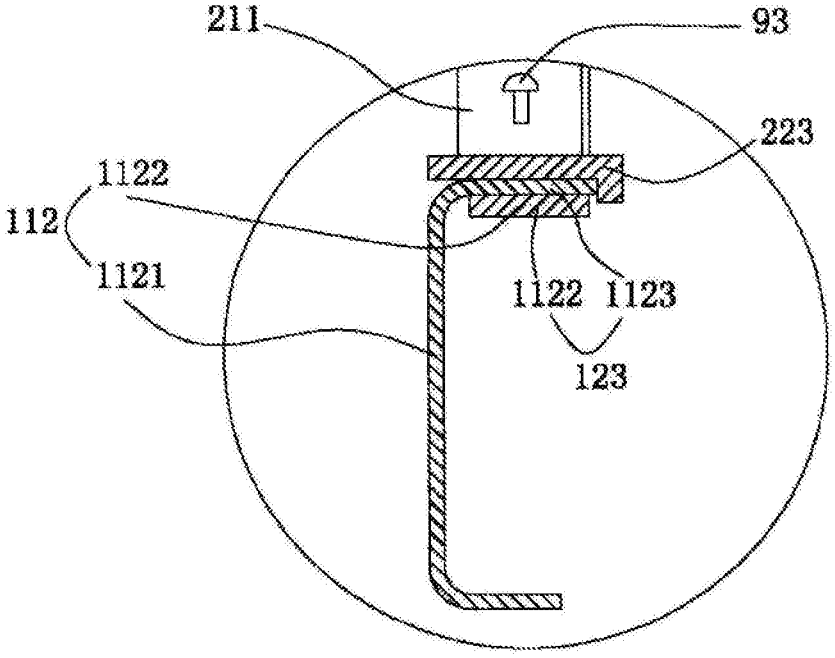

Referring to FIG. 8E which shows the fifth embodiment, it shows therein: the bottom longitudinal beams 112 on the bottom body 11 of the bottom finished module 1; the lateral wall 211 and the lateral connecting element 223 of the lateral bottom connecting part 22 of the lateral finished module 2; and the connecting piece 93. The bottom longitudinal beam 112 comprises a C-shaped body 1121. The body 1121 comprises an upper flange 1123 that is extended horizontally outwardly, a lower flange, and a web connected between the upper and lower flanges; and a flat plate 1122 disposed on a bottom side of the upper flange 1124. The upper flange 1123 of the body 1121 and the flat plate 1122 at a bottom side of the body together form the lateral connecting element 123 (horizontally extending abutting wall) on the bottom lateral connecting parts 12 with several connecting holes disposed therein. Accordingly, the lateral connecting element 223 of the lateral bottom connecting part 22 of the lateral finished module 2 is formed by the side lower longitudinal beam. The lateral connecting element 223 is a L-shaped plate with connecting holes disposed therein. The L-shaped plate comprises a flat plate (horizontally extending abutting wall), a side edge protruding downwardly from an outer side of the flat plate. The side edge is disposed on outer side of the lateral connecting element 123. The connecting piece 93 may be a fastener such as a bolt and a rivet disposed to penetrate the corresponding connecting hole.

Figure 8F:
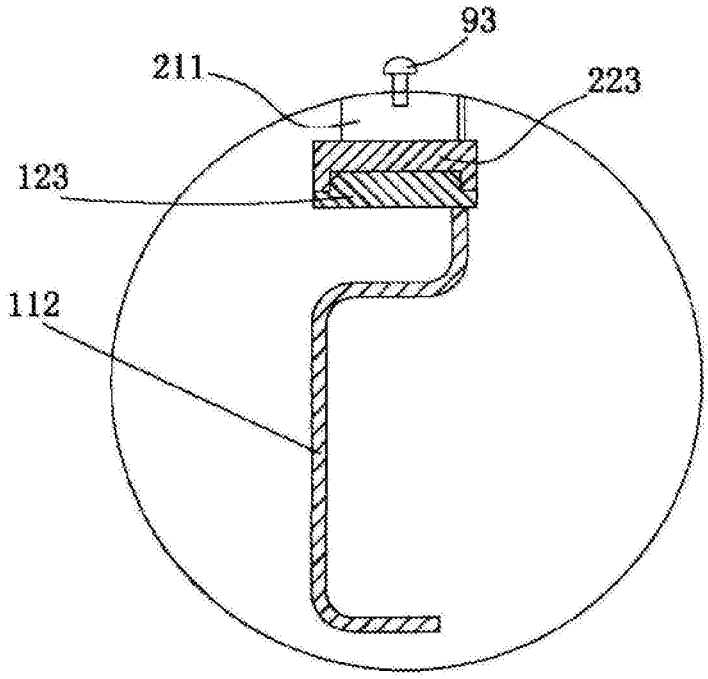

Referring to FIG. 8F which shows the sixth embodiment, it shows therein: the bottom longitudinal beam 112 on the bottom body 11 and the lateral connecting element 123 on the bottom lateral connecting parts 12 of the bottom finished module 1; the lateral wall 211 and the lateral connecting element 223 of the lateral bottom connecting part 22 of the lateral finished module 2; and the connecting piece 93. The bottom longitudinal beams 112 comprises an upper flange extending outwardly, a lower flange, a web connected between the upper and lower flanges, and an extending part extending upwardly from the upper flange. The lateral connecting element 123 is disposed on a top of the extending part, and comprises a horizontally extending abutting wall having a convex cross section and comprising an outer side step and an inner side step with several connecting holes disposed therein. Accordingly, the lateral connecting element 223 of the lateral bottom connecting part 22 of the lateral finished module 2 is formed by the side lower longitudinal beam. The lateral connecting element 223 is a C-shaped plate with connecting holes disposed therein. The C-shaped plate comprises a flat plate (—horizontally extending abutting wall—), an outer side edge protruding downwardly from an outer side of the flat plate, and an inner side edge protruding downwardly from an inner side of the flat plate. The outer side edge is disposed on the outer side step of the lateral connecting element 123, and the inner side edge is disposed on the inner side step of the lateral connecting element 123. The connecting piece 93 may be a fastener such as a bolt and a rivet disposed to penetrate into the corresponding connecting hole.

Figure 8G:
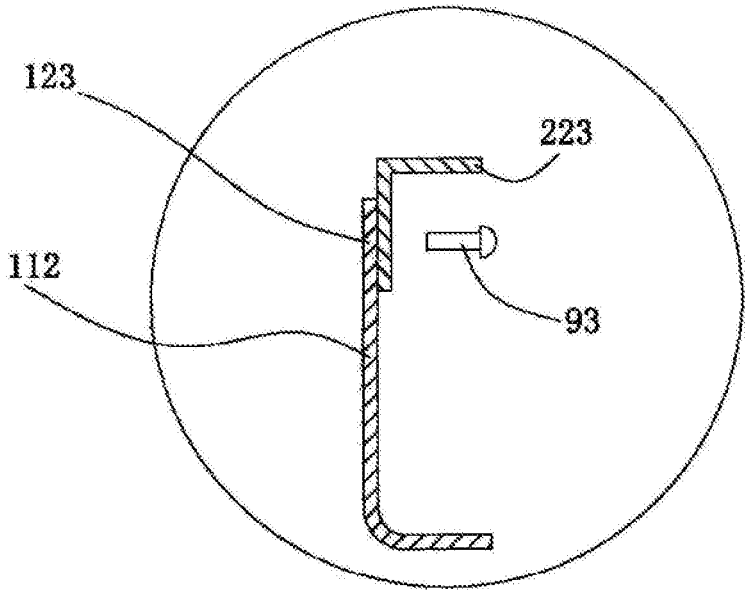

Referring to FIG. 8G which shows the seventh embodiment, it shows therein: the bottom longitudinal beam 112 on the bottom body 11 and the lateral connecting element 123 on the bottom lateral connecting parts 12 of the bottom finished module 1; the lateral wall 211 and the lateral connecting element 223 of the lateral bottom connecting part 22 of the lateral finished module 2; and the connecting piece 93. The bottom longitudinal beam 112 has a shape of L, and comprises a lower flange extending horizontally outwardly and a web vertically extending upward. The lateral connecting element 123 comprises a vertical extending abutting wall (i.e., the upper part of the web), and has several connecting holes disposed therein. Accordingly, the lateral connecting element 223 of the lateral bottom connecting part 22 of the lateral finished module 2 is formed by the side lower longitudinal beam. The lateral connecting element 223 is a L-shaped plate, and comprises a flat plate part and a vertical plate part (abutting wall extending vertically). The vertical plate part is correspondingly fit to an outer side of the web of the bottom longitudinal beam, and connecting holes are disposed therein. Alternatively, the lateral connecting element 223 may be a vertical plate (abutting wall extending vertically), and the vertical plate is correspondingly fit to an outer side of the web of the bottom longitudinal beam with connecting holes disposed therein. The connecting piece 93 may be a fastener such as a bolt and a rivet disposed to penetrate into the corresponding connecting hole. It would be noted, in other embodiments, the web of the bottom longitudinal beam may be correspondingly fit to an outer side of the vertical plate.

Figure 8H:
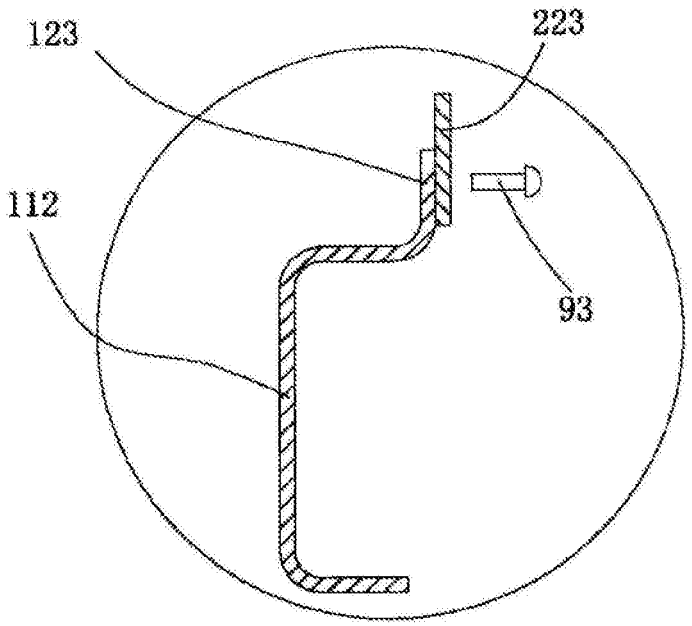

Referring to FIG. 8H which shows the eighth embodiment, it shows therein: the bottom longitudinal beam 112 on the bottom body 11 and the lateral connecting element 123 on the bottom lateral connecting parts 12 of the bottom finished module 1; the lateral wall 211 and the lateral connecting element 223 of the lateral bottom connecting part 22 of the lateral finished module 2; and the connecting piece 93. The bottom longitudinal beam 112 comprises an upper flange extending outwardly, a lower flange, a web connected between the upper and lower flanges, and an extending part vertically extending upwardly from the upper flange. The lateral connecting element 123 comprises a vertically extending abutting wall (i.e., the extending part), and has several connecting holes disposed therein. Accordingly, the lateral connecting element 223 of the lateral bottom connecting part 22 of the lateral finished module 2 is formed by the side lower longitudinal beam. The lateral connecting element 223 is a vertical plate (extending vertically abutting wall), and the vertical plate is correspondingly fit to an outer side of the web of the bottom longitudinal beam with connecting hole disposed therein. Alternatively, the lateral connecting element 223 may be a L-shaped plate which includes a flat plate part and a vertical plate part (extending vertically abutting wall), and the vertical plate part is correspondingly fit to an outer side of the web of the bottom longitudinal beam with connecting holes disposed therein. The connecting piece 93 may be a fastener such as a bolt and a rivet disposed to penetrate into the corresponding connecting hole. It would be noted, in other embodiments, the web of the bottom longitudinal beam may be correspondingly fit to the outer side of the vertical plate.

It would be noted, for connections of the lateral finished module 2 and the bottom finished module 1 at the side of the bottom longitudinal beam 112, in addition to disposing the connecting holes in the structural pieces and inserting the connecting pieces into the connecting holes to achieve fixed connection, as stated above, the connections of the lateral finished module 2 and the bottom finished module 1 may be achieved by applying structural adhesive separately or in combination.

Next, the top finished module 5 and the connection relations between the top finished module 5 and the lateral finished modules 2, 3 will be discussed.

Referring to FIGS. 1 to 2E, similar to the bottom lateral connecting part 12 of the bottom finished module 1, the top lateral connecting part 52 of the top finished module 5 comprises: a first corner connecting element 521 on the top of the door end top corner fitting 511, a second corner connecting element 522 on the top of the front end top corner fittings 513, and a lateral connecting element 523 in the bottom of the top lateral beam 512, disposed on the same side of the top body 51. Correspondingly, similar to the lateral bottom connecting part 22, the lateral top connecting part 23 of the lateral finished module 2 comprises: a first corner connecting element 231 on the top of the door end corner pillar 213, a second corner connecting element 232 on the top of the front end corner pillar 212, and a lateral connecting element 233 on the top of the lateral wall 211, disposed on the lateral body 21. The first corner connecting element 231 is opposite to the first corner connecting element 521, the second corner connecting element 232 is opposite to the second corner connecting element 522, and the lateral connecting element 233 is opposite to the lateral connecting element 523.

Preferably, the top finished module 5 and the lateral finished module 2 are assembled together at the first corner connecting element 521 via a first group of connecting pieces, assembled together at the second corner connecting element 522 via a second group of connecting pieces, and assembled together at the lateral connecting element 523 via a third group of connecting pieces. Preferably, the third group of connecting pieces may be fasteners, more preferably, the third group of connecting pieces may be rivets. Alternatively, the top finished module 5 and the lateral finished module 2 may be assembled together, at the first corner connecting element 521 via welding, and assembled together at the second corner connecting element 522 via welding.

At a connection of the top finished module 5 and the lateral finished module 2, sealing may be achieved by: applying glue, an adhesive tape or an adhesive sheet and the like on a connection coupling surface or an inner/outer side of the coupling surface.

The structure of the top lateral connecting parts 53 is similar to the top lateral connecting parts 52 in the top finished module 5, the connection relations and sealing manners of the top finished module 5 and the lateral finished module 3 are similar to those of the top finished module 5 and the lateral finished module 3, and no redundant discussion is repeated here.

Preferably, the connection structure between the lateral finished module 2 and the top finished module 5 above the front end corner pillar 212 may adopt the connection structure between the lateral finished module 2 and the bottom finished module 1 below the front end corner pillar 212. The connection structure between the lateral finished module 2 and the top finished module 5 above the door end corner pillar 213 may adopt the connection structure between the lateral finished module 2 and the bottom finished module 1 below the door end corner pillar 213, and no redundant discussion is repeated here.

The connection relations of the lateral finished modules 2, 3 and the top finished module 5 at the sides of the top beams 52, 53 will be discussed hereinbelow by referring to FIGS. 9A-9M.

Figure 9A:
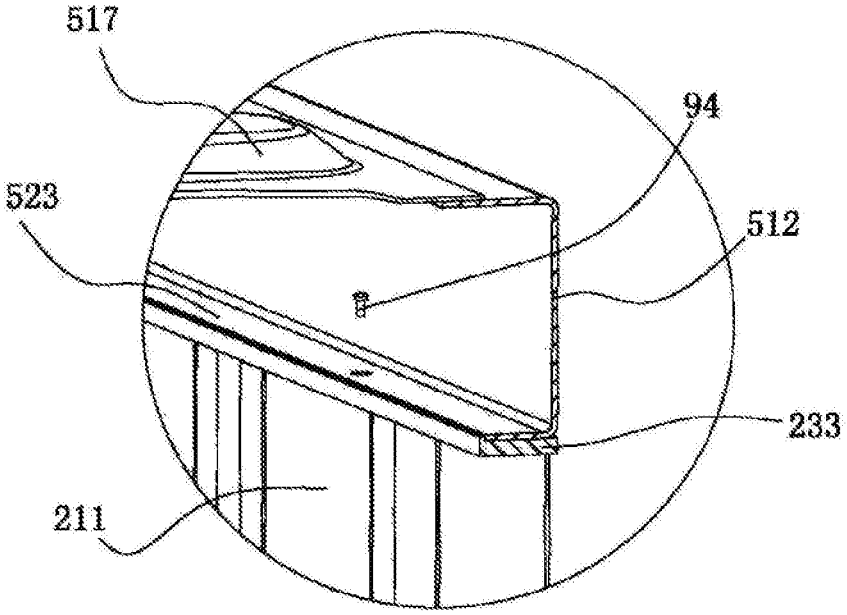

Referring to FIGS. 9A and 9A1 which shows the first embodiment, it shows therein: the top beam 512 on the top body 51, the lateral connecting element 523 on the top plate 517 and the top lateral connecting parts 52 of the top finished module 5; the lateral wall 211 and the lateral connecting element 233 of the lateral top connecting part 23 of the lateral finished module 2; and the connecting piece 94. The top lateral beam 512 has a shape of C, and comprises an upper flange horizontally extending inwardly, a lower flange (equivalent to horizontally extending abutting wall), and a web connected between the upper and lower flanges. The lower flange forms the lateral connecting element 523 on the top lateral connecting parts 52. Several connecting holes are disposed in the lateral connecting element 523. Accordingly, the lateral connecting element 233 of the lateral top connecting part 23 of the lateral finished module 2 is formed by a side upper longitudinal beam. The lateral connecting element 233 is a L-shaped plate, and comprises a flat plate (equivalent to horizontally extending abutting wall) and an inner side edge protruding upwardly from an inner side of the flat plate with the inner side edge positioned at an inner side of the corresponding lower flange. Several connecting holes are disposed in the flat plate. The connecting piece 94 may be a fastener such as a bolt and a rivet disposed to penetrate into the corresponding connecting hole.

Figure 9B:
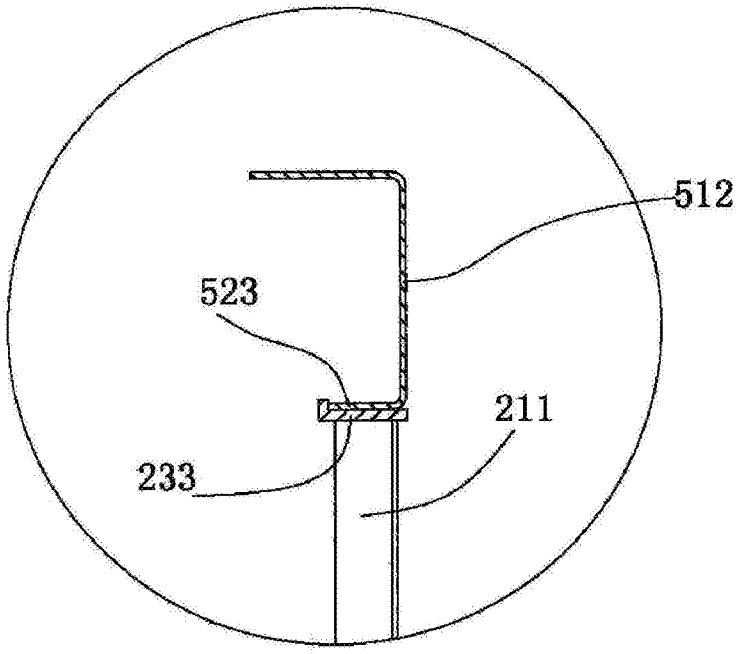
Figure 9B:
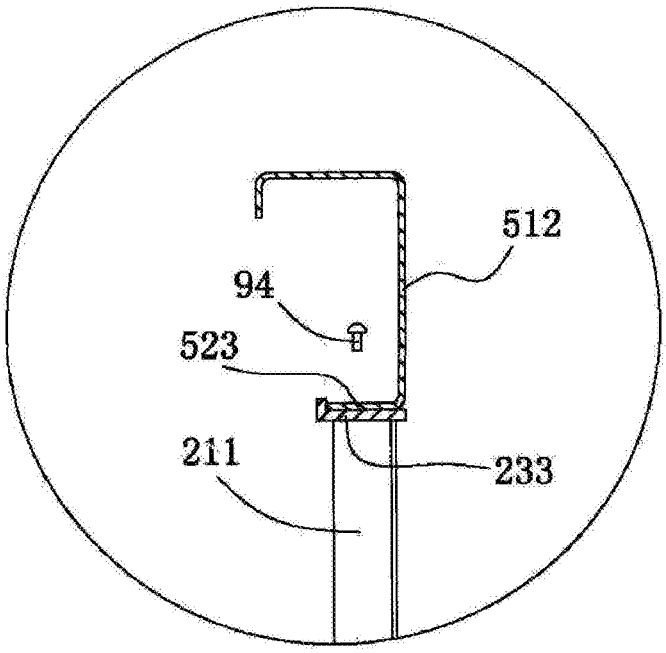

Referring to FIG. 9B which shows the second embodiment, it shows therein: the top beam 512 on the top body 51 and the lateral connecting element 523 on the top lateral connecting parts 52 of the top finished module 5; the lateral wall 211 and the lateral connecting element 233 of the lateral top connecting part 23 of the lateral finished module 2; and the connecting piece 94. The difference of the second embodiment with respect to the first embodiment is: a downwardly bended edge is disposed on an inner side of the upper flange top lateral beam 512.

Figure 9C:
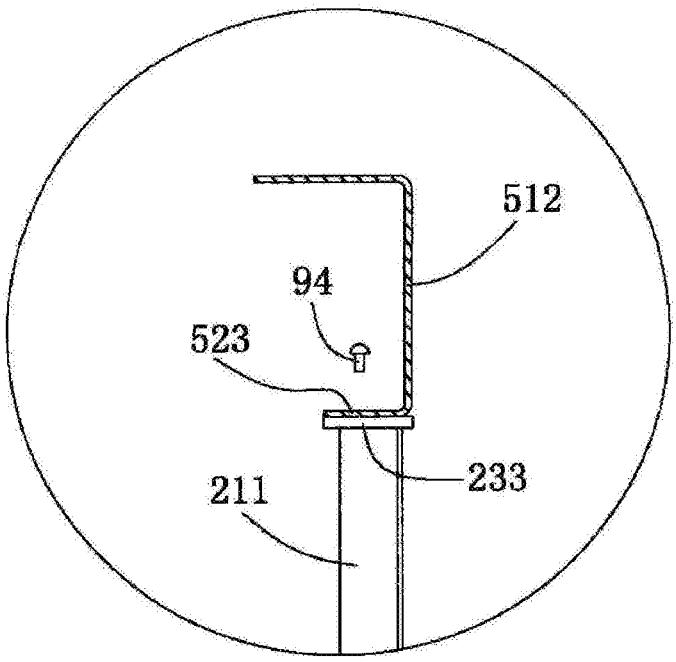

Referring to FIG. 9C which shows the third embodiment, it shows therein: the top beam 512 on the top body 51 and the lateral connecting element 523 on the top lateral connecting parts 52 of the top finished module 5; the lateral wall 211 and the lateral connecting element 233 of the lateral top connecting part 23 of the lateral finished module 2; and the connecting piece 94. The difference of the third embodiment with respect to the first embodiment is: the lateral connecting element 233 is only a flat plate without any side edge protruding upwardly.

Figure 9D:
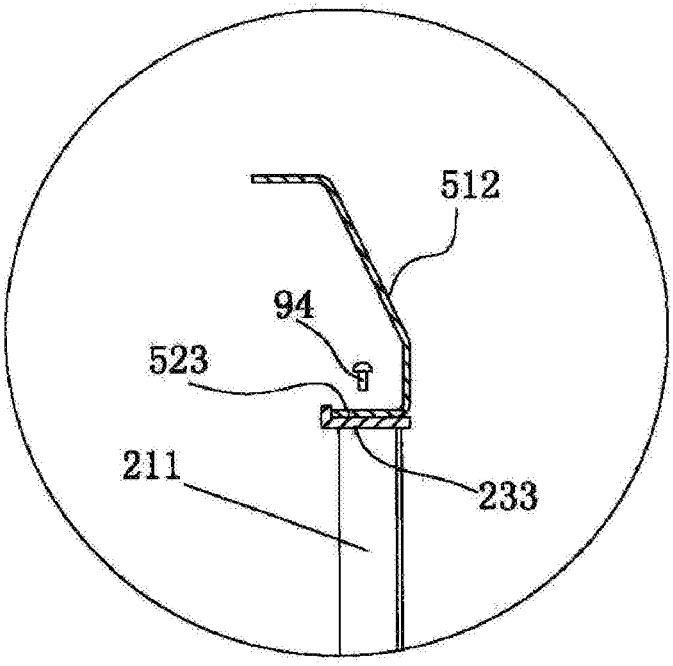

Referring to FIG. 9D which shows the fourth embodiment, it shows therein: the top beam 512 on the top body 51 and the lateral connecting element 523 on the top lateral connecting parts 52 of the top finished module 5; the lateral wall 211 and the lateral connecting element 233 of the lateral top connecting part 23 of the lateral finished module 2; and the connecting piece 94. The difference of the fourth embodiment with respect to the first embodiment is: the web of the top lateral beam 512 is consisted of an upper inclined section and a lower vertical section. The inclined section is inclined by extending outwardly and downwardly from an outer side of the upper flange.

Figure 9E:
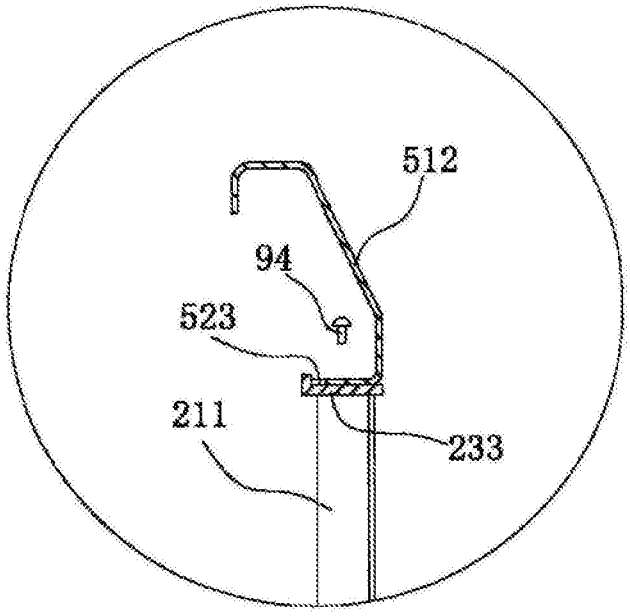

Referring to FIG. 9E which shows the fifth embodiment, it shows therein: the top beam 512 on the top body 51 and the lateral connecting element 523 on the top lateral connecting parts 52 of The top finished module 5; the lateral wall 211 and the lateral connecting element 233 of the lateral top connecting part 23 of the lateral finished module 2; and the connecting piece 94. The difference of the fifth embodiment with respect to the fourth embodiment is: a downwardly bended edge is disposed on an inner side of the upper flange of top lateral beam 512.

Figure 9F:
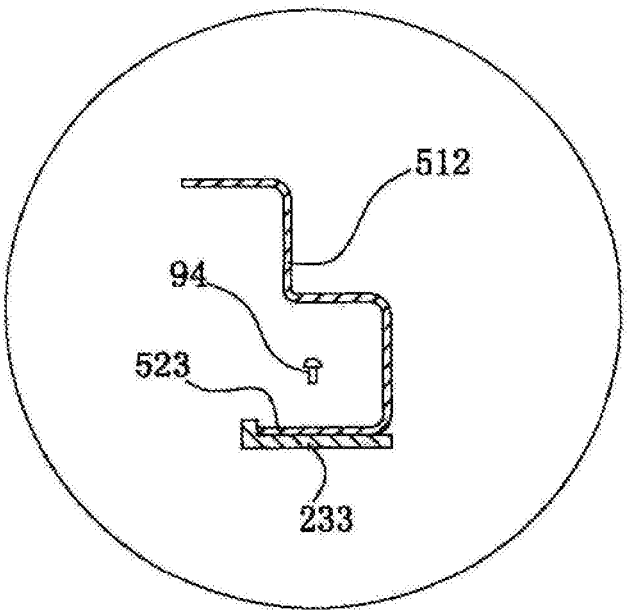

Referring to FIG. 9F which shows the sixth embodiment, it shows therein: the top beam 512 on the top body 51 and the lateral connecting element 523 on the top lateral connecting parts 52 of the top finished module 5; the lateral wall 211 and the lateral connecting element 233 of the lateral top connecting part 23 of the lateral finished module 2; and the connecting piece 94. The difference of the sixth embodiment with respect to the first embodiment is: the web of the top lateral beam 512 is consisted of an upper first vertical section, a horizontal section extending outwardly from the first vertical section, and a second vertical section extending downwardly from an outer side of the horizontal section.

Figure 9G:
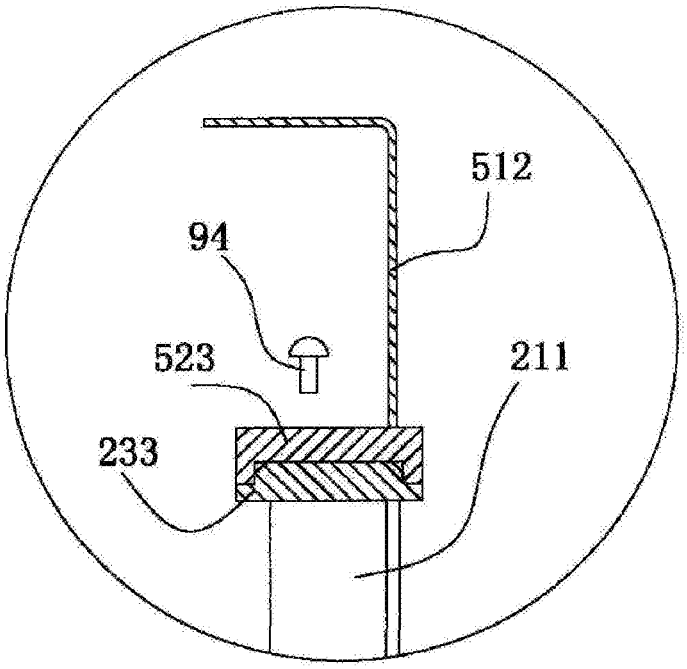

Referring to FIG. 9G which shows the seventh embodiment, it shows therein: the top beam 512 on the top body 51 and the lateral connecting element 523 on the top lateral connecting parts 52 of the top finished module 5; the lateral wall 211 and the lateral connecting element 233 of the lateral top connecting part 23 of the lateral finished module 2; and the connecting piece 94. The top lateral beam 512 has a shape of L, and comprises an upper flange and a web vertically extending downwardly from the outer side of the upper flange. The lateral connecting element 523, as a C-shaped plate, is disposed (e.g., welded) at a bottom of the web. The C-shaped plate comprises a flat plate (equivalent to horizontally extending abutting wall), an outer side edge extending downwardly from an outer side of the flat plate, and an inner side edge extending downwardly from an inner side of the flat plate. Several connecting holes are disposed in the flat plate. Accordingly, the lateral connecting element 233 of the lateral top connecting part 23 of the lateral finished modules 2 is formed by the side upper longitudinal beam, the lateral connecting element 233 is convex plate, and comprises an outer side step and an inner side step. An outer side edge of the C-shaped plate is disposed on the outer side step of the lateral connecting element 233, and an inner side edge of the C-shaped plate is disposed on the inner side step of the lateral connecting element 223.

Figure 9H:
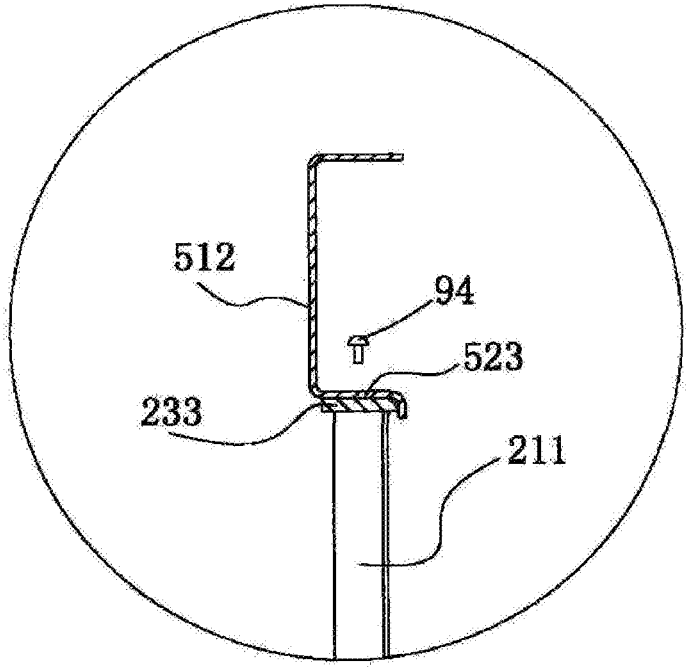

Referring to FIG. 9H which shows the eighth embodiment, it shows therein: the top beam 512 on the top body 51 and the lateral connecting element 523 on the top lateral connecting parts 52 of the top finished module 5; the lateral wall 211 and the lateral connecting element 233 of the lateral top connecting part 23 of the lateral finished module 2; and the connecting piece 94. The top lateral beam 512 comprises a C-shaped body and an outer side edge. The C-shaped body comprises an upper flange, a lower flange, and a web connected on inner sides of the upper and lower flanges. The outer side edge is bent by extending downwardly from an outer side of the lower flange. The lateral connecting element 523 is formed by the lower flange (equivalent to the horizontally extending abutting wall) and the side edge. Accordingly, the lateral connecting element 233 of the lateral top connecting part 23 of the lateral finished module 2 is formed by the side upper longitudinal beam. The lateral connecting element 233 is a flat plate (equivalent to the horizontally extending abutting wall), and the outer side edge is positioned on an outer side of the flat plate.

Figure 9I:
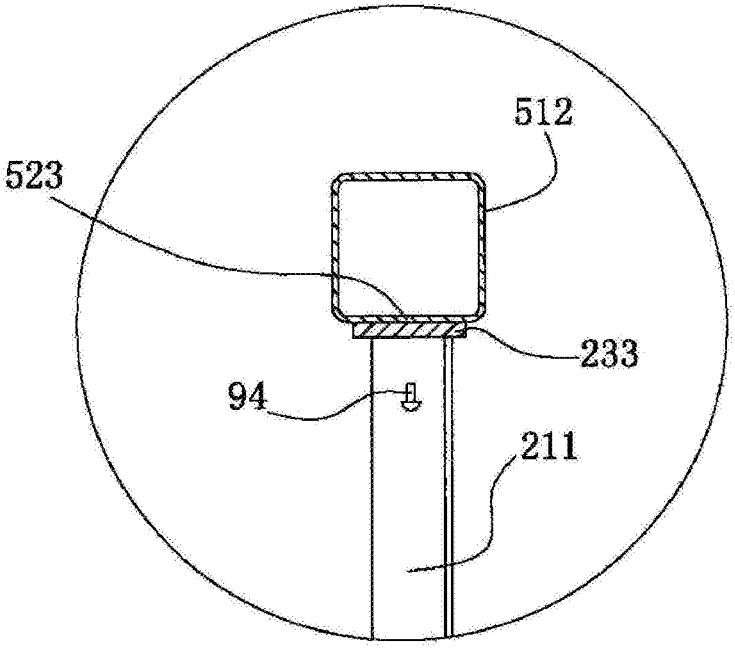

Referring to FIG. 9I which shows the ninth embodiment, it shows therein: the top beam 512 on the top body 51 and the lateral connecting element 523 on the top lateral connecting parts 52 of the top finished module 5; the lateral wall 211 and the lateral connecting element 233 of the lateral top connecting part 23 of the lateral finished module 2; and the connecting piece 94. The top lateral beam 512 may be a square tube, and the lateral connecting element 523 is formed by a bottom wall of the square tube (equivalent to the horizontally extending abutting wall). Accordingly, the lateral connecting element 233 of the lateral top connecting part 23 of the lateral finished module 2 is formed by the side upper longitudinal beam, and the lateral connecting element 233 is a flat plate (equivalent to the horizontally extending abutting wall). The connecting piece 94 may be a fastener mounted from bottom to top onto the flat plate and into the connecting hole in the bottom wall of the square tube.

Figure 9J:
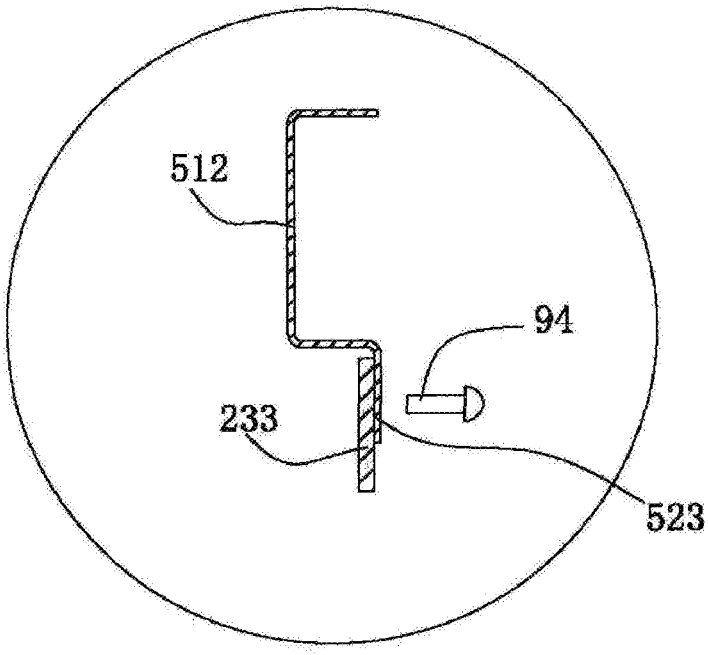

Referring to FIG. 9J which shows a tenth embodiment, it shows therein: the top beam 512 on the top body 51 and the lateral connecting element 523 on the top lateral connecting parts 52 of the top finished module 5; lateral wall 211 and the lateral connecting element 233 of the lateral top connecting part 23 of the lateral finished module 2; and the connecting piece 94. The top lateral beam 512 comprises a C-shaped body and a vertical wall. The C-shaped body comprises an upper flange, a lower flange, and a web connected on inner sides of both of the flanges. The vertical wall is bent by extending downwardly from an outer side of the lower flange, and the lateral connecting element 523 is formed by the vertical wall (equivalent to an abutting wall extending vertically). Accordingly, the lateral connecting element 233 of the lateral top connecting part 23 of the lateral finished module 2 is formed by the side upper longitudinal beam. The lateral connecting element 233 is a vertical plate (equivalent to an abutting wall extending vertically). The vertical wall is correspondingly fit to an outer side of the vertical plate 233. It would be noted, in other embodiments, the vertical plate 233 may be correspondingly fit to an outer side of the vertical wall.

Figure 9K:
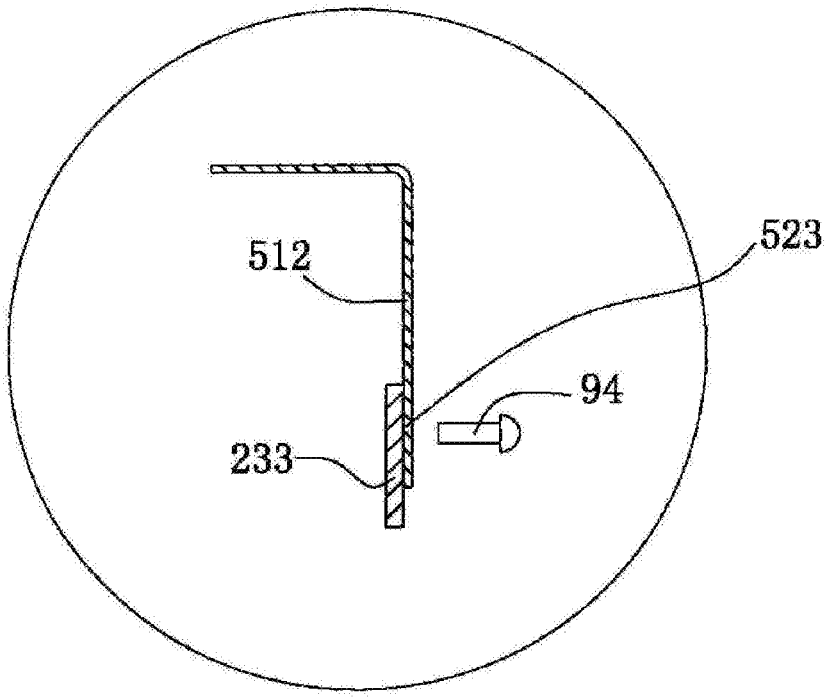

Referring to FIG. 9K which shows the eleventh embodiment, it shows therein: the top beam 512 on the top body 51 and the lateral connecting element 523 on the top lateral connecting parts 52 of the top finished module 5; the lateral wall 211 and the lateral connecting element 233 of the lateral top connecting part 23 of the lateral finished module 2; and the connecting piece 94. The top lateral beam 512 has a shape of L, and comprises a flat plate and a vertical wall extending downwardly from an outer side of the flat plate. The lateral connecting element 523 is formed by the vertical wall (equivalent to an abutting wall extending vertically). Accordingly, the lateral connecting element 233 of the lateral top connecting part 23 of the lateral finished module 2 is formed by the side upper longitudinal beam. The lateral connecting element 233 is a vertical plate (equivalent to an abutting wall extending vertically), and the vertical wall is correspondingly fit to an outer side of the vertical plate 233. It would be noted, in other embodiments, the vertical plate 233 may be correspondingly fit to an outer side of the vertical wall.

Figure 9L:
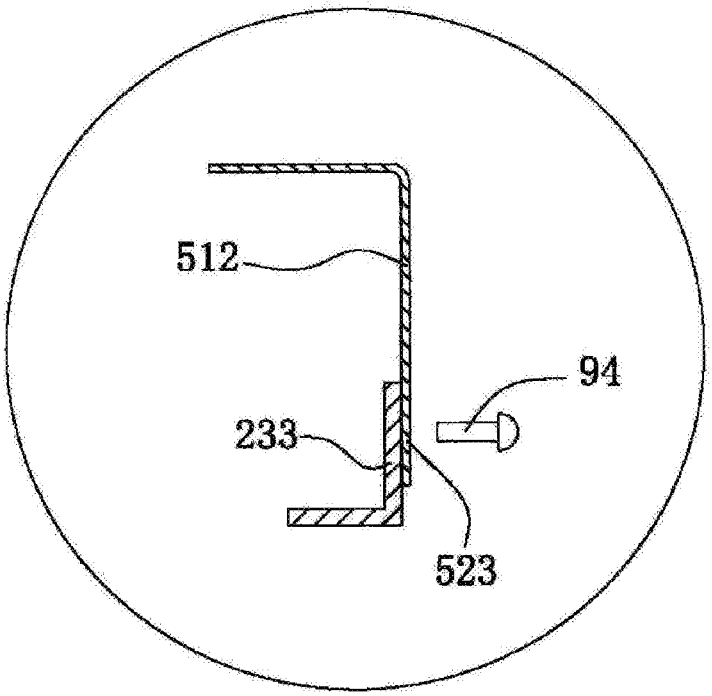

Referring to FIG. 9L which shows a twelfth embodiment, it shows therein: the top beam 512 on the top body 51 and the lateral connecting element 523 on the top lateral connecting parts 52 of the top finished module 5; the lateral wall 211 and the lateral connecting element 233 of the lateral top connecting part 23 of the lateral finished module 2; and the connecting piece 94. The top lateral beam 512 has a shape of L, and comprises a flat plate and a vertical wall extending downwardly from an outer side of the flat plate. The lateral connecting element 523 is formed by the vertical wall (equivalent to an abutting wall extending vertically). Accordingly, the lateral connecting element 233 of the lateral top connecting part 23 of the lateral finished module 2 is formed by the side upper longitudinal beam. The lateral connecting element 233 has a shape of L, and comprises a flat plate and a vertical plate extending upwardly from an outer side of the flat plate (equivalent to an abutting wall extending vertically). The vertical wall is correspondingly fit to an outer side of the vertical plate. It would be noted, in other embodiments, the vertical plate may be correspondingly fit to an outer side of the vertical wall.

Figure 9M:
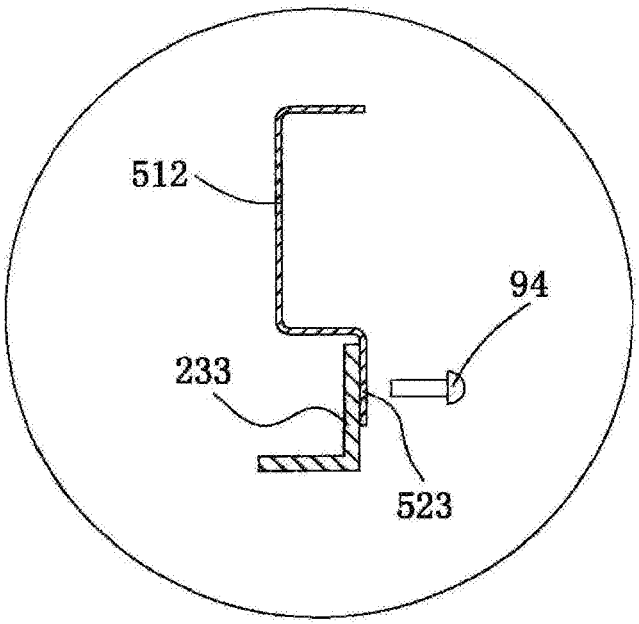

Referring to FIG. 9M which shows a thirteenth embodiment, it shows therein: the top beam 512 on the top body 51 and the lateral connecting element 523 on the top lateral connecting parts 52 of the top finished module 5; the lateral wall 211 and the lateral connecting element 233 of the lateral top connecting part 23 of the lateral finished module 2; and the connecting piece 94.

The top lateral beam 512 comprises a C-shaped body and a vertical wall. The C-shaped body comprises an upper flange, a lower flange, and a web connected on inner sides of the flanges. The vertical wall is bent by extending downwardly from an outer side of the lower flange, and the lateral connecting element 523 is formed by the vertical wall (equivalent to an abutting wall extending vertically). Accordingly, the lateral connecting element 233 of the lateral top connecting part 23 of the lateral finished module 2 is formed by the side upper longitudinal beam. The lateral connecting element 233 has a shape of L, and comprises a flat plate and a vertical plate extending upward from an outer side of the flat plate (equivalent to an abutting wall extending vertically). The vertical wall is correspondingly fit to an outer side of the vertical plate.

It would be noted, the connection of the lateral finished module 2 and the top finished module 5 at the top longitudinal beams 512 may be achieved not only by means of connecting pieces (fasteners) inserted into the connecting holes disposed in structural pieces, as stated above, but also achieved by structural adhesives used separately or in combination.

Again, the connection relations of the bottom finished module 1 and the front finished module 4 at the sides will be further discussed. The bottom front connecting part 14 of the bottom finished module 1 is disposed on the front end bottom beam 114 of the bottom body 11. Accordingly, the front bottom connecting part 42 of the front finished module 4 is disposed at a bottom of the front body 41. Preferably, the bottom finished module 1 and the front finished module 4 may be assembled together at the bottom front connecting part 14 via a group of connecting pieces. Sealing of the connections of the bottom finished module 1 and the front finished module 4 may be achieved by: applying glue, an adhesive tape or an adhesive sheet and the like to connection coupling surface or onto an inner/outer side of coupling surface.

Figure 10A:
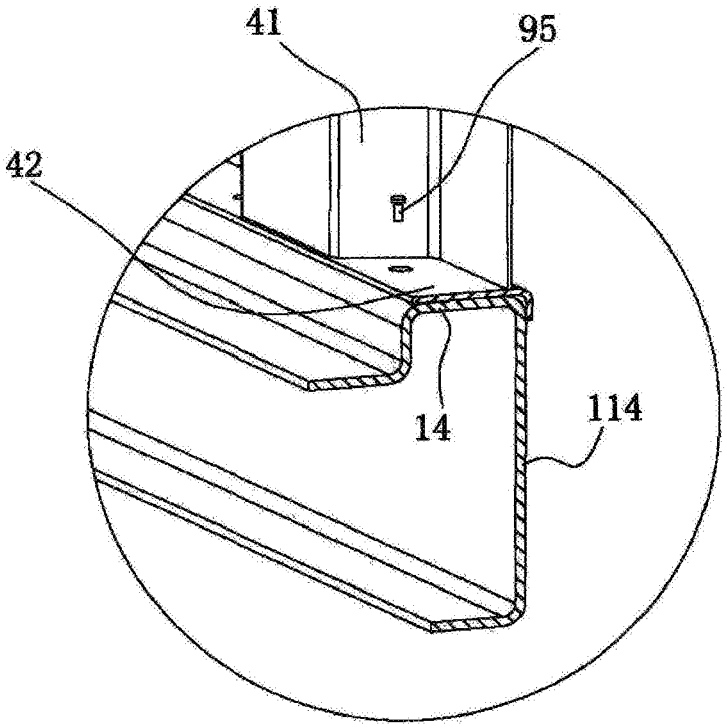
Figure 10B:
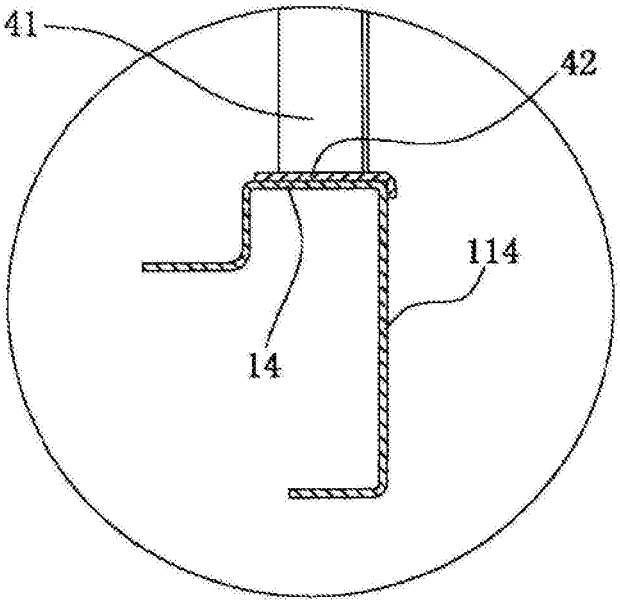
Figure 10B:
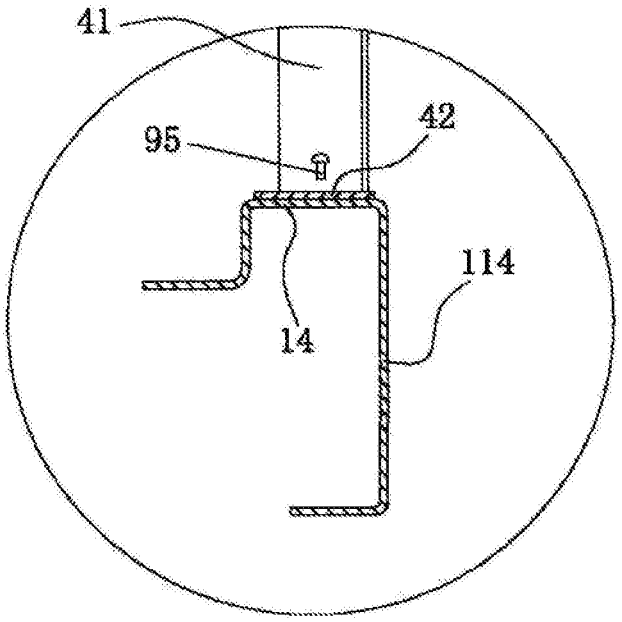

Referring to FIGS. 10A-10B, they show connection relations of the bottom finished module 1 and the front finished module 4 at the sides of the front end bottom beam 114.

Referring to FIGS. 10A and 10A1 which show the first embodiment, it shows therein: the front end bottom beam 114 and the bottom front connecting part 14 of the bottom finished module 1; the front end body 41 and the front bottom connecting part 42 of the front finished module 4; and the connecting piece 95. The front end bottom beam 114 comprises an upper flange, a lower flange, and a web connected between the upper and lower flanges. The upper flange further comprises a first flat plate extending backwardly from the web (equivalent to an abutting wall horizontally extending), a vertical plate bent by extending downwardly from the first flat plate, and a second flat plate further extending backwardly from a bottom of the vertical plate. A connecting hole is disposed in the first flat plate. The first flat plate forms the bottom front connecting part 14. The front bottom connecting part 42 is formed by a front end lower beam having a shape of L and comprising a flat plate (equivalent to an abutting wall horizontally extending) and side edge protruding downwardly from an outer side of the flat plate. The side edge is disposed on an outer side of the web of the front end bottom beam 114. The connecting piece 95 may be a fastener such as a bolt and a rivet disposed to penetrate into the corresponding connecting hole.

Referring to FIG. 10B which shows the second embodiment, it shows therein: the front end bottom beam 114 and the bottom front connecting part 14 of the bottom finished module 1; the front end body 41 and the front bottom connecting part 42 of the front finished module 4; and the connecting piece 95. The difference of the second embodiment with respect to the first one is: the front bottom connecting part 42 only has a flat plate structure (equivalent to an abutting wall horizontally extending), and the flat plate is fit from above to the first flat plate corresponding to the front end bottom beam 114 (equivalent to an abutting wall horizontally extending).

It would be noted, the connection of the bottom finished module 1 and the front finished module 4 at the front end bottom beam 114 can be achieved not only by the connecting pieces disposed to be inserted into the connecting holes disposed in structural pieces, but also by structural adhesives used separately or in combination.

Next, the connection relations of the top finished module 5 and the front finished module 4 at the sides will be discussed. The top front connecting part 54 of the top finished module 5 is disposed on the front end top beam 514 of the top body 51. Accordingly, the front top connecting part 45 of the front finished module 4 is disposed on the top of the front body 41. Preferably, the top finished module 5 and the front finished module 4 are assembled together at the bottom front connecting part 54 via a group of connecting pieces. Sealing of the connection of the top finished module 5 and the front finished module 4 may be achieved by: applying glue, an adhesive tape or an adhesive sheet and the like on the connection coupling surface or on an inner/outer side of the coupling surface.

Figure 11B:
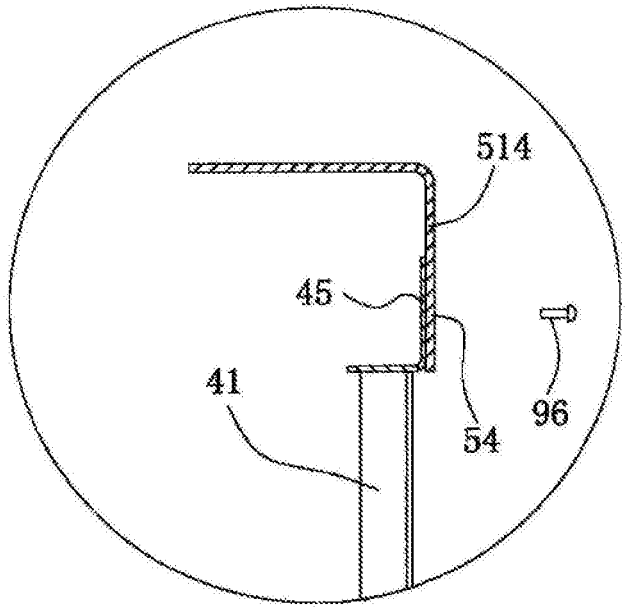

Referring to FIGS. 11A-11B, they show the connection relations of the top finished module 5 and the front finished module 4 at the sides of the front end top beam 514.

Referring to FIGS. 11A and 11A1 which show the first embodiment, it shows therein: the front end top beam 514 and the top front connecting part 54 of the top finished module 5; the front end body 41 and the front top connecting part 45 of the front finished module 4; and the connecting piece 96. The front end top beam 514 comprises a vertical plate (equivalent to an abutting wall extending vertically) with the connecting holes disposed therein. The vertical plate forms the top front connecting part 54. The front top connecting part 45 is formed by a front end upper beam which is C-shaped and comprises an upper flange, a lower flange, and a web connected between the upper and lower flanges (equivalent to an abutting wall extending vertically). The connecting holes are disposed in the web. The vertical plate of the front end top beam 514 is correspondingly disposed on an outer side of the web. The connecting piece 96 may be a fastener such as a bolt and a rivet disposed to penetrate into the corresponding connecting hole.

Referring to FIG. 11B which shows the second embodiment, it shows therein: the front end top beam 514 and the top front connecting part 54 of the top finished module 5; the front end body 41 and the front top connecting part 45 of the front finished module 4; and the connecting piece 96. The difference of the second embodiment with respect to the first embodiment is: the front top connecting part 45 has a shape of L, and comprises the lower flange and the web (equivalent to an abutting wall extending vertically) without the upper flange structure.

It would be noted, the connection of the top finished module 5 and the front finished module 4 at the front end top beam 514 can be achieved not only by the connecting pieces inserted into the connecting holes disposed in the structural pieces, but also by structural adhesives used separately or in combination.

Finally, the connection relations of the lateral finished module 2 and the front finished module 4 at the sides will be discussed. The lateral front connecting part 24 of the lateral finished module 2 is disposed on the front end corner pillar 212 of the lateral body 21. Accordingly, the front lateral connecting parts 43 of the front finished module 4 is disposed on a side of the front body 41. The lateral finished module 2 and the front finished module 4 are assembled together at the lateral front connecting part 24 via a group of connecting pieces. Sealing of the connection of the lateral finished module 2 and the front finished module 4 may be achieved by: applying glue, an adhesive tape or an adhesive sheet and the like on the connection coupling surface or on an inner/outer side of the coupling surface. The connection relations and sealing of the lateral finished module 3 and the front finished module 4 are similar to those of the lateral finished module 2 and the front finished module 4, no redundant discussion is repeated here.

Referring to FIGS. 12A-12D, they show the connection relations of the lateral finished module 2 and the front finished module 4 at the sides.

Figure 12A:
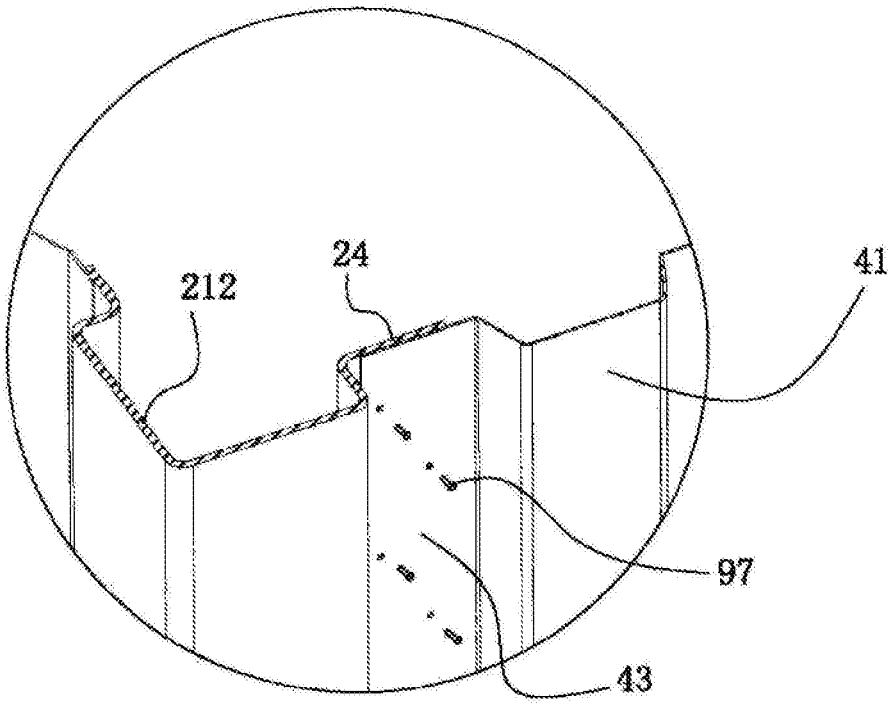

Referring to FIGS. 12A and 12A1 which show the first embodiment, it shows therein: the front end pillar 212 and the lateral front connecting part 24 of the lateral finished module 2; the front body 41 and the front lateral connecting parts 43 of the front finished module 4; and the connecting piece 97. The front end pillar 212 comprises a first overlapping plate extending inwardly and having connecting holes disposed therein. The first overlapping plate (equivalent to an abutting wall extending vertically) forms the lateral front connecting part 24. The front lateral connecting parts 43 is formed by a side of the front body 41 and composes a second overlapping plate (equivalent to an abutting wall extending vertically). A connecting hole(s) is disposed in the second overlapping plate. The second overlapping plate is positioned on a front side of the first overlapping plate. The connecting piece 97 may be a fastener such as a bolt and a rivet correspondingly disposed to penetrate into the connecting hole.

Figure 12B:
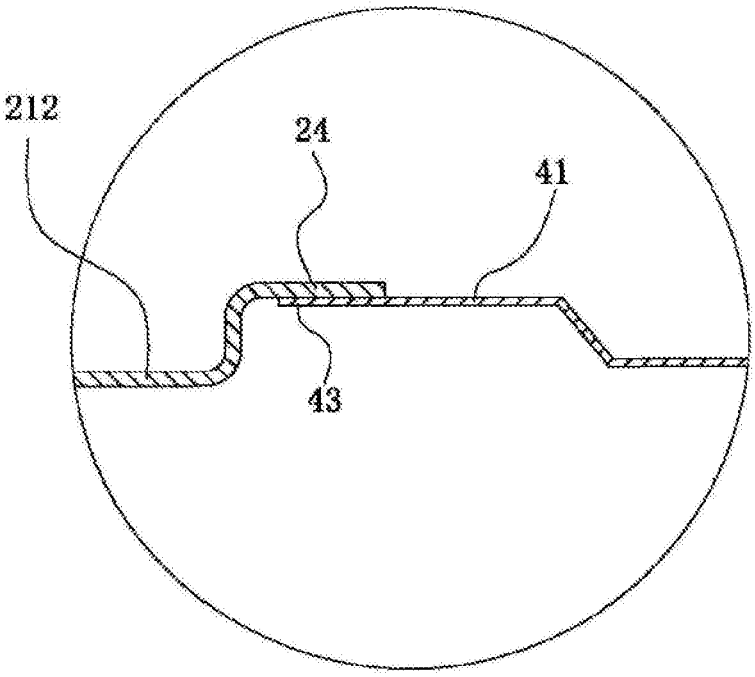
Figure 12B:
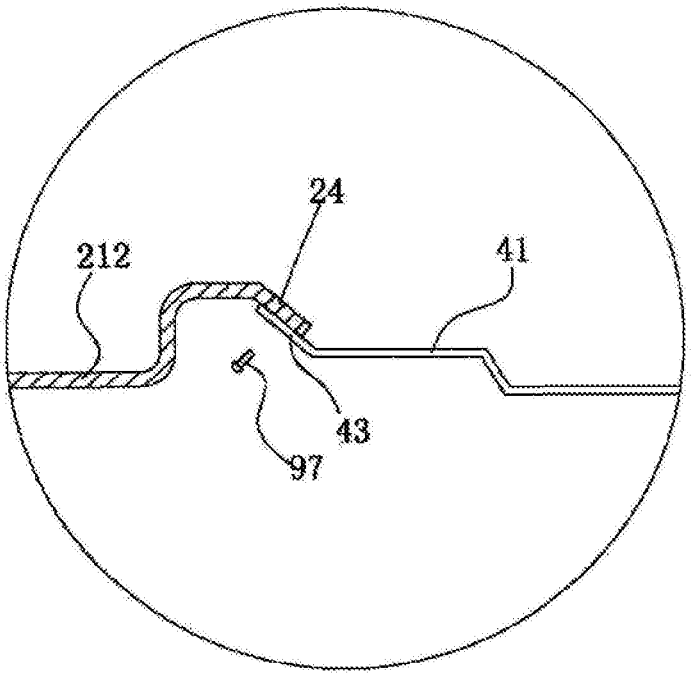

Referring to FIG. 12B which shows the second embodiment, it shows therein: the front end pillar 212 and the lateral front connecting part 24 of the lateral finished module 2; the front body 41 and the front lateral connecting parts 43 of the front finished module 4; and the connecting piece 97. The difference of the second embodiment with respect to the first embodiment is: the first overlapping plate comprises an overlapping piece inclined forwardly by bending and extending, and the second overlapping plate comprises an overlapping piece correspondingly inclined backwardly by bending and extending.

Figure 12C:
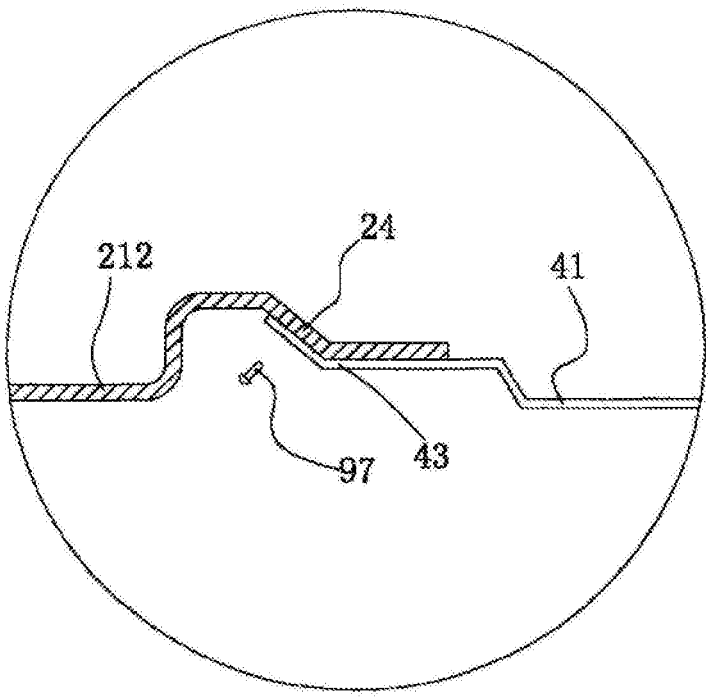

Referring to FIG. 12C which shows the third embodiment, it shows therein: the front end pillar 212 and the lateral front connecting part 24 of the lateral finished module 2; the front body 41 and the front lateral connecting parts 43 of the front finished module 4; and the connecting piece 97. The difference of third embodiment with respect to the second embodiment is: the first overlapping plate further comprises an extending part horizontally extending inwardly from the overlapping piece, so as to increase a fitting area to the second overlapping plate. In addition, the first overlapping plate may form a step shape in order to achieve water proof effect.

Figure 12D:
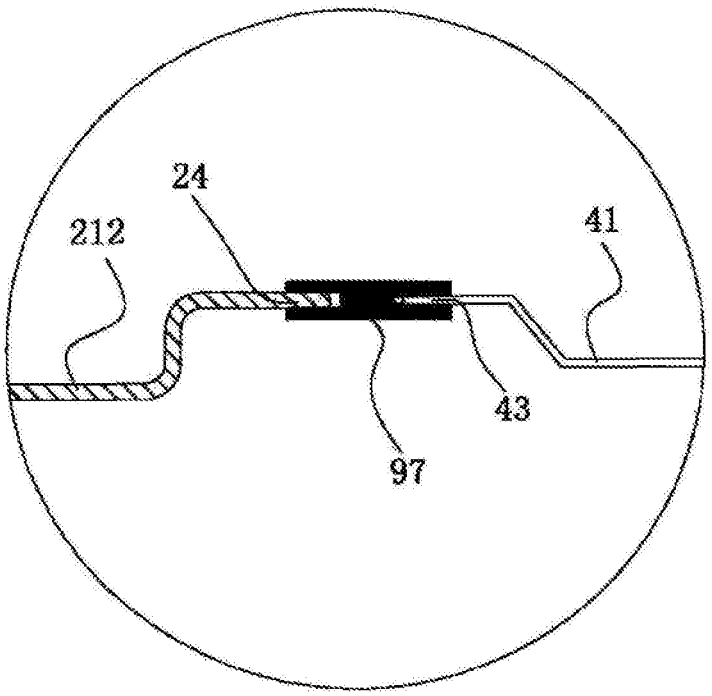

Referring to FIG. 12D which shows the fourth embodiment, it shows therein: the front end pillar 212 and the lateral front connecting part 24 of the lateral finished module 2; the front body 41 and the front lateral connecting parts 43 of the front finished module 4; and the connecting piece 97. The connecting piece 97 has a shape of H, and comprises a first receiving cavity corresponding to the lateral front connecting part 24 and a second receiving cavity corresponding to the front lateral connecting part 43.

It would be noted, the connection of the lateral finished module 2 and the front finished module 4 can be achieved not only by the connecting pieces inserted into the connecting holes disposed in the structural pieces, but also by structural adhesives used separately or in combination.

Turning back to FIGS. 1 to 2F, in a special embodiment of the sliced assembly type container according to the disclosure, the bottom finished module 1, the lateral finished module 2, the lateral finished module 3, the front finished module 4, and the top finished module 5 may be manufactured separately; and then, these modules 1-5 are assembled. The details are presented below.

Regions between the bottom finished module 1 and the lateral finished modules 2, 3, and regions between the lateral finished modules 2, 3 and the top finished module 5, out of the corners of the sliced assembly type container, may be fixedly connected together via fasteners such as rivets (that is, between the two bottom longitudinal beams of the bottom finished module 1 and the corresponding two bottom lateral beams of the lateral finished modules 2, 3, and between the two top lateral beams of top finished module 5 and the corresponding two top lateral beams of the top lateral finished modules 2, 3, there are totally four side connections);

Regions between the bottom finished module 1 and the lateral finished modules 2, 3, and regions between the lateral finished modules 2, 3 and the top finished module 5, in the corners of the sliced assembly type container, may be fixedly connected together via the connecting pieces (that is, between the four bottom corner fittings of the bottom finished module 1 and the corresponding four bottoms of the corner pillars of the lateral finished modules 2, 3, and between the four top corner fittings of the top finished module 5 and the corresponding four tops of the corner pillars of the lateral finished modules 2, 3, there are totally eight corner connections). Alternatively, at the at least one of the eight corners, fixed connection may be achieved by welding.

Between the bottom finished module 1 and the front finished module 4 (i.e., between the front end bottom beam of the bottom finished module 1 and the bottom of the front finished module 4), between the lateral finished modules 2, 3 and the front finished module 4 (i.e., between the front ends of the lateral finished modules 2,3 and both sides of the front finished module 4), and between the top finished module 5 and the front finished module 4 (i.e., between the front end top beams of the top finished module 5 and the top of the front finished module 4), there are totally four side connections, at which they are fixedly connected together by fasteners (e.g., rivets).

In the junctions among the modules 1-5, sealing is performed by applying glue, adhesive tape or adhesive sheet, so as to get a sample box. It would be noted, since there are many variations for the connection relations of the eight corners, and there are many variations for the connection relations of the eight side connections, the sample box is only a desirable container representing a series of sample boxes, in other words, it may represent any combination of the connections listed hereinbelow.

At connections of the eight corners: for the four corners at the door end, in one case, the structure as shown in FIG. 6A may be applicable; in another case, the structure as shown in FIG. 6C may be applicable; in a further case, the structure as shown in FIG. 6C1 may be applicable; in a further case, the structure as shown in FIG. 6C2 may be applicable. The inventor has determined after experiment: the structure as shown in FIG. 6C1 is most favorable. For the four corners at the front end, in one case, the structure as shown in FIG. 7A may be applicable; in another case, the structure as shown in FIG. 7C may be applicable; in a further case, the structure as shown in FIG. 6C1 may be applicable; in a further case, the structure as shown in FIG. 6C2 may be applicable. The inventor has determined after experiment: the structure as shown in FIG. 7A in cooperation with the structure as shown in FIG. 6C1, or the structure as shown in FIG. 7A1 in cooperation with the structure as shown in FIG. 6C1, are two favorable selections, which are helpful for assembling of the bottom finished module 1 (and the top finished module 5) and the lateral finished modules 2, 3.

At connections of the eight sides: for the bottom finished module 1 and the lateral finished modules 2, 3, in one case, the structure as shown in FIG. 8A may be applicable; in another case, the structure as shown in FIG. 8B may be applicable; in a further case, the structure as shown in FIG. 8C may be applicable. For the top finished module 5 and the lateral finished modules 2, 3, in one case, the structure as shown in FIG. 9A may be applicable; in another case, the structure as shown in FIG. 9B may be applicable; in a further case, the structure as shown in FIG. 9C may be applicable. For the bottom finished module 1 and the front finished module 4, in another case, the structure as shown in FIG. 10A may be applicable; in another case, the structure as shown in FIG. 10B may be applicable. For the top finished module 5 and the front finished module 4, in one case, the structure as shown in FIG. 11A may be applicable; in another case, the structure as shown in FIG. 11B may be applicable. For the lateral finished modules 2, 3 and the front finished module 4, in one case, the structure as shown in FIG. 12A may be applicable; in another case, the structure as shown in FIG. 12B may be applicable; and in a further case, the structure as shown in FIG. 12C may be applicable.

After experiment, the sample box satisfies the ISO requirements relating to the general cargo container (20 feet). The related requirements for the sample box meet the related regulations of ISO1496-1, 1990 (E), and are in consistent with the regulations to the related experiments under the standard item 6, specifically, the related requirements for the sample box comprise: stacking test, lifting test from the top corner fittings, lifting test from the bottom corner fittings, longitudinal fixation test, end wall strength test, side wall strength test, top strength test, bottom strength test, horizontal stiffness test, longitudinal stiffness test, fork lifting test, snatching test, and water tightness test. Moreover, the sample box satisfies the requirements of CSC1991 Amendment, and are in consistent with the regulations to test load and test procedure, specifically, the related requirements comprise: lifting, stacking, concentrated load, horizontal stiffness test, longitudinal fixation, end wall, and side wall. The sample box satisfies the requirements of UIC 592, and are in consistent with the regulations and method under item 3.5.2, specifically, the experiments comprise: stacking test, hanging top test, hanging bottom test, longitudinal fixation test, end wall strength test, side wall strength test, top strength test, bottom strength test, horizontal stiffness test, longitudinal stiffness test, fork lifting test, snatching test, and water tightness test. The sample box satisfies all the TIR requirements.

It would be noted, though the tests mentioned above are performed targeting to the sliced assembly type container of a 20-foot standard general cargo container, the respective inventive structures are not limited thereto, rather, the disclosure may be applied to a general cargo container of some other standard, for example: a general cargo container of 40-foot standard.

In comparison with the prior art, the disclosure can achieve connections of the finished modules by additionally disposing structures of abutting parts as much as possible, and increasing weight as little as possible, thus replacing the traditional welding. According to the disclosure, preferably, the connections of all the eight corners and eight sides can be achieved without welding. In this way, in the assembling process of the container, welding/painting process is unnecessary to be performed, so negative influence on environment of the assembling site can be greatly reduced. As a possible alternative, the connections of all the eight sides may be achieved without welding, and welding is locally or entirely performed to the connections of the eight corners. In this way, in the assembling process, only by performing little welding/painting, the negative influence on environment of the assembling site may be greatly reduced, too. The inventive sliced assembly type container can satisfy ISO requirements about a general cargo container and is in consistent with requirements about a container in CSC, UIC and TIR, thus a revolutionary change to the manufacturing and operation mode of the container may be brought.

In the context of the disclosure, the term "connecting piece" refers to any structural piece which has a certain shape and fixedly connects two structural pieces together, for example, a fastener such as a bolt or rivet. In another example, the connecting piece may be a structural piece such as a pin. In another example, the connecting piece may be a structural piece formed by using the characteristics of the material itself. In another example, the connecting piece may refer to two structural pieces having a cooperation relation such as a protrusion and a groove, or two structural pieces having a cooperation relation such as a clasp hook and a clasp slot.

Figure 13A:
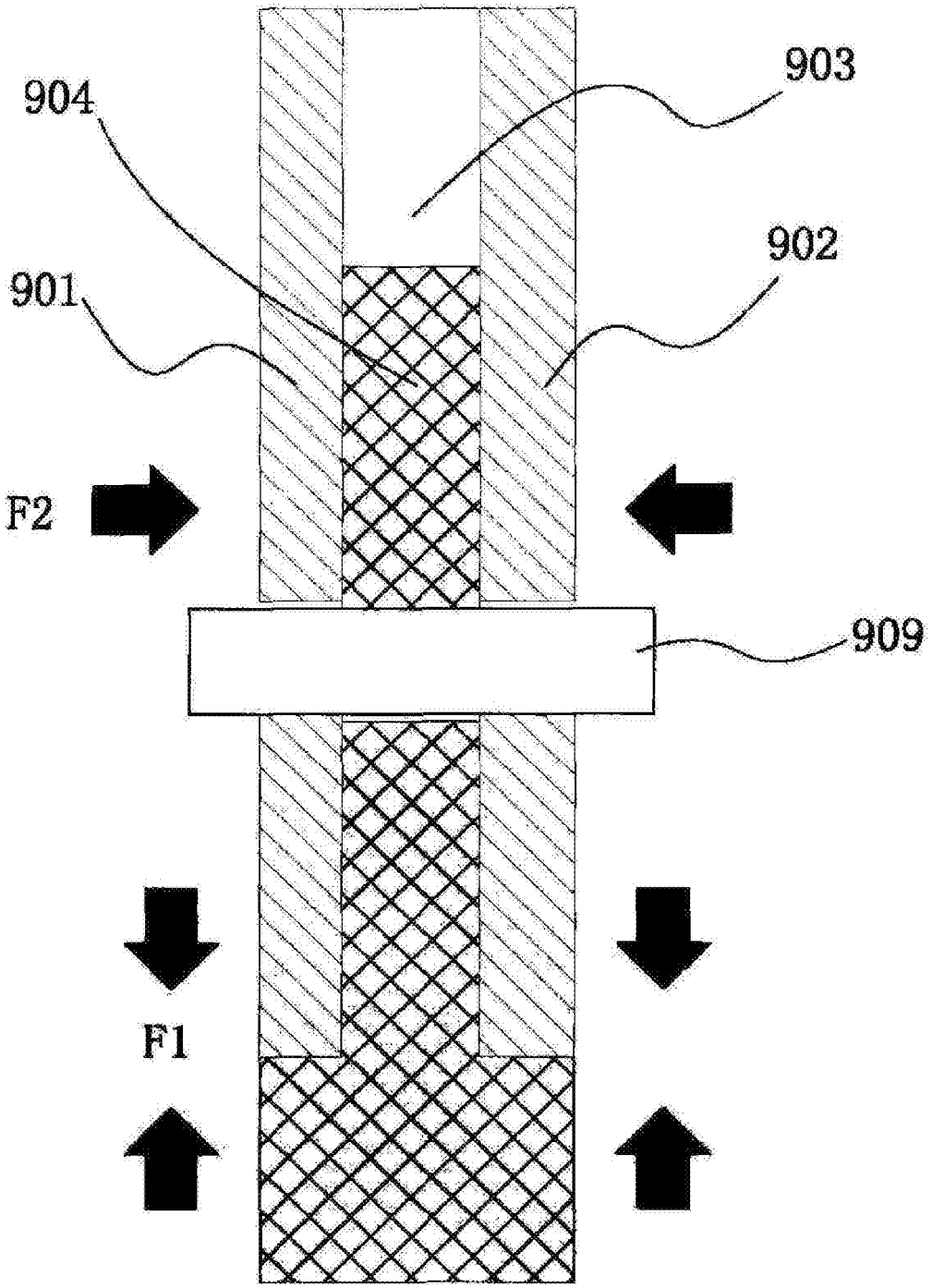
Figure 13B:
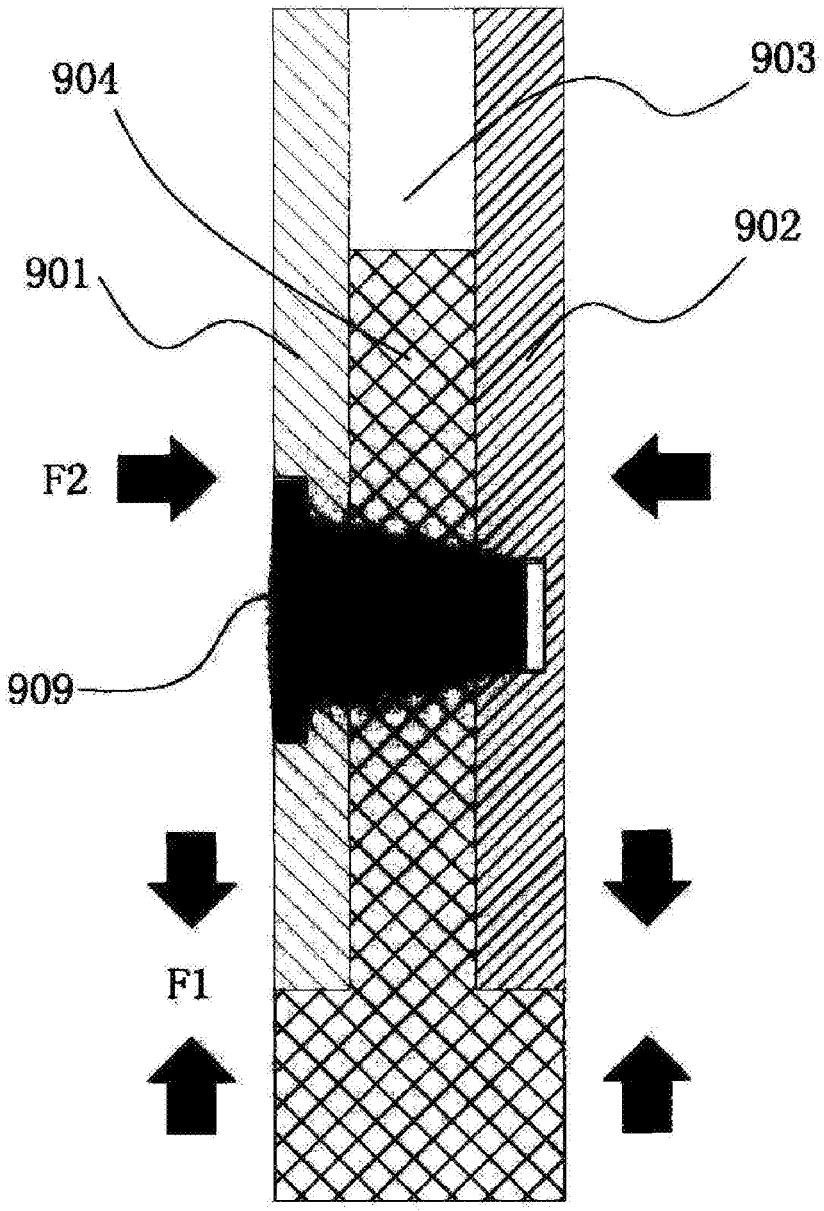
Figure 13C:
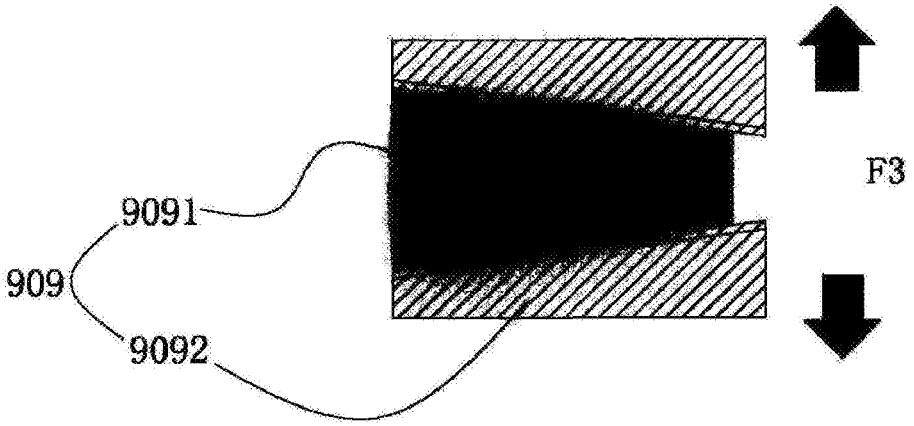
Figure 13D:
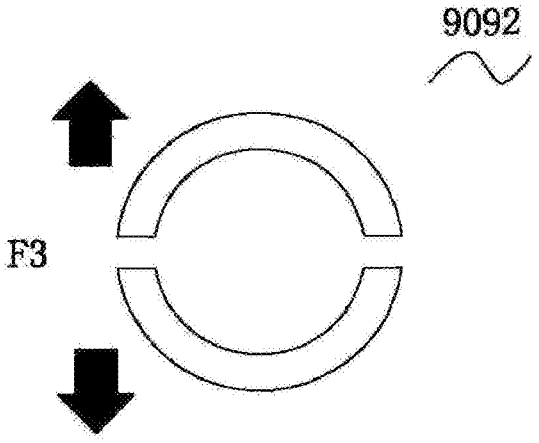

Preferably, at corner connections, if the connecting holes in two structural pieces which are cooperating with each other and to be fixedly connected together are located in a vertical plane, and the connecting pieces disposed to horizontally penetrate into these connecting holes, preferably, the connecting pieces have a locking effect, so as to assure a tight fit of the two structural pieces to be fixedly connected (e.g., a protrusion of a corner fitting and an abutting structure of a corner pillar). Referring to FIG. 13A, the corner pillar comprises a first corner pillar part 901 and a second member 902, the first corner pillar part 901 and the second member 902 cooperate with each other to form a receiving cavity 903, a protrusion 904 on the corner fitting may be correspondingly inserted into the receiving cavity 903. A fixed connection between the protrusion 904 and the receiving cavity may be achieved by a connecting piece 909 inserted into the connecting hole. A tightening force F1 in a vertical direction may be applied by the connecting piece 909, and most preferably, a tightening force F2 in a horizontal direction may be applied at the same time. There may be various specific structures of the connecting piece having locking effect, in addition to the rivet as shown in FIGS. 6C1 and 7A1, the pin and its combination as shown in FIGS. 6A, 6D and 6E, the structures may further comprise, for example, the structure having a middle taper end with a threaded end as shown in FIG. 13B. In such case, the second member 902 of the corner pillar is threaded. When the connecting piece 909 is threaded in, the taper face of the connecting piece 909 would cooperate with taper faces of the first corner pillar part 901 of the corner pillar and the protrusion 904. As the connecting piece 909 is threaded further, the protrusion 904 may closely fit to the first corner pillar part 901 of the corner pillar and the second member 902 in vertical direction. Moreover, in the combination structure as shown in FIGS. 13C and 13D, the connecting piece 909 comprises a piece 9091 having a metric taper thread and a double semicircle piece 9092 also having a taper thread. When the piece 9091 enters the piece 9092, a tension force F3 would be produced to force the double semicircle piece 9092 to separate upward and downward, thus eliminating the upper and lower gaps of the connecting hole, as a result, the concave block and the protrusion can be fastened in a vertical direction. Of course, the piece 9091 and the piece 9092 may be not threaded, but have taper faces instead. In assembling, the piece 9092 may be forced to enter the piece 9091, the same effect may be achieved, too.

According to the disclosure, the expression of "connecting piece having a locking effect" is used to specifically mean: if the connecting piece is substantively disposed to horizontally penetrate into the corresponding connecting hole, the connecting piece can cause the corresponding two structural pieces (e.g., a protrusion and a concave block) to closely cooperate with each other in a vertical direction. In order to perform a connection between, for example, a protrusion in a corner fitting and an abutting structure in a corner pillar, it is necessary for the connecting piece having a locking effect to be able to produce force in a vertical direction, such that the protrusion and the concave block in cooperation with each other may closely fit each other (in a vertical direction). Preferably, the connecting piece having a locking effect may be able to produce a force in a horizontal direction, such that the protrusion and the concave block in cooperation with each other may closely fit each other (in a horizontal direction). The rivet is most preferable, because it can not only perform locking in a vertical direction, but also perform locking in a horizontal direction. In addition, since the rivet may completely eliminate the gap around the connecting hole, the assembly error of the connecting hole is tolerable, consequently, it is not necessary to over strictly control the machining accuracy of the finished modules, and that is helpful for assembling of the container. In the context of the disclosure, the expression "horizontally penetrating" means the angle of the connecting piece with respect to the horizontal plane is within a range of ±30°; similarly, the expression "horizontally overlapping surface" means the angle of the overlapping surface of the structural piece with respect to the horizontal surface is within a range of ±30°; furthermore, the expression "vertically overlapping surface" means the angle of the overlapping surface of the structural piece with respect to the vertical surface of the horizontal surface is within a range of ±30°. In other words, in the context of the disclosure, the term "horizontal" may be understood to have an angle, e.g., within a range of ±30°, with respect to the horizontal surface; and in the context of the disclosure, the term "vertical" may be understood to have an angle, e.g., within a range of ±30°, with respect to the vertical surface of the horizontal surface.

It would be noted, while in the above embodiments, the connecting hole is illustrated as a circular hole, in other embodiments, the connecting hole may be a hole of other shape according to the actual situation, for example, the connecting hole may be a square hole. Accordingly, the connecting piece may be have some other shapes, for example, a wedge block/wedge cavity may be formed in a protrusion and/or concave block, then, a wedge connecting piece is inserted thereinto, and the connecting piece may have an locking effect. While in the above embodiments, overlapping is illustrated as horizontally overlapping and vertical overlapping, in other embodiments, overlapping may be performed to other overlapping surfaces, for example, inclined surface overlapping, curved surface overlapping. While in the above embodiments, for sake of convenience, two kinds of fitting, plug-in and overlapping, are illustrated, the disclosure is not limited to this in fact. For example, while the embodiments shown in FIGS. 6C2, 6C3 is illustrated as a vertical overlapping, in fact, the embodiments may be understood as inserting in a horizontal direction is performed, because in the process of assembling the lateral finished modules to the bottom finished module, actually fitting of horizontally moving the lateral finished modules toward the sides of the bottom finished module is performed, so fitting of overlapping combining with plug-in is performed.

Therefore, the embodiments described above are merely some preferable ones, and the disclosure is not limited to any specific details of these embodiments. An ordinary person skilled in the art would readily appreciate that modifications or changes based on the principles of the disclosure. Accordingly, the scope of the present invention should be limited solely by the appended claims.

What is claimed is:

1. A sliced assembly type container, comprising: a bottom finished module, two lateral finished modules, two door finished modules respectively hinged to door ends of lateral bodies of the two lateral finished modules, a top finished module, and a front finished module, wherein:

the bottom finished module comprises:

a bottom body, comprising two door end bottom corner fittings, two bottom longitudinal beams and two front end bottom corner fittings, respectively disposed on both lateral sides of the bottom body;

two bottom lateral connecting parts, respectively disposed on both sides of the bottom body to fixedly connect the two lateral finished modules, wherein each of the bottom lateral connecting parts comprises: a lateral connecting element, a first corner connecting element at the door end of the lateral connecting element, and a second corner connecting element at a front end of the lateral connecting element; and a bottom front connecting part, disposed at a front end of the bottom body, to connect the front finished module;

each of the two lateral finished modules comprises:

a lateral body, comprising a lateral wall, a front end corner pillar connected to a front end of the lateral wall, and a door end corner pillar connected to a door end of the lateral wall;

lateral bottom connecting parts, disposed on a bottom side of the lateral body, to fixedly connect the bottom finished module, wherein each of the lateral bottom connecting parts comprises: a lateral connecting element, a first corner connecting element at a door end of the lateral connecting element, and a second corner connecting element at a front end of the lateral connecting element;

lateral top connecting parts, disposed on a top side of the lateral body, to fixedly connect the top finished module, wherein each of the lateral top connecting parts comprises: a lateral connecting element, a first corner connecting element at a door end of the lateral connecting element, and a second corner connecting element at a front end of the lateral connecting element; and a lateral front connecting part, disposed at a front end corner pillar of the lateral body, to connect the front finished module;

the top finished module comprises:

a top body, comprising two door end top corner fittings, two top longitudinal beams, and two front end top corner fittings positioned on both lateral sides of the top body;

two top lateral connecting parts, respectively disposed on both lateral sides of the top body, to fixedly connect the two lateral finished modules, wherein each of the top lateral connecting parts comprises: a lateral connecting element, a first corner connecting element at a door end of the lateral connecting element, and a second corner connecting element at a front end of the lateral connecting element; and a top front connecting part, disposed at the front end of the top body, to connect the front finished module;

the front finished module comprises:

a front body;

a front bottom connecting part, disposed on a bottom side of the front body, to connect the bottom finished module;

two front lateral connecting parts, respectively disposed on both sides of the front body, to connect the two lateral finished modules; and a front top connecting part, disposed on a top side of the front body, to connect the top finished module; and wherein the bottom finished module and the two lateral finished modules are fixedly connected through two pairs of the lateral connecting elements, and the two lateral finished modules and the top finished module are fixedly connected through another two pairs of the lateral connecting elements, each of the four pairs of the lateral connecting elements being able to be fixedly connected together via a connecting piece and/or a structural adhesive, wherein the connecting piece has a locking effect capable of producing force in a vertical direction and in a horizontal direction, and wherein the front lateral connecting part and the lateral front connecting part are fixedly connected together via a connecting piece, wherein the front lateral connecting part comprises a first abutting wall extending vertically, and the lateral front connecting part of each of the two lateral finished module comprises a second abutting wall extending vertically, wherein the connecting piece for fixing the two corresponding side connections has a shape of H and comprises a first clasp slot for clamping the first abutting wall and a second clasp slot for clamping the second abutting wall.

2. The sliced assembly type container according to claim 1, wherein the door finished module and each of the two lateral finished modules are one integrated finished module; or, the door finished modules and each of the two lateral finished modules are two finished modules separated from each other.

3. The sliced assembly type container according to claim 1, wherein:

the bottom body further comprises: a front end bottom beam connected between the two front end bottom corner fittings, a doorsill connected between of the two door end bottom corner fittings, and bottom crossbeams each connected between the two bottom longitudinal beams, and a floor;

the first corner connecting element of the bottom lateral connecting parts is disposed on a top of the door end bottom corner fitting, the second corner connecting element is disposed on a top of the front end bottom corner fitting, and the lateral connecting elements are disposed on a top of the bottom longitudinal beam;

the first corner connecting element of the lateral bottom connecting part is disposed on a bottom of the door end corner pillar, the second corner connecting element is disposed on a bottom of the front end corner pillar, and the lateral connecting elements are disposed on a bottom of the lateral wall; and the corresponding lateral connecting elements are able to be fixedly connected together via a connecting piece.

4. The sliced assembly type container according to claim 3, wherein the first corner connecting element of the bottom lateral connecting parts comprises a vertically extending protrusion; and the first corner connecting element of the lateral bottom connecting parts comprises a receiving cavity correspondingly for insertion of the protrusion; or the first corner connecting element of the lateral bottom connecting parts comprises a vertically extending protrusion; and the first corner connecting element of the bottom lateral connecting parts comprises a receiving cavity correspondingly for insertion of the protrusion; and wherein:

the two first corner connecting elements are able to be fixedly connected together by a connecting piece in cooperation with the protrusion and the receiving cavity.

5. The sliced assembly type container according to claim 4, wherein a connection structure of the two first corner connecting elements is selected from any one of the plug-in structures below:

a first plug-in structure, wherein: the first corner connecting element of the bottom lateral connecting part comprises an upwardly protruding protrusion, and a first connecting hole and first mounting holes around the first connecting hole are horizontally disposed in the protrusion; the first corner connecting element of the lateral bottom connecting part comprises a receiving cavity formed at a bottom of the door end corner pillar, and a second connecting hole and second mounting holes surrounding the second connecting hole are horizontally disposed in the bottom of the door end corner pillar at a position corresponding to the receiving cavity; the connecting piece comprises a connecting pin and a fastener, wherein the connecting pin is disposed to penetrate through the first and second connecting holes and has a locking effect and has third mounting holes disposed therein, and the fastener is disposed to penetrate into the first to third mounting holes;

a second plug-in structure, wherein: the first corner connecting element of the bottom lateral connecting part comprises a upwardly protruding protrusion, and a connecting hole is disposed in the protrusion; the first corner connecting element of the lateral bottom connecting part comprises a receiving cavity formed at the bottom of the door end corner pillar, and a connecting hole is disposed in the bottom of the door end corner pillar at a position corresponding to the receiving cavity; and the connecting pieces having a locking effect are disposed to penetrate into the connecting holes;

a third plug-in structure, wherein: the first corner connecting element of the bottom lateral connecting part comprises a upwardly protruding protrusion, and a connecting hole is disposed in the protrusion; the first corner connecting element of the lateral bottom connecting part comprises a receiving cavity formed at the bottom of the door end corner pillar, and a connecting hole is disposed in the bottom of the door end corner pillar at a position corresponding to the receiving cavity; the door end corner pillar comprises a first corner pillar part, a second corner pillar part and a reinforcing part, which all are welded together, wherein the reinforcing part is correspondingly welded in the bottom of the first corner pillar part/the second corner pillar part and located between the first corner pillar part and the second corner pillar part, and the connecting hole in the bottom of the door end corner pillar comprises holes formed in the first corner pillar part, the reinforcing part and the second corner pillar part, respectively; and the connecting piece having a locking effect is disposed to penetrate into the connecting holes;

a fourth plug-in structure, wherein: the first corner connecting element of the bottom lateral connecting part comprises an upwardly protruding protrusion, two connecting holes, and a mounting hole positioned on a side of each of the connecting holes and communicating with the connecting holes, wherein the two connecting holes and the mounting hole are disposed in the protrusion; the first corner connecting element of the lateral bottom connecting part comprises a receiving cavity formed at the bottom of the door end corner pillar, two connecting holes and a mounting hole positioned on a side of each of the connecting holes and communicating with the connecting holes, wherein the two connecting holes and the mounting hole are horizontally disposed in the bottom of the door end corner pillar at a position corresponding to the receiving cavity; and the connecting piece comprises two connecting pins and a fastener, wherein the connecting pins are correspondingly disposed to penetrate into the connecting holes and have locking effect, and the fastener is correspondingly disposed to penetrate into the mounting holes;

a fifth plug-in structure, wherein: the first corner connecting element of the bottom lateral connecting parts comprises a upwardly protruding protrusion, and a connecting hole is disposed in the protrusion; the first corner connecting element of the lateral bottom connecting part comprises a receiving cavity formed at the bottom of the door end corner pillar, and a connecting hole is disposed in the bottom of the door end corner pillar at a position corresponding to the receiving cavity; and the connecting piece comprises a bolt having a locking effect and a tail cone and being correspondingly disposed to penetrate into the connecting holes;

a sixth plug-in structure, wherein: the first corner connecting element of the bottom lateral connecting part comprises a connecting block having a downwardly depressed receiving cavity, the connecting block having a horizontally traversing connecting hole disposed therein; the first corner connecting element of the lateral bottom connecting part comprises a downwardly protruding protrusion, and a connecting hole is disposed in the protrusion to horizontally pass therethrough; and the connecting piece has a locking effect and is disposed to penetrate into the connecting holes;

a seventh plug-in structure, wherein: the first corner connecting element of the bottom lateral connecting parts comprises a vertically extending protrusion; the first corner connecting element of the lateral bottom connecting part comprises a receiving cavity for insertion of the protrusion; and the connecting piece is formed by solidification of a filler injected into the receiving cavity; and an eighth plug-in structure, wherein: the first corner connecting element of the lateral bottom connecting part comprises a vertically extending protrusion; the first corner connecting element of the bottom lateral connecting part comprises a receiving cavity for insertion of the protrusion; and the connecting piece is formed by solidification of a filler injected into the receiving cavity.

6. The sliced assembly type container according to claim 5, wherein the connecting piece having a locking effect is a rivet.

7. The sliced assembly type container according to claim 3, wherein: the first corner connecting element of the bottom lateral connecting parts comprises a first overlapping piece; the first corner connecting element of the lateral bottom connecting part comprises a second overlapping piece; and the first corner connecting element of the bottom lateral connecting parts and the first corner connecting element of the lateral bottom connecting part are able to be fixedly connected together by a connecting piece in cooperation with the two overlapping pieces.

8. The sliced assembly type container according to claim 7, wherein a connection structure configured to connect the first corner connecting element of the bottom lateral connecting parts and the first corner connecting element of the lateral bottom connecting part is selected from any of the overlapped structures below:

a first overlapped structure, wherein: the first overlapping piece has a horizontally overlapping surface with a connecting hole disposed therein; the second overlapping piece has a horizontally overlapping surface with a connecting hole disposed therein; and the connecting piece is selected to be a fastener correspondingly to penetrate into the connecting holes;

a second overlapped structure, wherein: the first overlapping piece has a vertically overlapping surface with a connecting hole disposed therein; the second overlapping piece has a vertically overlapping surface with a connecting hole disposed therein; and the connecting piece having a locking effect is disposed to penetrate into the connecting holes; and a third overlapped structure, wherein: the first overlapping piece has a vertically overlapping surface with a connecting hole disposed therein; the second overlapping piece has a vertically overlapping surface with a connecting hole disposed therein, wherein one of the two overlapping pieces has an overlapping surface with a clasp slot depressed therein, and the other of the two overlapping pieces has an overlapping surface with a clasp block protruded therein, the clasp block being in cooperation with the clasp slot; and the connecting piece having a locking effect is disposed to penetrate into the connecting holes.

9. The sliced assembly type container according to claim 8, wherein the connecting piece having a locking effect is a rivet.

10. The sliced assembly type container according to claim 3, wherein the second corner connecting element of the bottom lateral connecting part comprises a first overlapping piece; the second corner connecting element of the lateral bottom connecting part comprises a second overlapping piece; and the second corner connecting element of the bottom lateral connecting part and the second corner connecting element of the lateral bottom connecting part are able to be fixedly connected together by a connecting piece in cooperation with the two overlapping pieces.

11. The sliced assembly type container according to claim 10, wherein a connection structure configured to connect the second corner connecting element of the bottom lateral connecting part and the second corner connecting element of the lateral bottom connecting part is selected from any of the overlapped structures below:

a first overlapped structure, wherein: the first overlapping piece has a horizontally overlapping surface with a connecting hole disposed therein; the second overlapping piece has a horizontally overlapping surface with a connecting hole disposed therein; and the connecting piece is chosen to be a fastener correspondingly to penetrate into the connecting holes;

a second overlapped structure, wherein: the first overlapping piece has a vertically overlapping surface with a connecting hole disposed therein; the second overlapping piece has a vertically overlapping surface with a connecting hole disposed therein; and the connecting piece having a locking effect is disposed to penetrate into the connecting holes;

a third overlapped structure, wherein: the first overlapping piece has a vertically overlapping surface with a connecting hole disposed therein; the second overlapping piece has a vertically overlapping surface with a connecting hole disposed therein, wherein one of the two overlapping pieces has an overlapping surface with a clasp slot depressed therein, and the other of the two overlapping pieces has an overlapping surface with a clasp block protruded therein, the clasp block being in cooperation with the clasp slot; and the connecting piece is disposed to penetrate into the connecting holes, and the connecting piece having a locking effect may be selected; and a fourth overlapped structure, wherein: the first overlapping piece comprises a first part having a vertically overlapping surface with a connecting hole disposed therein, and a second part having a horizontally overlapping surface with a connecting hole disposed therein; the second overlapping piece comprises a first part having a vertically overlapping surface with a connecting hole disposed therein, and a second part having a horizontally overlapping surface with a connecting hole disposed therein; and the connecting pieces are disposed to horizontally penetrate into the connecting holes and disposed to vertically penetrate into the connecting holes, wherein the connecting piece disposed to horizontally penetrate into the connecting holes is selected to be a connecting piece having a locking effect, and the connecting piece disposed to vertically penetrate into the connecting holes is a fastener.

12. The sliced assembly type container according to claim 11, wherein in any of the overlapped structures, the first overlapping piece has a shape of L, and the second overlapping piece has a shape of L.

13. The sliced assembly type container according to claim 11, wherein the connecting piece having a locking effect is a rivet.

14. The sliced assembly type container according to claim 3, wherein:

the second corner connecting elements of the bottom lateral connecting part comprises a vertically extending protrusion; the second corner connecting elements of the lateral bottom connecting part comprises a receiving cavity for insertion of the protrusion; or the second corner connecting elements of the lateral bottom connecting part comprises a vertically extending protrusion; the second corner connecting elements of the bottom lateral connecting part comprises a receiving cavity for insertion of the protrusion; and wherein the second corner connecting element of the bottom lateral connecting part and the second corner connecting element of the lateral bottom connecting part are able to be fixedly connected together by a connecting piece in cooperation with the two overlapping pieces.

15. The sliced assembly type container according to claim 14, wherein a connection structure configured to connect the second corner connecting elements of the bottom lateral connecting part and the second corner connecting elements of the lateral bottom connecting part is selected from any one of the plug-in structures below:

a first plug-in structure, wherein: the second corner connecting element of the bottom lateral connecting part comprises upwardly protruding protrusion, and a connecting hole is disposed in the protrusion; the second corner connecting element of the lateral bottom connecting part comprises a receiving cavity formed at the bottom of front end corner pillar; and the connecting piece having a locking effect is disposed to penetrate into the connecting holes;

a second plug-in structure, wherein: the second corner connecting element of the bottom lateral connecting part comprises upwardly protruding protrusion, and a connecting hole is disposed in the protrusion; the second corner connecting element of the lateral bottom connecting part comprises a receiving cavity formed at the bottom of the front end corner pillar, and a connecting hole being disposed in the protrusion in the bottom of the front end corner pillar at a position corresponding to the receiving cavity; the front end corner pillar comprises a first corner pillar part, a second corner pillar part and a reinforcing part, which all are welded together, wherein the reinforcing part is correspondingly welded in the bottom of the first corner pillar part/the second corner pillar part and located between the first corner pillar part and the second corner pillar part, the connecting hole in the bottom of the front end corner pillar comprises holes formed in the first corner pillar part, the reinforcing part and the second corner pillar part, respectively; and the connecting piece having a locking effect is disposed to penetrate into the connecting holes;

a third plug-in structure, wherein: the second corner connecting element of the bottom lateral connecting part comprises a connecting block having a downwardly depressed receiving cavity, the connecting block having a connecting hole disposed therein; the second corner connecting element of the lateral bottom connecting part comprises a downwardly protruding protrusion, and a connecting hole is disposed in the protrusion; and the connecting piece having a locking effect is disposed to penetrate into the connecting holes;

a fourth plug-in structure, wherein: the second corner connecting element of the bottom lateral connecting part comprises a vertically extending protrusion; the second corner connecting element of the lateral bottom connecting part comprises a receiving cavity for insertion of the protrusion; and the connecting piece is formed by solidification of a filler injected into the receiving cavity;

a fifth plug-in structure, wherein: the second corner connecting element of the lateral bottom connecting part comprises a vertically extending protrusion; the second corner connecting element of the bottom lateral connecting part comprises a receiving cavity for insertion of the protrusion; and the connecting piece is formed by solidification of a filler injected into the receiving cavity.

16. The sliced assembly type container according to claim 15, wherein the connecting piece having a locking effect is a rivet.

17. The sliced assembly type container according to claim 3, wherein:

the first corner connecting element of the bottom lateral connecting parts comprises an upwardly protruding protrusion, and a connecting hole is disposed in the protrusion;

the first corner connecting element of the lateral bottom connecting part comprises a receiving cavity formed at a bottom of the door end corner pillar, and a connecting hole is disposed in the bottom of the door end corner pillar at a position corresponding to the receiving cavity;

the connecting piece having a locking effect to fixedly connecting the first corner connecting element of the bottom lateral connecting part and the first corner connecting element of the lateral bottom is disposed correspondingly penetrate into the connecting holes;

the second corner connecting element of the bottom lateral connecting part comprises a first overlapping piece;

the second corner connecting element of the lateral bottom connecting part comprises a second overlapping piece; and the connecting piece to fixedly connecting the second corner connecting element of the bottom lateral connecting part and the second corner connecting element of the lateral bottom is disposed correspondingly penetrate into the connecting holes, and if the two overlapping pieces are horizontally overlapped, then the connecting piece is a fastener, if the two overlapping pieces are vertically overlapped, then the connecting piece having a locking effect is selected.

18. The sliced assembly type container according to claim 17, wherein the connecting piece having a locking effect is a rivet.

19. The sliced assembly type container according to claim 3, wherein:

the lateral connecting element of the bottom lateral connecting part comprises a first abutting wall extending horizontally, and a connecting hole is disposed in the abutting wall;

the lateral connecting element of the lateral bottom connecting part comprises a second abutting wall extending horizontally, and a connecting hole is disposed in the abutting wall; and the connecting piece to fixedly connect the corresponding two lateral connecting elements is a fastener disposed correspondingly to penetrate into the two connecting holes.

20. The sliced assembly type container according to claim 19, wherein:

the second abutting wall has a downwardly protruding outer side edge at an outer side thereof, and the outer side edge is positioned corresponding to an outer side of the first abutting wall; or the second abutting wall has an outer side edge protruding downwardly from an outer side thereof, and the outer side edge is positioned corresponding to an outer side of the first abutting wall, further, the second abutting wall has an inner side edge protruding downwardly from an inner side thereof, and the inner side edge is positioned corresponding to an inner side of the first abutting wall.

21. The sliced assembly type container according to claim 3, wherein:

the lateral connecting element of the bottom lateral connecting part comprises a first abutting wall extending vertically, and a connecting hole is disposed in the abutting wall;

the lateral connecting element of the lateral bottom connecting part comprises a second abutting wall extending vertically, and a connecting hole is disposed in the abutting wall;

the second abutting wall is correspondingly positioned on an outer side of the first abutting wall, or the first abutting wall is correspondingly positioned on an outer side of the second abutting wall; and the connecting piece to fixedly connect the corresponding two lateral connecting elements is a fastener disposed correspondingly to penetrate into the two connecting holes.

22. The sliced assembly type container according to claim 1, wherein:

the bottom body further comprises a front end bottom beam connected between the two front end bottom corner fittings, a doorsill connected between the two door end bottom corner fittings, a crossbeam connected between the two bottom longitudinal beams, and a floor;

the bottom front connecting part is disposed on the front end bottom beam of the bottom body; and the front bottom connecting part and the bottom front connecting part are fixedly connected together via a connecting piece.

23. The sliced assembly type container according to claim 22, wherein:

the front bottom connecting part comprises a first abutting wall extending horizontally, and a connecting hole is disposed in the abutting wall;

the bottom front connecting part comprises a second abutting wall extending horizontally, and a connecting hole is disposed in the abutting wall; and the connecting piece for fixing the corresponding two side connections is a fastener correspondingly disposed to penetrate into the two connecting holes.

24. The sliced assembly type container according to claim 23, wherein: the first abutting wall has an outer side edge protruding downwardly from an outer side thereof, and the outer side edge is correspondingly positioned on an outer side of the second abutting wall; and/or, the first abutting wall has an inner side edge protruding downwardly from an inner side thereof, and the inner side edge is correspondingly positioned on an inner side of the second abutting wall.

25. The sliced assembly type container according to claim 1, wherein: the top body further comprises a front end top beam connected between two of the front end top corner fittings, a lintel connected between the two door end top corner fittings, and a top plate; the top front connecting part is disposed on the front end top beam of the top body; and the front top connecting part and the top front connecting part are fixedly connected together via a connecting piece.

26. The sliced assembly type container according to claim 25, wherein:

the front top connecting part comprises a first abutting wall extending vertically, and a connecting hole is disposed in the abutting wall;

the top front connecting part comprises a second abutting wall extending vertically, and a connecting hole is disposed in the abutting wall, wherein the second abutting wall is positioned on an outer side of the first abutting wall, or, the first abutting wall is positioned on an outer side of the second abutting wall; and the connecting piece for fixing the corresponding two side connections is a fastener correspondingly disposed to penetrate into the two connecting holes.

27. The sliced assembly type container according to claim 1, wherein:

the lateral front connecting part of each of the two lateral finished modules is disposed on the front end corner pillar of the lateral body;

the front lateral connecting part and the lateral front connecting part are fixedly connected together via a connecting piece;

the front lateral connecting part comprises a first abutting wall extending vertically, and a connecting hole is disposed in the abutting wall; the lateral front connecting part comprises a second abutting wall extending vertically, and a connecting hole is disposed in the abutting wall, wherein the second abutting wall is positioned on an outer side of the first abutting wall, or the first abutting wall is positioned on an outer side of the second abutting wall; and the connecting piece for fixing the corresponding two side connections is a fastener correspondingly disposed to penetrate into the two connecting holes.

28. The sliced assembly type container according to claim 1, wherein between the bottom finished module and the front finished module, between the top finished module and the front finished module, as well as between the two lateral finished modules and the front finished module, there are totally four pairs of side connections each being able to be fixedly connected together via a connecting piece and/or a structural adhesive, and the connecting piece has a locking effect to be able to produce force in a vertical direction and in a horizontal direction; and wherein:

the bottom finished module and the two lateral finished modules are fixedly connected through four pairs of the corner connection elements and the two lateral finished modules and the top finished module are fixedly connected through another four pairs of the corner connection elements, each of the eight pairs of the corner connection elements being able to be fixedly connected together via a connecting piece, wherein the connecting piece has a locking effect to be able to produce force in a vertical direction and in a horizontal direction; or the bottom finished module and the two lateral finished modules are fixedly connected through four pairs of the corner connection elements, and the two lateral finished modules and the top finished module are fixedly connected through another four pairs of the corner connection elements, wherein at least one of the eight pairs of the corner connection elements is able to be fixedly connected together via welding and the rest of the eight pairs are able to be fixedly connected together via a connecting piece and/or welding.

29. The sliced assembly type container according to claim 1, wherein:

the front finished module is hinged to one module of the two lateral finished modules, the bottom finished module, and the top finished module; and the front finished module is able to be fixedly connected to each of the rest modules of the two lateral finished modules, the bottom finished module, and the top finished module via a connecting piece and/or a structural adhesive, wherein the connecting piece has a locking effect to be able to produce force in a vertical direction and in a horizontal direction; and the bottom finished module and the two lateral finished modules are fixedly connected through four pairs of the corner connection elements, and the two lateral finished modules and the top finished module are fixedly connected through another four pairs of the corner connection elements, each of the eight pairs of the corner connection elements being able to be fixedly connected together via a connecting piece, wherein the connecting piece has a locking effect to be able to produce force in a vertical direction and in a horizontal direction.

30. The sliced assembly type container according to claim 29, wherein one of the front finished module, the two lateral finished modules, the bottom finished module, and the top finished module is able to be a coupled finished module; or, the front finished module and the other finished modules are finished modules separated from each other.

31. The sliced assembly type container according to claim 1, wherein sealing is able to be performed on coupled portions between the modules of the sliced assembly type container by applying a glue, an adhesive tape or adhesive sheet.

32. A method for manufacturing the sliced assembly type container of claim 1, wherein the method comprises:

a manufacturing process of finished modules for separately manufacturing the bottom finished module, the two lateral finished modules, the two door finished modules, the top finished module, and the front finished module; and an assembling process of the container for assembling the finished modules together, comprising:

locating the bottom finished module at first;

mounting the two lateral finished modules on both sides of the bottom finished module via the connecting pieces;

mounting the front finished module to the bottom finished module via the connecting pieces;

mounting the top finished module to two lateral finished modules via the connecting pieces; and sealing coupled portions between the modules by applying a glue, an adhesive tape or adhesive sheet;

wherein the connecting piece has a locking effect to be able to produce force in a vertical direction and in a horizontal direction; and the two door finished modules are able to be coupled to the two lateral finished modules during the manufacturing process of finished modules in advance, or assembled with the two lateral finished modules during the assembling process of the container.

* * * * *